US011400385B2

(12) United States Patent
Heine et al.

(10) Patent No.: US 11,400,385 B2
(45) Date of Patent: Aug. 2, 2022

(54) PLAY RING

(71) Applicant: Streitmonster GmbH, Berlin (DE)

(72) Inventors: Marcus Heine, Berlin (DE); Michael Grande, Berlin (DE)

(73) Assignee: Streitmonster GmbH, Berlin (DE)

( * ) Notice: Subject to any disclaimer, the term of this patent is extended or adjusted under 35 U.S.C. 154(b) by 0 days.

(21) Appl. No.: 17/043,053

(22) PCT Filed: Mar. 29, 2019

(86) PCT No.: PCT/EP2019/058094

§ 371 (c)(1),
(2) Date: Sep. 29, 2020

(87) PCT Pub. No.: WO2019/185921

PCT Pub. Date: Oct. 3, 2019

(65) Prior Publication Data

US 2021/0016193 A1 Jan. 21, 2021

(30) Foreign Application Priority Data

Mar. 29, 2018 (EP) ..... 18165196

(51) Int. Cl.
*A63H 1/00* (2019.01)
*A63H 1/24* (2006.01)

(52) U.S. Cl.
CPC ..... *A63H 1/00* (2013.01); *A63H 1/24* (2013.01)

(58) Field of Classification Search
CPC ..... A63B 1/00
See application file for complete search history.

(56) References Cited

U.S. PATENT DOCUMENTS

| | | | | |
|---|---|---|---|---|
| 9,914,063 | B1 * | 3/2018 | McCoskery | A63H 29/08 |
| 10,537,819 | B2 * | 1/2020 | Waddell | A63H 33/00 |
| 10,625,172 | B2 * | 4/2020 | Mak | A63H 33/00 |
| 2009/0075553 | A1 * | 3/2009 | Van Dan Elzen | A63H 1/30 446/247 |
| 2018/0200638 | A1 * | 7/2018 | Chin | A63H 37/00 |
| 2018/0345155 | A1 * | 12/2018 | Philgreen | A63H 1/00 |

OTHER PUBLICATIONS

International Search Report and Written Opinion for International Patent Application No. PCT/EP2019/058094 dated Jul. 3, 2019, 9 pages.

* cited by examiner

*Primary Examiner* — John A Ricci
(74) *Attorney, Agent, or Firm* — Amin, Turocy & Watson, LLP

(57) ABSTRACT

The present invention relates a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position.

29 Claims, 7 Drawing Sheets

PLAY RING

The present invention relates to a toy, in particular a rotatable play body suitable for a children's game, consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position.

STATE OF THE ART

Toys are generally objects that are used for playing. Toys are usually used by children for playing, wherein the use of toys by adults is also not unusual. A toy is valued for its own sake and due to the joy on the game. A toy is used for the pleasure of playing with its material, its functions and its possibilities. By using a toy, the play instinct can be lived out. A toy can increase the desire to move or the need for communication. Toys in general do not necessarily and primarily serve certain learning purposes, but playing and toys can represent space and means which can promote children in their development. Through play, physical, cognitive and social skills and competences can be developed and trained. Playing with toys that are easy to handle has the reputation that, for example, nervousness can be reduced by playing with the toy. Such easy-to-handle toys are also used in the context of attention deficit/hyperactivity disorder (ADHS) or autism. Easy-to-handle toys can also be used to get rid of bad habits such as smoking, nail biting or to reduce stress. For withdrawing from stressful situations e.g. so-called anti-stress balls are mentioned here.

A spinning top is one of the oldest and best known toys. Spinning tops are bodies that rotate around an axis. Otherwise the spinning top can move freely, but it can also be forced with an axis in a certain direction. A spinning top serves as a toy for children by rotating it e.g. on a base around a vertical axis and then by keeping the axis direction for a while, while the spinning top moves around the base. Besides being used as a toy, spinning tops have historically been used for gambling and fortune telling. Examples of spinning tops include humming tops, throwing tops, whipping tops, standing up tops (tippe top) or gyroscopes.

Rotatable play bodies are thus especially suitable as toys which can be fun and enjoyable and with which a play instinct can be excellently lived out. The occupation with a rotatable play body is an ideal means to dispel e.g. arising boredom during a waiting period. In particular, lightweight and portable rotatable play bodies are a first-class opportunity to provide a possibility of employment and thus to take the fun and enjoyment generated by playing with the toy at any location.

Finger gyroscopes known from the state of the art often have two or more "spinner arms", such as those from DE 20 2017 103 662 U1, CN 107 754 323 A, CN 107 395 815 A or U.S. Pat. No. 9,914,063 B1, wherein the finger gyroscope has to be centred and held centrally on lateral cover caps. CN 107 320 973 discloses a finger gyroscope that has a side cover with a central recess in which a second cover is inserted to hold the finger gyroscope. The finger gyroscopes known from the state of the art are mainly designed to provide fun and enjoyment in the rotation of the rotatable body.

The objective of the present invention is to provide a new toy in particular a rotatable play ring which is suitable for a children's game and can be printed flat on the outwardly directed visible surface of the swing body located between the side caps, preferably with illustrations of toy figures, and from the rotational movement of the swing body one of the illustrations can be selected by abrupt stopping of the swing body.

According to the invention, this objective is solved by the technical teaching of independent claims. Further advantageous embodiments according to the invention result from the dependent claims, the description, the figures and the examples.

DESCRIPTION OF THE INVENTION

Surprisingly, it has been found that the objective of the present invention can be solved by a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position.

A further embodiment of the present invention is related to a rotatable play body suitable for a children's game consisting of a freely rotatable swing body (S) arranged between two mutually opposite disc-shaped side caps (K1) and (K2), wherein the swing body (S) exhibits an outer shell (M) with a first central recess (A1) and a centred ball bearing (L) with a second central recess (A2), and the centred ball bearing (L) is inserted in the first central recess (A1) of the outer shell (M), the first disc-shaped side cap (K1) has an outer face (F1) and, on the inner face (I1), a first centred extension (P1), the opposite second disc-shaped side cap (K2) exhibits an outer face (F2) and, on the inner face (I2), a second centred extension (P2), the first centred extension (P1) is suitable to engage in the second central recess (A2) of the centred ball bearing (L), and the second centred extension (P2) is suitable to engage in the second central recess (A2) of the centred ball bearing (L) and/or in the first centred extension (P1) of the first disc-shaped side cap (K1). The anchoring of the two side caps (K1) and (K2) in the swing body (S) is preferably such that the disc-shaped side caps (K1) and (K2) can be moved or pressed against the freely rotatable swing body (S) in order to fix the freely rotatable swing body (S), or to stop it, if it is rotating.

In other words, the present invention elates to a rotatable play body for a children's game consisting of a freely rotatable swing body (S) arranged between two mutually opposite disc-shaped side caps (K1) and (K2), wherein the swing body (S) exhibits an outer shell (M) with a first central recess (A1) and a centred ball bearing (L) with a second central recess (A2), and the centred ball bearing (L) is inserted in the first centra recess (A1) of the outer shell (M), the first disc-shaped side cap (K1) has an outer face (F1) and, on the inner face (I1), a first centred extension (P1), the opposite second disc-shaped side cap (K2) exhibits an outer face (F2) and, on the inner face (I2), a second centred extension (P2), the first centred extension (P1) is suitable to engage in the second central recess (A2) of the centred ball bearing (L), and the second centred extension (P2) is suitable to engage in the second central recess (A2) of the centred ball bearing (L) and/or in the first centred extension (P1) of the first disc-shaped side cap (K1).

The present invention relates to a rotatable play body suitable for a children's game consisting of a freely rotatable swing body (S) arranged between two mutually opposite disc-shaped side caps (K1) and (K2), wherein the swing body (S) exhibits an outer shell (M) with a first central recess (A1) and a centred ball bearing (L) with a second central recess (A2), and the centred ball bearing (L) is inserted in the first central recess (A1) of the outer shell (M), characterized in that the first disc-shaped side cap (K1) has an outer face (F1) and, on the inner face (I1), a first centred extension (P1), the opposite second disc-shaped side cap (K2) exhibits an outer face (F2) and, on the inner face (I2), a second centred extension (P2), the first centred extension (P1) is suitable to engage in the second central recess (A2) of the centred ball bearing (L), and the second centred extension (P2) is suitable to engage in the second central recess (A2) of the centred ball bearing (L) and/or in the first centred extension (P1) of the first disc-shaped side cap (K1).

In other words, the present invention relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the two disc-shaped side caps have outer faces and, on the inner face in each case, a centred extension suitable for engaging in the second central recess of the centred ball bearing and/or in the centred extension of the opposite disc-shaped side cap.

In other words, the present invention relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the outer shell concentrically encloses the centred ball bearing, the two disc-shaped side caps have outer faces and, on the inner face in each case, a centred extension suitable for engaging in the second central recess of the centred ball bearing and/or in the centred extension of the opposite disc-shaped side cap.

As mentioned above, the anchoring of the side caps in the swing body is designed in such a way that the rotating swing body can be abruptly stopped by pressing the disc-shaped side caps together at the outer edge or the swing body is preferably fixed in its position by pressing the side caps together.

Furthermore, the present invention relates to a rotatable play body for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for form-fit engaging in the swing body (S), wherein the disc-shaped side caps (K1) and (K2) are movable at the outer edge (R1) and (R2) towards the freely rotatable swing body (S) in order to fix the freely rotatable swing body (S) in its position.

In other words, the present invention relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), the first centred extension (P1) is suitable to engage in the second centred recess (A2) of the centred ball bearing (L), and the second centred extension (P2) is suitable to engage in the second centred recess (A2) of the centred ball bearing (L) and/or in the first centred extension (P1) of the first disc-shaped side cap (K1), wherein the disc-shaped side caps (K1) and (K2) are movable at the outer edge (R1) and (R2) towards the freely rotatable swing body (S) in order to fix the freely rotatable swing body (S) in its position.

Herein, the term "freely rotatable" is used synonymously for "rotatable" or "easily rotatable" and is intended to illustrate that the swing body (S) can be rotated by children easily and without significant effort.

In a preferred embodiment, the rotatable play body exhibits disc-shaped side caps (K1) and (K2) with a diameter in the range of 0.5 times to 1.2 times of the outer diameter of the swing body (S).

In preferred embodiments of the rotatable play body according to the present invention, the disc-shaped side caps (K1) and (K2) at the outer edge (R1) and (R2) are reversibly movable against the freely rotatable play body (S) by an acting compressive force (AF) in order to fix the position of the freely rotatable swing body (S). In other words, the disc-shaped side caps (K1) and (K2) at the outer edge (R1) and (R2) are reversibly movable against the freely rotatable play body (S) by an acting compressive force in order to fix the position of the freely rotatable swing body (S), and after decay of the applied compressive force to return to the position previous to the application of the compressive force, or to regain the distance to the freely rotatable swing body (S) as before the application of the compressive force.

In preferred embodiments of the rotatable play body according to the present invention, the freely rotatable swing body (S) with the outer shell (M) is cylindrical, and the outer cylindrical surface of the cylindrical swing body (S) is plane and printable. It is therefore particularly preferred that the outer radius of the outer shell (M) is constant. The printability of the cylindrical shell of the swing body (S) with pictures of e.g. two-dimensional game figures is essential for the suitability of the rotating play body as a play ring for a children's game. Essential for the children's game is that the rotating swing body (S) is stopped abruptly, preferably by pressing both side caps (K1) and (K2) at the outer edge (R1) and (R2) at two opposite positions, and thereby a picture was selected which is pointed to by a marking on a side cap or by a finger of the user. However, printability of the outwardly facing surface of the shell of the swing body (S) is only given if the surface is curved in the longitudinal direction according to the cylindrical shape but is plane in the traverse direction, i.e. parallel to the axis of rotation, and is not concave or convex. The printable visible surface of the shell of the swing body (S) per figure is at least 25 $mm^2$, preferably 50 $mm^2$, preferably 70 $mm^2$, preferably 80 $mm^2$, preferably 90 $mm^2$, preferably 100 $mm^2$, preferably 110 $mm^2$, preferably 120 $mm^2$, preferably 130 $mm^2$, preferably 140 $mm^2$, preferably 150 $mm^2$, preferably 160 $mm^2$, preferably 170 $mm^2$, preferably 180 $mm^2$, preferably 190 $mm^2$, preferably 200 $mm^2$, preferably 210 $mm^2$, preferably 220 $mm^2$.

The outer shell (M) is preferably cylindrical or exhibits preferably a triangular, rectangular, pentagonal, hexagonal, heptagonal, octagonal or polygonal shape.

Preferably, the first disc-shaped side cap (K1) and/or the second disc-shaped side cap (K2) is/are cylindrical or has/have a triangular, rectangular, pentagonal, hexagonal, heptagonal, octagonal or polygonal shape.

Furthermore, the freely rotatable swing body (S) with the outer shell (M) is preferably cylindrical, and the outer cylindrical surface of the cylindrical swing body is plane and printable.

The wall thickness (W) of the cylindrical outer shell (M) of the freely rotatable swing body (S) is preferably constant. The outer radius of the cylindrical outer shell (M) of the freely rotatable swing body (S) is preferably constant.

In preferred embodiments, the distance ($B_0$) of the inner faces (I1, I2) of the mutually opposite disc-shaped side caps (K1) and (K2) is greater than the width ($B_3$) of the swing body (S). It is further preferred that the distance ($B_0$) of the inner faces (I1, I2) of the mutually opposite disc-shaped side caps (K1) and (K2) is greater than the width ($B_3$) of the outer shell (M) of the swing body (S). In other words, it is preferred that the distance ($B_0$) of the inner faces of the mutually opposite disc-shaped side caps (K1) and (K2) is the sum of the width ($B_3$) of the swing body (S), the distance ($B_4$) of the swing body to the inner face of the first disc-shaped side cap (K1) and the distance ($B_5$) of the swing body to the inner face of the second disc-shaped cap (K2).

The "swing body", as used herein, is the part of the rotatable play body that can be set in rotation or spin. Thereby, the swing body can rotate preferably around a central or centred axis perpendicular to the swing body. The swing body is preferably composed of an outer shell and a centred ball bearing. The outer shell and the centred ball bearing preferably each have a central recess. The central recess of the outer shell is referred to herein as the first central recess, while the central recess of the centred ball bearing is referred to herein as the second central recess. Thus, the swing body according to the invention is preferably composed of an outer shell with a first central recess and a centred ball bearing with a second central recess. According to the invention the outer shell with the first central recess and the centred ball bearing with the second central recess form a unit, which is referred to as swing body. Thus, the recess of the outer shell referred to as the first central recess can also be referred to as the first central recess of the swing body while the central recess of the centred ball bearing referred to as the second central recess can be referred to as the second central recess of the swing body.

According to the invention, the outer shell surrounds the centred ball bearing in a concentric manner. That means that depending on the shape of the outer shell the distance of the outer frame of the outer shell relative to the centred ball bearing and to the centre of the swing body is preferably constant. If the outer frame of the outer shell is e.g. cylindrical, the outer radius of the outer cylindrical shell relative to the centre of the swing body is constant. If the outer shell is cylindrical, the outer cylindrical outer shell exhibits a constant outer diameter according to the invention. If the first central recess of the outer shell or of the swing body is also cylindrical, the first central recess exhibits also a constant diameter according to the invention. Preferably, the swing body which exhibits a cylindrical outer shell with an outer and an inner side is referred to herein as swing ring. The side of the outer shell referred to as the outer side can be called the outer frame. The side referred to as the inner side of the outer shell is preferably the outer frame of the first central recess of the outer shell or the swing body, respectively. In preferred embodiments, the outer shell of the rotatable swing body is cylindrical and the outer cylindrical surface, also referred to as circumferential shell surface, is plane and printable. "Plane", as used herein, means that the outer cylindrical surface or the circumferential shell surface of a cylindrical outer shell is not concave or convex, i.e. the outer radius or outer diameter of the cylindrical outer shell is constant over the entire width ($B_3$) or height of the cylindrical outer shell and over the entire circumference of the cylindrical outer shell. In other words, the outer shell of the rotatable swing body does not exhibit dents or unevenness at the outer cylindrical surface or the circumferential I shell surface.

A straight circular cylinder, which has a central recess along its axis, is also called a hollow cylinder. For an outer shell of the rotatable swing body in form of hollow cylinder, the determining variables besides the height or width ($B_3$) of the outer shell of the rotatable swing body are the outer radius of the outer shell and the inner radius of the outer shell, wherein the inner radius as used herein also being referred to as the outer radius of the first central recess. The wall thickness (W) of the hollow cylinder is therefore the difference between the outer radius of the outer shell and the inner radius of the outer shell, i.e. the outer radius of the first central recess of the outer shell or swing body. In preferred embodiments, the outer shell of the rotatable swing body is cylindrical and exhibits particularly preferred the form of a hollow cylinder, wherein the outer cylindrical surface or circumferential shell surface is plane and printable, wherein the wall thickness (W) of the outer shell of the rotatable swing body in form of a hollow cylinder is constant. If the wall thickness (W) of the outer shell of the rotatable swing body in form of a hollow cylinder is constant, the outer cylindrical surface or circumferential shell surface, as used herein, is plane. It is thus preferred that the outer cylindrical surface or circumferential shell surface, is not convex, i.e. the wall thickness (W) at e.g. half width ($B_3$) of the outer shell of the rotatable swing body is not larger than at the edge of the outer shell of the rotatable swing body. It is further preferred that the outer cylinder surface or the circumferential shell surface is not concave, i.e. the wall thickness (W) at e.g. half width ($B_3$) of the outer shell of the rotatable swing body is not smaller than at the edge of the outer shell of the rotatable swing body. A cylindrical outer shell of a rotatable swing body in form of a hollow cylinder with a constant wall thickness (W) is rollable, i.e. it can be rolled over a surface. It could surprisingly be found that a cylindrical outer shell of a rotatable swing body in form of a hollow cylinder with a constant wall thickness (W) is particularly suitable and advantageous for the provision of a printable surface on the outer cylindrical surface or circumferential shell surface. Surprisingly, it was found that the complete cylindrical surface or circumferential shell surface is only printable over the whole circumference of the outer shell if the cylindrical surface or circumferential shell surface is plane.

The present invention is thus related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the swing body (S) with the outer shell (M) is cylindrical, and the outer cylindrical surface of the cylindrical swing body (S) is plane and printable, wherein preferably the wall thickness (W) of the cylindrical outer shell of the swing body is constant.

According to the invention the centred ball bearing is form-fitted within the first central recess of the outer shell. Form-fitting connections (positive connections/interlocking connections) are generated by interlocking of at least two connecting partners. As a result, the connecting partners cannot disengage even without or with interrupted force transmission. If, for example, the centred ball bearing is cylindrical towards the outside, i.e. the outer face or the outer frame of the centred ball bearing is cylindrical, and the first central recess of the outer shell or the swing body is also cylindrical, the first central recess exhibits preferably a diameter, which corresponds to the outer diameter of the cylindrical ball bearing or corresponds to such an extent that the centred ball bearing can be form-fit engaged in the first central recess. As used herein, corresponding to the diameter also means that a part which is form-fit engaged in a recess of a second part has an outer diameter which preferably corresponds substantially to the diameter of the recess of the second part. The skilled person in the art knows from the state of the art how a part with an outer diameter and a second part with a recess having a certain diameter can be manufactured so that they can be form-fitted with each other. Fitting a part with an outer diameter in the recess of a second part, wherein the diameter of the recess of the second part corresponds to the outer diameter of the first part, is also referred to herein as inserting or engaging this first part into the recess of the second part. Preferably, the fitting or inserting or engaging of a first part with an outer diameter into the recess of a second part represents herein a form-fitting or form-fit inserting or a form-fit engaging.

For form-fitting of the centred ball bearing in the first central recess of the outer shell or swing body, the outer shell can exhibit e.g. a groove. Grooves serve to fix, guide or countersink components as form-fitting connections. The form-fitting of the centred ball bearing in the first central recess of the outer shell or swing body, wherein the outer shell exhibits a groove on the inner side, is herein merely mentioned as a non-limiting example. For form-fitting of the centred ball bearing in the first central recess of the outer shell or swing body, the skilled person in the art can use any suitable method or known procedure known from production engineering.

Any suitable ball bearing known from the state of the art can be used for the swing body according to the invention. Preferably the swing body exhibits a centred roller bearing, more preferably a centred ball bearing. Roller bearings are bearings in which rolling elements between a so-called inner ring and an outer ring reduce the frictional resistance, in contrast to lubrication in plain bearings. They are used to fix axes and shafts, wherein they absorb radial and/or axial forces depending on their designs, and at the same time enable the rotation of the shaft or the components (e.g. a wheel) mounted on such an axis. Rolling friction mainly occurs between the three main components, inner ring, outer ring and rolling bodies. Ball bearings are the most frequently used roller bearings, as there is the widest selection of different dimensions, and they are cost-effective. The centred ball bearing can be made of different materials such as different plastics, glass, wood or metals such as aluminium, it is preferred if the centred ball bearing is made of polypropylene (PP) and further preferably of polyvinyl chloride (PVC) and especially preferably of polyoxymethylene (POM). The material of the balls is preferably made of glass, preferably from the group of alkaline earth-alkaline silicate glass, such as soda lime glass, or further preferably of polypropylene (PP), polyethylene (PE), polyvinylidene fluoride (PVDF), Polytetrafluoroethylene (PTFE) or polyester ether ketone (PEEK) and further preferably made of aluminium oxide ($Al_2O_3$), zirconium oxide ($ZrO_2$), silicon nitride ($Si_3N_4$) or silicon carbide (SiC) and especially preferably of stainless steel such as SUS304 or SUS316. The skilled person in the art can fall back on any suitable ball bearing known from the state of the art for the present invention. The skilled person in the art is able to select a suitable ball bearing on the basis of the present disclosure, which can be form-fitted into the first central recess of the outer shell or swing body of the rotatable play body according to the invention.

The ball bearings known from the state of the art can be commercially available e.g. in different designs with different diameters. In a preferred embodiment a swing body can be composed such that an outer shell of the swing body with a prefixed outer and prefixed diameter of the first central recess of the outer shell is provided and the centred ball bearing from the state of the art is selected such that the centred ball bearing exhibits an outer diameter, which corresponds to the prefixed diameter of the first central recess of the outer shell, so that the centred ball bearing can be form-fitted in the outer shell of the swing body. If, for example, no centred ball bearing according to the state of art can be provided with the corresponding defined outer diameter or if, for example, such as in further preferred embodiments a larger or smaller ball bearing should be preferably form-fitted, e.g. an outer shell of the swing body can be provided which exhibits a different diameter or a diameter corresponding to the outer diameter of the respective centred ball bearing of the first central recess of the outer shell of the swing body. It is preferable that different centred ball bearings, which have different outer diameters, can be form-fitted into an outer shell of the swing body with, for example, a defined outer diameter, by providing different embodiments of the outer shell of the swing body with different defined outer diameters, which differ by the different diameters of the first central recess of the outer shell of the swing body, so that the corresponding suitable centred ball bearings, each having different outer diameters, can each be fitted into a corresponding outer shell with a first central recess of a suitable corresponding diameter. Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the centred ball bearing is a roller bearing.

Hence, the present invention is also related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the centred ball bearing is roller bearing.

As already mentioned above, the outer shell of the swing body e.g. at the outer side or at the inner side can be cylindrical, i.e. can be present in form of a hollow cylinder. In some embodiments, however, the outer shell may preferably have other shapes. Preferably, the outer frame or the outer side of the outer shell of the swing body can exhibit a triangular, rectangular, pentagonal, hexagonal, heptagonal, octagonal or any other polygonal shape. Preferably the polygonal shape is a regular or basic polygon or regular polygon with 5 to 10 corners, preferably with 6 to 8 corners. In geometry, a regular polygon is a plane polygon, which is both equilateral and equiangular. Thus, in a regular polygon, all sides have equal lengths and all interior angles are equal. The corners of a regular polygon all lie on a common circle, with adjacent corners appearing at the same centre angle. Since the corners of a regular polygon all lie on a common circle, all corners have, as preferred, an equal distance to the centre of the swing body. This means, as already mentioned above, that depending on the shape of the outer shell the distance of the outer frame of the outer shell relative to the centred ball bearing and to the centre of the swing body is constant.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the outer shell or the swing body is cylindrical or exhibits the form of a regular polygon.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the outer shell or the swing body is cylindrical or exhibits a triangular, rectangular, pentagonal, hexagonal, heptagonal, octagonal or any other polygonal shape and preferably has the form of a regular polygon with preferably 5 to 10 corners, more preferably with 6 to 8 corners.

The present invention is also related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the outer shell or the swing body is cylindrical or exhibits a triangular, rectangular, pentagonal, hexagonal, heptagonal, octagonal or any other polygonal shape and preferably has the form of a regular polygon with preferably 5 to 10 corners, more preferably with 6 to 8 corners.

The outer faces of the cylinder as well as the outer faces of the regular polygon are preferably printable with game figures, pictures, motifs and text. In other words, the outer faces of the cylindrical outer shell as well as the outer faces of the outer shell in form of a regular polygon are preferably printable with game figures, pictures, motifs and text. In a preferred embodiment, the outer shell of the swing body has a printable outer face on the outer frame of the outer shell, in a further embodiment, the outer swing body preferably has printable outer faces which are preferably at least partially covered by the two mutually opposite disc-shaped side caps and which can be described as the lateral outer faces of the first and second side of the outer shell of the swing body. These lateral outer faces herein preferably denote the lateral outer faces of the outer shell of the swing body in the region between the outer diameter of the outer shell and the inner diameter of the outer shell or diameter of the first central recess. In a preferred embodiment, only the first lateral outer face of the outer shell is printable. In another preferred embodiment, only the second lateral outer face of the outer shell is printable. In a particularly preferred embodiment, the first and second lateral outer faces of the outer shell are printable. In a further particularly preferred embodiment, the two lateral outer faces and the outer face on the outer frame of the outer shell of the swing body can be printed with figures, pictures, motifs and text. It is preferred that the outer shell of the swing body has at least one printable outer face. Further, it is preferred that the outer shell of the swing body has one or more printable outer faces. In preferred embodiments, the outer shell of the rotatable swing body is cylindrical and the outer face on the outer frame of the outer shell of the swing body, i.e. the outer cylindrical surface or circumferential shell surface is plane and printable with game figures, pictures, motifs and text. The outer face on the outer frame of the cylindrical outer shell of the swing body is plane and printable, i.e. the outer cylindrical surface or circumferential shell surface of a cylindrical outer shell is not concave or convex and the outer radius or outer diameter of the cylindrical outer shell is constant over the width or height of the cylindrical outer shell and over the entire circumference of the cylindrical outer shell. In other words, the outer shell of the rotatable swing body does not exhibit dents or unevenness on the outer cylindrical surface or the circumferential shell surface or outer face on the outer frame. In other words, the cylindrical outer shell of the freely rotatable swing body in the form of a hollow cylinder preferably exhibits a constant wall thickness (W). Surprisingly, it was found that a cylindrical outer shell of a rotatable swing body in the form of a hollow cylinder with a constant wall thickness (W) is particularly suitable and advantageous for providing a printable surface on the outer cylinder surface or circumferential shell surface. Surprisingly, it was found that the complete cylinder surface or circumferential shell surface over the entire circumference of the outer shell of the freely rotatable swing body is only printable if the cylinder surface or circumferential shell surface is plane.

In other words, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the swing body exhibits one or more printable outer faces and is preferably plane, i.e. it is plane parallel to the rotation axis and not concave or convex.

In other words, the present invention is also related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the swing body exhibits one or more printable outer faces and is preferably plane, i.e. it is plane parallel to the rotation axis and not concave or convex.

In other words, the present invention is related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the outer shell of the swing body exhibits one or more printable outer faces, wherein the freely rotatable swing body (S) with the outer shell (M) is cylindrical, and the outer cylindrical surface of the cylindrical swing body (S) is plane and printable, wherein preferably the wall thickness (W) of the cylindrical outer shell (M) of the freely rotatable swing body (S) is constant.

"Printing", as used herein, means any suitable arbitrary process or method, preferably of the state of the art, by which, for example, game figures, pictures, motifs and/or text can be represented on a surface of a material. "Printable" as used herein means, inter alia, that the material of a part of the rotatable play body with a printable outer face may be directly printed with, for example, game figures, pictures, motifs and/or text. The skilled person in the art may use a suitable method or process known from the state of the art, which can be used to print on a specific material. In some embodiments, for example, plastics or metals can be printed directly by a sieving, offset or tampon printing process. Printable as used herein also means that the material of a part of the rotatable swing body with a printable outer face can be laminated with, for example, game figures, pictures, motifs and text. Thus, in some embodiments, self-adhesive foils printed with, for example, game figures, pictures, motifs and text can be used to print a printable outer face. In some embodiments, it can be preferred, if a part made of plastic with a printable outer face exhibits a painted outer face. In some embodiments, for example, a printable magnetic foil can also be used, which can hold on a magnetic material with a magnetic outer face. In some embodiments, it may be preferred if the material of the part of the rotatable swing body with a printable outer face exhibits engravings with game figures, pictures, motifs and/or text. In these embodiments, the material, such as a metal or plastic, can be processed, for example, by laser engraving. The preceding methods and processes for printing on outer faces are only examples of methods and processes, and the skilled person in the art can still fall back on other suitable methods and processes from the state of the art, with which an outer face can be printed with game figures, motifs, pictures and text.

For a surface to be printed with game figures, motifs, pictures and text, it is preferred that the surface to be printed is plane. In other words, it is preferred that the outer faces of the disc-shaped side caps are planar and plane, and that the outer face of the outer frame of the outer shell or the disc-shaped side caps are plane. Thus, it is particularly preferred, if the freely rotatable swing body (S) with the outer shell (M) is cylindrical and the outer cylindrical surface of the cylindrical swing body (S) is plane and printable. It is thus preferred that the wall thickness (W) of a cylindrical outer shell (M) of a freely rotatable swing body (S) is constant, in particular if a cylindrical outer shell (M) of a freely rotatable swing body has the form of a hollow cylinder.

As described above, the outer shell can preferably exhibit different outer or also inner shapes. This means that not only the outer frame or the outside of the outer shell of the swing body can be cylindrical or exhibit a triangular, rectangular, pentagonal, hexagonal, heptagonal, octagonal or any other regular polygonal shape, but can also be cylindrical on the inside of the outer shell or exhibit a triangular, rectangular, pentagonal, hexagonal or any other preferably regular polygonal shape. Preferably, the outer shell is cylindrical on the inside, i.e. the first central recess is circular, so that preferably a cylindrical centred ball bearing can be fitted.

The outer shell according to the invention of the swing body can be made of different materials such as different plastics, glass, wood, or metals such as aluminium, it is preferred if the outer shell of the swing body is made of polypropylene (PP), and further preferred of polyvinyl chloride (PVC) and especially preferred of polyoxymethylene (POM). Any other suitable arbitrary material suitable for the construction of the swing body or also the rotatable play body according to the invention can be used by a person skilled in the art. Further non-exhaustive examples of suitable materials are metals such as cast iron, steel, stainless steel, aluminium alloys, copper alloys, magnesium alloys, titanium alloys, zinc alloys; ceramics, such as glasses e.g. borosilicate glass, glass-ceramics, quartz glass, soda-lime glass, or technical ceramics such as silicon, silicon carbide, silicon nitride, tungsten carbide; composite materials such as aluminium-silicon carbide, carbon fibre reinforced plastic (CFRP), glass fibre reinforced plastic (GFRP), natural materials such as wood or bamboo, polymers or plastics such as elastomers e.g. natural rubber, thermoplastics such as acrylonitrile-butadiene-styrene copolymer (ABS), cellulose acetate (CA), ionomers, polyamides such as nylon, polycarbonates (PC), polyether ether ketone (PEEK), polyethylene (PE), polyethylene terephthalate (PET), Polymethyl methacrylate (PMMA), polyoxymethylene (POM), polypropylene (PP), polystyrene (PS), polyurethane thermoplastics, polyvinyl chloride (PVC), Teflon (PTFE), thermosets such as epoxy resins, phenolic resins and polyesters. In some embodiments, the outer shell of the swing body can preferably also consist of a combination of different parts, which can also be made of different materials. For example, the outer shell may exhibit a cylindrical outer ring made of a plastic and a cylindrical inner ring made of metal. Another example is an outer shell consisting of a cylindrical outer ring made of a plastic, a cylindrical middle ring made of metal and a cylindrical inner ring made of plastic. Furthermore, for example, the outer shell may consist of an outer ring which exhibits the shape of a regular hexagon on the outside and is cylindrical on the inside and consists of an inner ring, wherein the outside of the inner ring is cylindrical so that the outer ring and the inner ring can be form-fitted with each other. Another example is an outer shell consisting of an outer ring which exhibits the shape of a regular hexagon on the outer side and on the inner side, and further consisting of an inner ring whose outer side exhibits the shape of a regular hexagon but whose inner side is cylindrical. The above examples are only exemplary embodiments of the outer shell of the swing body according to the invention and are not limited to these examples. However, it is particularly preferred that the different parts of the different embodiments of the outer shell of the swing body can be form-fitted with each other. This means that if the outer shell, for example in a further embodiment, preferably consists of an outer ring, which exhibits the shape of a regular hexagon on the outer and on the inner side, that the inner ring, which consequently also exhibits the shape of a regular hexagon on the outer side of the inner ring, that the size and shape of the regular hexagon of the inner side of the outer ring corresponds to the size and shape of the regular hexagon of the outer side of the inner ring to such an extent that the outer ring and the inner ring can be form-fitted with each other.

According to the invention, the centred ball bearing and thus the swing body exhibits a second central recess. Preferably, the second central recess is centred in the centred ball bearing. The second central recess can be cylindrical, but can also have a triangular, rectangular, pentagonal, hexagonal, heptagonal, octagonal or polygonal shape and preferably have the form of a regular polygon with preferably 5 to 10 corners, further preferably with 6 to 8 corners. It is preferred that the second central recess corresponds to the outer shape of at least one centred extension of one of the disc-shaped side caps. It is preferred that at least one of the centred extensions of the disc-shaped side caps can be form-fitted into the second central recess. For example, the second central recess, which represents the inner side of the centred ball bearing, can be cylindrical. In some embodiments, it is then preferred that the outer frame or outside of the first centred extension is for example also cylindrical. For example, for form-fitting of the first centred extension of the first disc-shaped side cap, into the second central recess, it is particularly preferred that the diameter of the cylindrical second central recess of the centred ball bearing corresponds to the outer diameter of the first centred extension to such an extent that form-fitting is possible. Another example of a preferred embodiment is a second central recess having the shape of a regular square, wherein it is preferred that the outer shape of the first centred extension of the first disc-shaped side cap is also, for example, a regular square. It is particularly preferred that, for example, after engaging the first centred extension of the first disc-shaped side cap in the second central recess of the swing body or of the centred ball bearing, the swing body and the first disc-shaped side cap with the first centred extension do not disengage from each other without force or not solely by gravity.

According to the invention, the swing body is "freely rotatable", and can be mechanically set in rotation, wherein the swing ring can preferably rotate freely at a high speed and for at least 5-10 s, and particularly preferably at least 30 s. The rotatable play body according to the invention is preferably held by a user with one hand on the non-rotating mutually opposite disc-shaped side caps, while the swing body is mechanically set in rotation with the other hand, e.g. by bumping with a finger of the other hand. "Freely rotatable" as used herein means that the swing body continues to rotate after it has been set in rotation. This means that the rotation of the swing body does not stop at the point where the force applied to the swing body to set it in rotation no longer acts on the swing body. The term "freely rotatable" therefore refers to a rotation of the swing body at a speed of at least one rotation per second for a period of at least 5 seconds after omission of the force effect, preferably at least one rotation per second for a period of at least 10 seconds after omission of the force effect and particularly preferably at least one rotation per second for a period of at least 30 seconds after omission of the force effect.

In some embodiments, the swing body may preferably have different total diameters. The total diameter here represents the outer diameter of the outer shell of the swing body and thus the outer diameter of the swing body. For example, if the outer shell of the swing body is cylindrical, the distance from the outer side of the outer shell to the centre of the swing body is constant. This distance is the outer radius of the cylindrical outer shell. In other words, the outer radius of a cylindrical outer shell of a rotatable swing body is preferably constant. This means that the cylindrical outer shell of the rotating swing body preferably has a constant outer radius. In other words, the cylindrical outer shell of the rotatable swing body preferably has a constant outer radius over the entire width or height of the cylindrical outer shell and is thus plane on the outer cylindrical surface or circumferential shell surface. In other words, the outer radius of a cylindrical outer shell of a freely rotatable swing body in the form of a hollow cylinder is constant, and thus the wall thickness of the cylindrical outer shell of the freely rotatable swing body is also constant. It is understood that the total diameter of the swing body according to the invention is thus twice the outer radius of the cylindrical outer shell. If the outer shell has the shape of a regular polygon, then the outer radius is the distance between one of the corners of the regular polygon and the centre of the swing body, since, as described above, all the corners of a regular polygon lie on a circle. In a preferred embodiment, the swing body has an outer diameter of 2.0 cm to 10.0 cm. Preferred is an outer diameter of 2.5 cm to 8.0 cm, further preferred from 3.0 cm to 6.0 cm. Especially preferred is an outer diameter of 3.5 to 4.0 cm. Especially preferred the swing body has an outer diameter of at least 3.0 cm. Especially preferred the swing body has an outer diameter of 3.5 cm.

In some embodiments, the swing body may preferably be of different width. The width of the swing body corresponds to the width of the outer shell of the swing body. The width of the outer shell of the swing body can also be referred to as the height of the outer shell of the swing body or the thickness of the outer shell of the swing body. The width of the centred ball bearing can be different than the width of the outer shell. The width of the centred ball bearing is preferably smaller or equal to the width of the outer shell of the swing body. Furthermore, the width of the centred ball bearing preferably corresponds at most to the width of the outer shell of the swing body. In some embodiments, however, it may be preferred if the width of the centred ball bearing is greater than the width of the outer shell of the swing body. As already described above, the centred ball bearing is preferably composed of a so-called inner ring and an outer ring with intermediate rolling bodies that reduce the frictional resistance. With regard to the width of the centred ball bearing, it may be preferred in some embodiments if the so-called inner ring and the outer ring of the centred ball bearing have different widths. For example, in a preferred embodiment, the outer ring of the centred ball bearing and the rolling bodies between the outer and inner ring of the centred ball bearing may have a smaller width than the outer shell of the swing body, and the inner ring of the centred ball bearing may have a larger width than the outer shell of the swing body. In another preferred embodiment, the inner ring of the centred ball bearing can also exhibit a width that corresponds to the width of the outer shell of the swing ring. The width of the centred ball bearing can also be referred to as the height of the centred ball bearing or thickness of the centred ball bearing. For example, if the outer shell of the swing body is cylindrical in a preferred embodiment, the width of the outer shell of the swing body will be equal to the height of the cylinder. In preferred embodiments of the swing body according to the invention, the outer shell preferably has a width of 0.4 cm to 5.0 cm, preferably a width of 0.5 cm to 3.0 cm, further preferably a width of 0.7 cm to 3.0 cm and still further preferably a width of 0.8 cm to 2.0 cm. A width of 1.0 to 1.2 cm is particularly preferred. In a preferred embodiment, the centred ball bearing, for example, may have maximum the width of the outer shell of the swing ring. It is particularly preferred that the width of the centred ball bearing is 0.50 times to 0.95 times the width of the swing body. It is particularly preferred when at least the width of the outer ring of the centred ball bearing and the width of the rolling bodies between the outer and inner ring of the centred ball bearing are 0.50 to 0.95 times the width of the swing body.

Thus, the present invention is also related to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing, and the second centred extension is suitable to engage in the second central recess of the centred ball bearing and/or in the first centred extension of the first disc-shaped side cap, wherein the width of the centred ball bearing is 0.50 times to 0.95 times the width of the swing body.

In other words, the present invention is also related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the width of the centred ball bearing is 0.50 times to 0.95 times the width of the swing body.

In a preferred embodiment of the play body according to the invention, the outer shell of the swing body or the swing body can have a bevel of various sizes and shapes at the edge, especially preferably a bevel of various sizes and shapes on both edges.

As already mentioned above, in preferred embodiments the outer shell of the swing body is cylindrical, so that the distance of the outer side of the outer shell to the centre of the swing body is constant. In these embodiments, it is preferred that the outer radius of the cylindrical outer shell is constant. In other words, the outer radius of a cylindrical outer shell of a rotatable swing body is preferably constant. In other words, it is preferred that the cylindrical outer shell of the rotatable swing body preferably has a constant outer radius over the whole width or height of the cylindrical outer shell and thus is plane at the outer cylinder surface or circumferential shell surface. In other words, the outer radius of a cylindrical outer shell of a freely rotatable swing body in the form of a hollow cylinder is constant, and thus the wall thickness of the cylindrical outer shell of the freely rotatable swing body is also constant.

In embodiments of the play body according to the invention in which the outer shell of the freely rotatable swing body is cylindrical and preferably exhibits the shape of a hollow cylinder, wherein the outer shell of the swing body or the swing body exhibits a bevel of various sizes and shapes at the edge, it is particularly preferred if the wall thickness (W) of the cylindrical outer shell of the swing body in form of a hollow cylinder, as well as the outer radius of the outer shell of the swing body, is constant over at least 90% of the width ($B_3$) of the outer shell, more preferably at least over 92% of the width ($B_3$) of the outer shell, more preferably at least over 94% of the width ($B_3$) of the outer shell, more preferably at least over 96% of the width ($B_3$) of the outer shell, at least over 98% of the width ($B_3$) of the outer shell, and particularly preferably at least over 99% of the width ($B_3$) of the outer shell of the swing body. In other words, in these embodiments it is preferred that the size of the bevel on the edge of the outer shell, or preferably the total size of the bevel on both edges of the outer shell, is preferably in total 1 to 10% of the width of a cylindrical outer shell of the swing body, so that at least 90% to 99% of the cylindrical surface or circumferential shell surface of the cylindrical outer shell is plane and printable.

In another preferred embodiment of the play body according to the invention, the outer shell of the swing body may also have one or more recess(es) in the shape of a circle or in the form of a triangle, rectangle, pentagon, hexagon or any other polygon. It is preferred that the shape of the polygon is a regular polygon. In another preferred embodiment, the outer shell of the swing body may also have one or more recesses of any arbitrary shape. In a preferred embodiment, the outer shell of the swing body may, for example, have a wedge-shaped recess directed towards the centre of the swing body, this wedge-shaped recess having the greatest distance on the outer frame of the outer shell and the distance being continuously reduced towards the centre of the outer shell. In another embodiment, the outer shell of the swing body can also have a recess in the form of a groove. The groove may be present, for example, on the outer frame over the entire circumference of the outer shell or may also be directed towards the inside of the outer shell along the width of the outer shell, so that the outer shell of the swing body has a gap at a defined position with a distance of constant width, for example. It is particularly preferred that the one or more gaps on the outer shell of the swing body do not create imbalance during rotation of the swing body and that the free rotation of the swing body is not restricted.

In preferred embodiments in which the outer shell of the freely rotatable swing body is cylindrical and preferably has the shape of a hollow cylinder with a constant wall thickness (W), it is particularly preferred if the outer shell of the freely rotatable swing body has no recess on the cylinder surface or circumferential shell surface so that the cylinder surface or circumferential shell surface is plane and can therefore be printed in a particularly advantageous manner.

The swing body preferably makes up at least 80% of the mass of the play body, preferably at least 85%, more preferably at least 90% and most preferably at least 95% of the mass of the play body.

Alternatively, the mass of the swing body (S) is at least 4 times the mass of the two disc-shaped side caps (K1 and K2), preferably at least 9 times, more preferably at least 15 times, still more preferably at least 19 times the mass of the two disc-shaped side caps (K1 and K2).

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the mass of the swing body is at least 15 times the mass of the two disc-shaped side caps.

According to the invention, the rotatable play body comprises two mutually opposite disc-shaped side caps between which a freely rotatable swing body is arranged. The first disc-shaped side cap has an outer edge, an outer face and a first centred extension on the inner face and the second disc-shaped side cap has an outer edge, an outer face and a second centred extension on the inner face. The extensions are suitable for engaging in the swing body, preferably suitable for form-fit engaging in the swing body, wherein the disc-shaped side caps are preferably movable at the outer edge against the freely rotatable swing body in order to fix the freely rotatable swing body in its position. A freely rotatable swing body is arranged between the mutually opposite disc-shaped side caps, therefore the mutually opposite disc-shaped side caps are arranged at a distance $B_0$ to each other between which a freely rotatable swing body with a width $B_3$ is arranged. The first disc-shaped side cap preferably has a distance $B_4$ between the swing body (S) and the inner face of the first disc-shaped side cap (K1) and the second disc-shaped side cap preferably has a distance $B_5$ between the swing body (S) and the inner face of the second disc-shaped side cap (K2). The rotatable play body of the present invention thus preferably has a swing body with the width $B_3$ and two opposite disc-shaped side caps which are arranged at a distance $B_0$ from each other. In order that the swing body located between the two opposite disc-shaped side caps can rotate freely, it is preferred if the distance $B_0$ between the opposite side caps is greater than the width $B_3$ of the swing body. It is therefore particularly preferred when the distance $B_0$ of the inner faces of the opposite disc-shaped side caps (K1) and (K2) is greater than the width $B_3$ of the swing body (S). In other words, it is particularly preferred when the distance ($B_0$) of the inner faces of the opposite disc-shaped side caps (K1) and (K2) is the sum of the width ($B_3$) of the swing body (S), the distance ($B_4$) of the swing body to the inner face of the first disc-shaped side cap (K1) and the distance ($B_5$) of the swing body to the inner face of the second disc-shaped side cap (K2). In accordance with the invention, the first disc-shaped side cap has an outer face and a first centred extension on the inner face and the opposite second disc-shaped side cap has an outer face and a second centred extension on the inner face. Preferably, the first centred extension is suitable to engage in the second central recess of the centred ball bearing and the second centred extension is suitable to engage in the second central recess of the centred ball bearing and/or the first centred extension of the first disc-shaped side cap.

Preferably the mutually opposite disc-shaped side caps are arranged parallel to each other. The disc-shaped side caps preferably have different external shapes. Preferably, the disc-shaped side caps can have an external shape which is cylindrical or which is a triangular, rectangular, pentagonal, hexagonal, heptagonal, octagonal or any other arbitrary polygonal shape. Preferably, the polygonal shape is a regular or basic polygon or regular polygon with 3 to 10, preferably 6 to 8 corners. The first disc-shaped side cap preferably has the same shape as the second disc-shaped side cap. However, the side caps can also have different shapes. For example, the first side cap can be cylindrical and the second side cap can be in the form of a regular hexagon. Any conceivable combination of the different external shapes for the first and second disc-shaped side caps can be considered according to the invention. It is particularly preferred when the first disc-shaped side cap and the second disc-shaped side cap are cylindrical.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first disc-shaped side cap is cylindrical or exhibits a triangular, rectangular, pentagonal, hexagonal, heptagonal, octagonal or polygonal shape, and wherein the triangular, rectangular, pentagonal, hexagonal, heptagonal, octagonal or polygonal shape is preferably a regular polygon.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the second disc-shaped side cap is cylindrical or exhibits a triangular, rectangular, pentagonal, hexagonal, heptagonal, octagonal or polygonal shape, and wherein the triangular, rectangular, pentagonal, hexagonal, heptagonal, octagonal or polygonal shape is preferably a regular polygon.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first disc-shaped side cap and/or the second disc-shaped side cap is/are cylindrical or the exhibits/exhibit the shape of a regular polygon.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first disc-shaped side cap and/or the second disc-shaped side cap is/are cylindrical or exhibits/exhibit a triangular, rectangular, pentagonal, hexagonal, heptagonal, octagonal or regular polygonal shape, and preferably has the shape of a regular polygon with 5 to 10 corners, more preferably with 6 to 8 corners.

The present invention is also related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the first disc-shaped side cap and/or the second disc-shaped side cap is/are cylindrical or exhibits/exhibit a triangular, rectangular, pentagonal, hexagonal, heptagonal, octagonal or regular polygonal shape, and preferably has the shape of a regular polygon with 5 to 10 corners, more preferably with 6 to 8 corners.

The outer face (F1) of the first disc-shaped side cap (K1) and the outer face (F2) of the second disc-shaped side cap (K2) are preferably printable with game figures, pictures, motifs and text. In a preferred embodiment, the first and/or the second disc-shaped side cap has a printable outer face on the outer frame of the respective disc-shaped side cap. In a further embodiment, the first and/or the second disc-shaped side cap preferably has a printable outer surface on the respective outer face of the corresponding disc-shaped side cap. In a preferred embodiment, only the outer face of the first disc-shaped side cap is printable. In another embodiment, only the outer face of the second disc-shaped side cap is printable. In a further particularly preferred embodiment, both outer faces of the first and second disc-shaped side caps are printable. In another particularly preferred embodiment, both outer faces of both disc-shaped side caps and the outer frame of the disc-shaped side caps are printable with game figures, pictures, motifs and text. It is preferred that the first and/or the second disc-shaped side cap has/have at least one printable surface. It is further preferred that the first and/or the second disc-shaped side cap has/have one or more printable outer surfaces.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the opposite disc-shaped side caps exhibit one or more printable outer surfaces.

The present invention is also preferably related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the opposite disc-shaped side caps exhibit one or more printable outer surfaces.

As described above, not only the disc-shaped side caps may have one or more printable surfaces, but also the outer shell of the swing body may have one or more printable outer surfaces.

In a particularly preferred embodiment of the rotatable play body one or more outer surfaces of the outer shell of the swing body and the opposite disc-shaped side caps are printable.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the swing body as well as the opposite disc-shaped side caps exhibit one or more printable outer surfaces.

In other words, the present invention is also related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the swing body as well as the opposite disc-shaped side caps exhibit one or more printable outer surfaces.

Preferably, the present invention is also related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the swing body as well as the opposite disc-shaped side caps exhibit one or more printable outer surfaces, wherein the freely rotatable swing body (S) with the outer shell (M) is cylindrical, and the outer cylindrical surface of the cylindrical swing body (S) is plane and printable, wherein preferably the wall thickness (W) of the cylindrical outer shell (M) of the freely rotatable swing body (S) is constant.

In some embodiments, the disc-shaped side caps may preferably have different diameters. It is preferred that the first disc-shaped side cap has the same diameter as the second disc-shaped side cap. It is particularly preferred if the first and second disc-shaped side caps each have a diameter at least equal to the outer diameter of the centred ball bearing or the diameter of the first central recess. The disc-shaped side caps can also have different diameters. For example, the first disc-shaped side cap may have a diameter corresponding to the outer diameter of the centred ball bearing of the swing body, while the second side cap may have a diameter corresponding to the outer diameter of the outer shell of the swing body.

In a preferred embodiment, the disc-shaped side caps have a smaller or larger diameter than the outer diameter of the swing body. In another preferred embodiment, the disc-shaped side caps have a smaller diameter than the outer diameter of the swing body. In another preferred embodiment, the disc-shaped side caps have a larger diameter than the outer diameter of the swing body. In a particularly preferred embodiment, both disc-shaped side caps both have the same diameter, which also corresponds to the outer diameter of the swing body.

The mutually opposite disc-shaped side caps (K1) as well as (K2) can have a diameter in the range of 0.3 to 1.5 times the outer diameter of the swing body (S). It is preferred when the disc-shaped side caps (K1) and (K2) have a diameter in the range of 0.5 to 1.5 times, more preferably 0.5 to 1.2 times, more preferably 0.7 to 1.4 times, more preferably 0.7 to 1.3 times, more preferably 0.8 to 1.4 times, more preferably 0.8 to 1.3 times, more preferably 0, 7 to 1.2 times, more preferably 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times the outer diameter of the swing body (S).

If one or both disc-shaped side caps (K1) and (K2) and/or swing body (S) are not cylindrical and have a defined diameter, then the smallest distance from the centre to the outer edge is considered as the diameter, e.g. in case of a polygonal shape of a regular polygon.

It is particularly preferred if the first and second disc-shaped side caps each have a diameter at least equal to the outer diameter of the centred ball bearing or the diameter of the first central recess. Preferably, the first and second disc-shaped side caps each have a diameter at least equal to the outer diameter of the first central recess. In other words, it is preferred when the diameter of the opposite side caps is larger than the outer diameter of the first central recess of the outer shell of the swing body or larger than the outer diameter of the centred ball bearing. It is therefore particularly preferred for the disc-shaped side caps (K1) and (K2) to have a diameter in the range of 0.5 to 1.5 times, more preferably 0.5 to 1.2 times, more preferably 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, further preferably 0.7 to 1.1 times, further preferably 0.8 to 1.1 times, further preferably 0.9 to 1.1 times, further preferably 0.95 to 1.1 times, further preferably 0.95 to 1.05 times of the outer diameter of the freely rotatable swing body (S), wherein the diameter of the disc-shaped side caps each corresponds at least to the outer diameter of the first central recess of the outer shell of the swing body. It is therefore particularly preferred that the disc-shaped side caps (K1) and (K2) have a diameter in the range of 0.5 to 1.5 times, more preferably 0.5 to 1.2 times, more preferably 0.7 to 1.4 times, further preferably from 0.7 to 1.3 times, further preferably from 0.8 to 1.4 times, further preferably from 0.8 times to 1.3 times, further preferably from 0.7 times to 1.2 times, further preferably from 0.8 to 1.2 times, further preferably 0.7 to 1.1 times, further preferably 0.8 to 1.1 times, further preferably 0.9 to 1.1 times, further preferably 0.95 to 1.1 times, further preferably 0.95 to 1.05 times of the outer diameter of the swing body (S), wherein the diameter of the disc-shaped side caps (K1) and (K2) correspond at least to the outer diameter of the centred ball bearing. It is therefore particularly preferred when the disc-shaped side caps (K1) and (K2) have a diameter in the range of 0.5 to 1.5 times, more preferably 0.5 to 1.2 times, more preferably 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times of the outer diameter of the swing body (S), wherein the diameter of the disc-shaped side caps (K1) and (K2) is larger than the outer diameter of the first central recess of the outer shell of the swing body. It is therefore particularly preferred when, the disc-shaped side caps (K1) and (K2) have a diameter in the range of 0.5 to 1.5 times, further preferred 0.5 to 1.2 times, further preferred 0.7 to 1.4 times, further preferred 0.7 to 1.3 times, further preferred 0.8 to 1.4 times, further preferred 0.8 to 1.3 times, further preferred 0.7 to 1.2 times, further preferred 0.8 to 1.2 times, further preferred 0.7 to 1.1 times, further 0.8 times to 1.1 times, further preferred 0.9 to 1.1 times, further preferred 0.95 times to 1.1 times, further preferred 0.95 times to 1.05 times of the outer diameter of the swing body (S), wherein the diameter of the disc-shaped side caps (K1) and (K2) is larger than the outer diameter of the centred ball bearing.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the disc-shaped side caps have a diameter in the range of 0.5 times to 1.2 times the outer diameter of the swing body.

In other words, the present invention is related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps have a diameter in the range of 0.5 times to 1.5 times, more preferably 0.5 times to 1.2 times, more preferably 0.7 times to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times the outer diameter of the swing body.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first and second disc-shaped side caps have a diameter in the range of 0.5 times to 1.5 times, more preferably 0.5 to 1.2 times, more preferably 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times the outer diameter of the outer shell of the swing body, and the first and/or second disc-shaped side cap is cylindrical, and/or exhibits the shape of a regular polygon.

In other words, the present invention is also related to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps have a diameter in the range of 0.5 to 1.5 times, more preferably 0.5 to 1.2 times, more preferably 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times the outer diameter of the swing body, and the first and/or second disc-shaped side cap is cylindrical and/or exhibits the shape of a regular polygon.

The present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first and second disc-shaped side cap have a diameter in the range of 0.5 to 1.5 times, more preferably 0.5 to 1.2 times, more preferably 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times the outer diameter of the swing body, and the first and/or second side cap is cylindrical, and/or exhibits the shape of a regular polygon.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first and second disc-shaped side cap have a diameter in the range of 0.5 to 1.5 times, more preferably 0.5 to 1.2 times, more preferably 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times the outer diameter of the swing body, and the first and/or second side cap is cylindrical, and/or exhibits the shape of a regular polygon, and the swing body exhibits an outer diameter of 3.0 cm to 6.0 cm and a width of 0.8 cm to 2.0 cm.

The two mutually opposite side caps are preferably mutually opposite disc-shaped side caps. "Disc-shaped" as used herein refers to a body that has the shape of a disc or a body with a plane surface. A disc is a geometric body preferably in the shape of a cylinder, whose radius is many times greater than its thickness. A disc-shaped side cap as used herein, however, does not exclusively refer to a disc-shaped side cap that is shaped like a cylinder. The term disc-shaped as used herein also refers to disc-shaped side caps which also have other external shapes, such as the shape of a regular polygon.

The first and the second disc-shaped side cap of the play body according to the invention can preferably have different widths. The width of the disc-shaped side caps can also be referred to as the height of the disc-shaped side caps or thickness of the disc-shaped side caps. For example, if disc-shaped side caps are cylindrical, the width of disc-shaped side caps thus represents the height of the cylinder. In preferred embodiments of the rotatable play body according to the invention, the disc-shaped side caps preferably have a width of 0.2 mm to 5.0 mm, preferably 0.3 mm to 3.0 mm. A width of 1 mm is particularly preferred. In a preferred embodiment, the side caps have a width in the range of 0.05 to 0.5 times, preferably 0.07 to 0.3 times, and further preferably 0.1 to 0.2 times the width of the swing body or the outer shell.

In some preferred embodiments, the disc-shaped side caps may also have a greater width than previously described. For example, the disc-shaped side caps could also have a width corresponding to the width of the swing body or the outer shell of the swing body. In some preferred embodiments, the disc-shaped side caps have a width in the range of 0.05 to 1.0 times the width of the swing body. In a particularly preferred embodiment, the disc-shaped side caps each have a width which corresponds to the width of the swing body.

In another preferred embodiment, the width of the first disc-shaped side cap can correspond to the width of the second disc-shaped side cap. It is particularly preferred when the first and second disc-shaped side caps have the same width. In other preferred embodiments, the first disc-shaped side cap may have a different width than the second disc-shaped side cap.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the disc-shaped side caps have a width in the range of 0.05 to 0.5 times the width of the swing body.

Accordingly, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps have a width in the range of 0.05 to 0.5 times the width of the swing body.

The present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first and second disc-shaped side cap have a diameter in the range of 0.5 to 1.5 times, more preferably 0.5 to 1.2 times, more preferably 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times the outer diameter of the swing body, and the first and/or second disc-shaped side cap is cylindrical, and/or exhibits the shape of a regular polygon, and the swing body exhibits an outer diameter of 3.0 cm to 6.0 cm and a width of 0.8 cm to 2.0 cm, and wherein the disc-shaped side caps have a width in the range of 0.05 to 0.5 times the width of the swing body.

Accordingly, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps have a width in the range of 0.05 to 0.5 times the width of the swing body, wherein the disc-shaped side cap have a diameter in the range of 0.5 to 1.5 times, more preferably 0.5 to 1.2 times, more preferably 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times the outer diameter of the swing body, and the first and/or second side cap is cylindrical, and/or exhibits the shape of a regular polygon.

In a preferred embodiment of the play body according to the invention, the disc-shaped side caps can each have a bevel in different sizes and shapes at the edge, particularly preferably at both edges, i.e. can have a bevel in different sizes and shapes on the inner side at the edge of the inner faces and on the outer side at the edge of the outer faces.

In another preferred embodiment of the play body according to the invention, the disc-shaped side caps may also have recesses in the shape of a circle or in the form of a triangle, quadrilateral, pentagon, hexagon, heptagon, octagon or any other arbitrary polygon. Preferably, the shape of the polygon is a regular polygon with preferably 3 to 10 corners. In a preferred embodiment, the first disc-shaped side cap and/or the second disc-shaped side cap has one or more recesses at the edge of the side cap. This means that the recess at the edge of the respective disc-shaped side cap is not completely enclosed by the material of the side cap. In other words, a recess at the edge of a disc-shaped side cap can also be called an outer recess or open recess or a recess open to the outside. In another preferred embodiment, the first and/or second disc-shaped side cap has one or more recesses which are completely enclosed by the material of the respective side cap. This recess of the first and/or second disc-shaped side cap can be called an inner recess. It is preferred that the first and/or the second disc-shaped side cap have one or more outer and/or inner recesses in a radius within the range of the outer diameter of the outer shell of the swing body and the inner diameter of the outer shell of the swing body or the diameter of the first central recess. It is preferred that one or more inner recesses of the first disc-shaped side cap and/or the second disc-shaped side cap are not within the range of the outer diameter of the centred ball bearing or the inner diameter of the outer shell or the diameter of the first central recess and the inner diameter of the centred ball bearing or the diameter of the second central recess of the swing body. In an exemplary embodiment, the outer shell of the swing body, for example, can be printed with numbers or also figures of a defined size at a defined radius between the outer diameter of the outer shell of the swing body and the inner diameter of the outer shell of the swing body on the surface, which is covered by the first disc-shaped side cap, i.e. the first lateral outer surface, and at the same time the first disc-shaped side cap can correspondingly also have, for example, a recess at said defined radius between the outer diameter of the outer shell of the swing body and the inner diameter of the outer shell of the swing body, which, for example, has a diameter or shape that corresponds to the defined size of a number or a figure. Put more simply, the exemplary recess in this exemplary embodiment on the first disc-shaped side cap represents a "window" through which the numbers or figures illustrated on the outer shell of the swing body are visible, preferably this recess, thus the "window" is so large that only one of the numbers or one of the figures is visible at a time. In a further embodiment, the second disc-shaped side cap can also have a recess, as described above for the first disc-shaped side cap, wherein the swing body can also be printed with numbers or figures as described above on the surface covered by the second disc-shaped side cap, i.e. the second lateral outer surface. In a preferred embodiment, a rotatable play body is provided, which has, for example, on the first and/or second disc-shaped side cap as described above, a recess which takes the role of a "window" and at the same time the corresponding lateral outer surfaces of the swing body or outer shell, that are covered by the first and/or second disc-shaped side cap, is printed with numbers or figures, so that after initiating the rotation of the swing body followed by braking the swing body, a certain number or figure is visible through the "window" or the recess on the first and/or second disc-shaped side cap. In a preferred embodiment, the disc-shaped side caps can also have a centred recess in which another additional part can be integrated. This additional part can be a handle for the fingers, for example. In a preferred embodiment, this additional part can be in the form of a finger ring into which a finger of a user can be inserted, so that the rotatable play body can be worn on the user's hand like a finger ring. In another preferred embodiment this additional part can have the shape of a ring or eyelet, so that e.g. a string can be threaded into this ring, so that the play body can be worn like a necklace around the neck of a user or can be attached to a key ring. In a further embodiment, the additional part can represent an attachable figure.

In a preferred embodiment of the rotatable play body according to the invention, the distance between the swing body and the mutually opposite disc-shaped side caps is in the range between 0.1 mm and 3.0 mm. In a particularly preferred embodiment, the distance between the swing body and the opposite disc-shaped side caps is preferably 0.1-3.0 mm, 0.3 mm-2.0 mm, further preferably 0.5 mm-1.5 mm and most preferably 0.8 mm-1.2 mm. In a preferred embodiment, the distance between the swing body and the first disc-shaped side cap and between the swing body and the second disc-shaped side cap is equal. In other words, the first disc-shaped side cap has preferably the same distance to the swing body as the second disc-shaped side cap to the swing body. In a preferred embodiment, the distance between the swing body and the disc-shaped side caps is at least large enough to allow the swing body to rotate freely. In a preferred embodiment, the distance between the swing body and the disc-shaped side caps is at least so large that the swing body is not braked by the disc-shaped side caps during free rotation. The distance between the swing body and the first disc-shaped side cap is preferably the distance between the swing body and the inner face of the first disc-shaped side cap and the distance between the swing body and the second disc-shaped side cap is preferably the distance between the swing body and the inner face of the second disc-shaped side cap. The distance ($B_0$) between the two mutually opposite disc-shaped side caps is thus preferably the distance $B_4$ between the swing body (S) and the inner face of the first disc-shaped side cap (K1) plus the distance $B_5$ between the swing body (S) and the inner face of the second disc-shaped side cap (K2) plus the width ($B_3$) of the swing body (S). Thus, the distance $B_0$ between the two opposite disc-shaped side caps is preferably the sum of $B_4+B_5+B_3$. It is preferred, if the distance $B_4$ and the distance $B_5$ is between 0.1 mm and 3.0 mm, particularly preferred between 0.1 and 0.3 mm. It is therefore preferred when the distance $B_4$ and the distance $B_5$ between the swing body and the mutually opposite disc-shaped side caps is preferably 0.1-3.0 mm, 0.3 mm-2.0 mm, further preferably 0.5 mm-1.5 mm and most preferably 0.8 mm-1.2 mm.

The present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps have a width in the range of 0.05 to 0.5 times the width of the swing body, wherein the disc-shaped side caps exhibit a diameter in the range of 0.5 times to 1.2 times of the outer diameter of the swing body, and the first and/or the second disc-shaped side cap is cylindrical and/or exhibits the shape of a regular polygon, wherein the distance $B_4$ or the distance $B_5$ between the swing body and the opposite disc-shaped side caps is preferably 0.1-3.0 mm, 0.3 mm-2.0 mm, further preferably 0.5 mm-1.5 mm and most preferably 0.8 mm-1.2 mm.

The present invention also relates a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps have a width in the range of 0.05 to 0.5 times the width of the swing body, wherein the disc-shaped side caps exhibit a diameter in the range of 0.5 times to 1.2 times of the outer diameter of the swing body, and the first and/or the second disc-shaped side cap is cylindrical and/or exhibits the shape of a regular polygon, wherein the outer shell (M) is cylindrical or has the shape of a regular polygon, the outer shell (M) of the freely rotatable swing body is preferably cylindrical and the outer cylindrical surface of the cylindrical swing body (S) is plane and printable, wherein preferably the wall thickness (W) of the cylindrical outer shell (M) of the freely rotatable swing body (S) is constant, wherein preferably the outer radius of the cylindrical outer shell (M) of the freely rotatable swing body (S) is constant.

In some embodiments of the play body according to the present invention, it may be preferable for the disc-shaped side caps to also have one or more extensions at the outer edge on the inner faces of the disc-shaped side caps or also an extension running along the entire outer circumference at the outer edge on the inner face of the disc-shaped side caps, so that at the outer edge the disc-shaped side caps have a smaller distance to the freely rotatable swing body than the distance $B_4$ or $B_5$ of the inner faces of the disc-shaped side caps to the freely rotatable swing body. It is particularly preferred if the distance to the freely rotating swing body is at least large enough to allow the freely rotatable swing body to be set in rotation and to rotate freely.

According to the invention, the rotatable play body according to the present invention is preferably held by a user with one hand at the non-rotating mutually opposite disc-shaped side caps, while with the other hand the swing body is mechanically set in rotation, e.g. by abutment with a finger of the other hand. In the case of finger gyroscopes from the state of the art, such as the finger gyroscopes from DE 20 2017 103 662 U1, CN 107 754 323 A, CN 107 395 815 A or U.S. Pat. No. 9,914,063 $B_1$, which have lateral cover caps with a diameter corresponding to that of the used ball bearing or which are minimally larger than the diameter of the first central recess, the finger gyroscope must be held at these lateral cover caps so that the rotating body can rotate freely. State-of-the-art finger gyroscopes often have two or three "gyro arms", wherein the diameter of the rotating body including the gyro arms is more than twice as large as the diameter of the ball bearing used in the respective finger gyroscope, i.e. more than twice as large as the diameter of the lateral cover caps. When holding such a finger gyroscope, it is essential that the rotating body of the finger gyroscope is not touched by the hand, in order that it can be set in rotation and rotate freely. The overall diameter of the state of the art finger gyroscopes is therefore limited to a maximum diameter that depends on the size of the user's hand. Children have smaller hands compared to adults, so that children cannot use all of the state of the art finger gyroscopes for playing, as their hands and fingers may be too small to hold such a finger gyroscope only by the side caps without touching the rotatable swing body. Even if the overall diameter of the finger gyroscope is small enough, it is still necessary that the state-of-the-art finger gyroscopes are held only in the middle of the finger gyroscope, i.e. only at the side caps of the ball bearing, in order to ensure the free rotation of the swing body. This prerequisite can be a disadvantage and an obstacle when using such a finger gyroscope for users who are motoric disadvantaged or clumsy.

The rotatable play body according to the present invention preferably comprises two disc-shaped side caps having a diameter preferably larger than the diameter of the centred ball bearing and further preferably a diameter in the range of 0.5 to 1.5 times, further preferably 0.5 to 1.2 times, further preferably 0.7 to 1.4 times, further preferably 0.7 to 1.3 times, further preferably 0.8 to 1.4 times, more preferably 0.8 to 1.3 times, more preferably 0.7 to 1.2 times, more preferably 0.8 to 1.2 times, more preferably 0.7 to 1.1 times, more preferably 0.8 to 1.1 times, more preferably 0.9 to 1.1 times, more preferably 0.95 to 1.1 times, more preferably 0.95 to 1.05 times, of the outer diameter of the swing body. It is therefore preferred that the disc-shaped side caps (K1) and (K2) have a diameter in the range of 0.5 to 1.5 times, more preferably 0.5 to 1.2 times, more preferably 0.7 to 1.4 times, more preferably 0.7 to 1.3 times, more preferably 0.8 to 1.4 times, more preferably 0.8 to 1.3 times, more preferably from 0.7 to 1.2 times, more preferably from 0.8 to 1.2 times, more preferably from 0.7 to 1.1 times, more preferably from 0.8 to 1.1 times, more preferably from 0.9 to 1.1 times, more preferably from 0.95 to 1.1 times, more preferably from 0.95 to 1.05 times of the outer diameter of the swing body (S). The rotatable play body according to the present invention therefore offers the considerable advantage that it does not have to be held in such a limited predetermined position, as it is the case with finger gyroscopes of the prior art, so that the swing body can rotate freely when the finger gyroscope is held. It is particularly advantageous if the disc-shaped side caps (K1) and (K2) have a diameter in the range of 0.5 to 1.5 times, further preferably 0.5 to 1.2 times, further preferably 0.7 to 1.4 times, further preferably 0.7 to 1.3 times, further preferably from 0.8 to 1.4 times, further preferably from 0.8 to 1.3 times, further preferably from 0.7 to 1.2 times, further preferably from 0.8 to 1.2 times, further preferably from 0, 7 to 1.1 times, more preferably 0.8 to 1.1 times, more preferably 0.9 to 1.1 times, more preferably 0.95 times to 1.1 times, more preferably 0.95 times to 1.05 times the outer diameter of the swing body (S), as this has the advantage that the rotatable play body can be easily and conveniently held at any point at the disc-shaped side caps, wherein the rotatable swing body can rotate freely without hindrance. Thus, the rotatable play body of the present invention offers decisive advantages over the finger gyroscopes of the state of the art, as it is easier to handle, can be used regardless of the size of the hands of a user and is also easy to operate for motoric disadvantaged or clumsy users or especially for children of any age. Due to these advantageous properties, the rotatable play body of the present invention is particularly suitable for children of kindergarten or primary school age.

As mentioned above, the opposite disc-shaped side caps preferably have a distance ($B_0$) between the two mutually opposite disc-shaped side caps, which is composed of the distance $B_4$ between the swing body (S) and the inner face of the first disc-shaped side cap (K1) plus the distance $B_5$ between the swing body (S) and the inner face of the second disc-shaped side cap (K2) plus the width ($B_3$) of the swing body (S). In other words, the opposite side caps preferably have a distance ($B_0$) between the opposite disc-shaped side caps that is greater than the width ($B_3$) of the swing body (S). This is particularly advantageous when the opposite disc-shaped side caps have a diameter in the range of 0.5 to 1.5 times, further preferably 0.5 to 1.2 times, further preferably 0.7 to 1.4 times, further preferably 0.7 to 1.3 times, further preferably 0.8 to 1.4 times, further preferably 0.8 to 1.3 times, more preferably from 0.7 to 1.2 times, more preferably from 0.8 to 1.2 times, more preferably from 0.7 to 1.1 times, more preferably from 0.8 to 1.1 times, more preferably from 0.9 to 1.1 times, more preferably from 0.95 to 1.1 times, more preferably from 0.95 to 1.05 times of the outer diameter of the swing body (S). The rotatable play body according to the present invention has the advantageous property compared to the finger gyroscope of the prior art that with opposite disc-shaped side caps preferably with a diameter in the range of 0.5 to 1.5 times, further preferably 0, 5 to 1.2 times, more preferably 0.7 to 1.4 times, more preferably 0.7 to 1.3 times, more preferably 0.8 to 1.4 times, more preferably 0.8 to 1.3 times, more preferably 0.7 to 1.2 times, more preferably 0.8 to 1.2 times, further preferably from 0.7 to 1.1 times, further preferably from 0.8 to 1.1 times, further preferably from 0.9 to 1.1 times, further preferably from 0.95 to 1.1 times, further preferably from 0.95 times to 1.05 times the outer diameter of the swing body (S), easier handling is achieved, since, in contrary to the finger gyroscopes of the state of the art, it is not necessary to hold the rotatable play body only at a small area in the middle of the finger gyroscope, usually the cover caps, in relation to the overall diameter of the finger gyroscope. Furthermore, it is advantageous if the mutually opposite disc-shaped side caps have a distance $B_4$ or $B_5$ to the swing body, so that it is ensured that the disc-shaped side caps can also be held in place at the outermost edge, the outer edge (R1) of the first disc-shaped side cap, as well as the outer edge (R2) of the second disc-shaped side cap, without inadvertently touching the swing body and thereby preventing the free rotation of the swing body. In finger gyroscopes of the state of the art, such as those in CN 107 320 973 A, a side cover with a central recess is shown which has a larger diameter than the ball bearing used. A second cover cap with centred extensions is inserted into the central recess of this cover. The side covers are embedded in the outer shell of the swing body, so in this finger gyro the distance between the inner faces of the covers is smaller than the width of the rotating body. This finger gyroscope therefore has the disadvantage that it cannot be held at the outer edge of the covers, as the covers and the rotating swing body merge into each other without any difference in height. It is also important to ensure that the finger gyroscope is held in the middle of the finger gyroscope, as the covers as disclosed in CN 107 320 973 A are covers that are rotatably connected to the rotating housing. Therefore, the covers in CN 107 320 973 A also have a central recess in which a second cover is inserted for holding the finger gyroscope. Thus, the covers according to CN 107 320 973 A are not the non-rotating disc-shaped side caps of the rotatable play body of the present invention. Furthermore, the covers according to CN 107 320 973 A are not disc-shaped side caps with plane surfaces which are particularly suitable for being printable.

The disc-shaped side caps of the rotatable play body according to the present invention may be made of a plastic, glass, wood or metals such as aluminium. It is preferred if the disc-shaped side caps are made of polypropylene (PP) and further preferably of polyvinyl chloride (PVC) and particularly preferably of polyoxymethylene (POM). Other non-exhaustive examples of suitable materials are metals such as cast iron, steel, stainless steel, aluminium alloys, copper alloys, magnesium alloys, titanium alloys, zinc alloys; ceramics, such as glass such as borosilicate glass, glass ceramics, quartz glass, soda-lime glass, or technical ceramics such as silicon, silicon carbide, silicon nitride, tungsten carbide, composite materials such as aluminium-silicon carbide, carbon fibre reinforced plastic (CFRP), glass fibre reinforced plastic (GFRP), natural materials such as wood or bamboo, polymers or plastics such as elastomers e.g. natural rubber, thermoplastics such as acrylonitrile-butadiene-styrene copolymer (ABS), cellulose acetate (CA), ionomers, polyamides such as nylon, polycarbonates (PC), polyether ether ketone (PEEK), polyethylene (PE), polyethylene terephthalate (PET), polymethyl methacrylate (PMMA), polyoxymethylene (POM), polypropylene (PP), polystyrene (PS), polyurethane thermoplastics, polyvinyl chloride (PVC), Teflon (PTFE), thermosets such as epoxy resins, phenolic resins and polyesters. In some embodiments, the disc-shaped side caps can be made of different materials. In some embodiment, the disc-shaped side caps can be made of the same material. It is preferred, if the disc-shaped side caps are made of the same material. In preferred embodiments, the disc-shaped side caps have a diameter which is greater than the diameter of the centred ball bearing, in some preferred embodiments the disc-shaped side caps have a diameter in the range of 0.5 to 1.5 times, more preferably 0.5 to 1.2 times, more preferably 0.7 to 1.4 times, more preferably 0.7 to 1.3 times, more preferably 0.8 times to 1.4 times, more preferably 0.8 times to 1.3 times, more preferably 0.7 times to 1.2 times, more preferably 0.8 times to 1.2 times, more preferably 0.7 times to 1.1 times, more preferably 0.8 to 1.1 times, more preferably 0.9 to 1.1 times, more preferably 0.95 to 1.1 times, more preferably 0.95 to 1.05 times the outer diameter of the swing body. It is therefore preferred that the material from which the disc-shaped side caps are made will not be plastically deformed or will not break when a weak compressive force is applied or acts perpendicularly to the disc-shaped side caps, especially at the outer edge (R1 and R2) of the disc-shaped side caps, i.e. at the maximum distance from the centre of the disc-shaped side caps, i.e. at the distance of the outer radius of the disc-shaped side caps. It is preferred when at least a compressive force of at least 50 N, more preferably at least 60 N, more preferably at least 70 N, more preferably at least 80 N, more preferably at least 90 N, more preferably at least 100 N is required to bend the first or second disc-shaped side cap at the outer edge (R1 or R2) of the corresponding disc-shaped side cap in the direction of the swing body, wherein the disc-shaped side caps are plastically deformed or break. It is therefore particularly preferred that the disc-shaped side caps are not plastically deformed and/or do not break by an acting compressive force or by an applied compressive force at the outer edge of the disc-shaped side caps of below 100 N.

This is particularly preferred when the disc-shaped side caps are made of a material for which no plastic deformation or breakage of the material occurs when one or both disc-shaped side caps are bent by a deflection f, which preferably corresponds maximally to the distance $B_4$ between the swing body (S) and the inner face of the first disc-shaped side cap (K1) and/or the distance $B_5$ between the swing body (S) and the inner face of the second disc-shaped side cap (K2), in particular if the diameter of the disc-shaped side caps is smaller than or equal to the diameter of the swing body (S). Such materials include, but are not limited to, glass or even plastics such as PMMA or amorphous and brittle plastics or glass fibre reinforced plastics or wood, where fracture occurs under heavy stress rather than permanent plastic deformation as in some soft plastics or metals or metal alloys. Force is a directed physical quantity that can be represented by a vector. For the description of a force not only its magnitude is necessary, but also the direction in which the force acts. Besides the magnitude and direction of the force vector, its point of application also determines the force effect. Therefore, as used herein, the term "compressive force" means a force acting perpendicularly on the disc-shaped side caps in the direction of the freely rotating swing body so that the disc-shaped side caps are movable against the freely rotatable swing body. The term "compressive force" as used herein refers preferably to the force required to compress the disc-shaped side caps, i.e. to press each of them in the direction of the freely rotatable swing body so that the freely rotatable swing body is fixed in its position, wherein fixing the freely rotatable swing body in its position herein also means that a previously rotating swing body is braked. The "compressive force" acts preferably at the outer edge of the disc-shaped side caps, since the amount of compressive force for fixing the freely rotatable swing body in its position is lowest at the outer edge of the disc-shaped side caps. As used herein, the term "acting compressive force" refers to the amount of force preferably acting at the outer edge of the disc side caps, wherein the "acting compressive force" preferably must exhibit a minimum amount in order to move the disc-shaped side caps against the free rotatable swing body. If the amount of the acting compressive force is less than the minimum amount required to move the disc-shaped side caps against the freely rotatable swing body, the disc-shaped side caps are not moved against the freely rotatable swing body. If the amount of the compressive force is continuously increased until the acting compressive force reaches said minimum amount, the disc-shaped side caps are moved at the outer edge against the freely rotatable swing body so that the freely rotatable swing body is fixed in its position.

As used herein, the term "applied compressive force" means the force that acts when the disc-shaped side caps are held in place or when the disc-shaped side caps are compressed, for example when the disc-shaped side caps have been moved against the freely rotatable swing body so that the freely rotatable swing body is fixed in its position and the freely rotatable swing body remains fixed in its position for a period of time. If the disc-shaped side caps are moved at the outer edge against the freely rotatable swing body by an acting compressive force at the outer edge of the disc-shaped side caps, so that the freely rotatable swing body is fixed in its position, the freely rotatable swing body remains fixed in its position as long as the applied compressive force is kept constant. If the amount of the applied compressive force is reduced, i.e. when the applied compressive force decreases, the disc-shaped side caps preferably return to the position as before the application of the compressive force or, in other words, the disc-shaped side caps again take up the distance to the freely rotatable swing body as before the application of the acting compressive force. Therefore the applied compressive force preferably corresponds to the force at the outer edge of the disc-shaped side caps which must be applied to hold the side caps in the compressed position so that the freely rotatable swing body remains fixed in its position. The decay of the applied compressive force therefore also corresponds to a release of the disc-shaped side caps so that they return to their original starting position.

It is further preferred that, in the case of a small deflection f, i.e. a bending of the disc-shaped side caps, which preferably corresponds at most to the distance $B_4$ between the swing body (S) and the inner face of the first disc-shaped side cap (K1) and/or the distance $B_5$ between the swing body (S) and the inner face of the second disc-shaped side cap (K2), in particular when the diameter of the disc-shaped side caps is smaller than or equal to the diameter of the swing body (S), an essentially elastic deformation takes place so that after omission of the force effect the disc-shaped side caps return to their original state. It is therefore preferred that the material from which the disc-shaped side caps are made behaves elastically or visco-elastically or essentially elastically when bent by a small deflection f preferably by 0.1-3.0 mm, by 0.3 mm-2.0 mm, further preferably by 0.5 mm-1.5 mm and most preferably by 0.8 mm-1.2 mm, so that the disc-shaped side caps are not plastically deformed or break.

It is therefore also preferred that the material from which the disc-shaped side caps are made does not consist of a very elastic and soft material, i.e. preferably not of a material with a small electricity module, where bending of the disc-shaped side caps already takes place when holding the rotatable play body, so that the disc-shaped side caps at the outer edge are movable against the freely rotatable swing body even by a weak acting compressive force, so that the freely rotatable swing body is fixed in its position. The rotatable play body of the present invention preferably has opposite disc-shaped side caps, which preferably have a diameter in the range of 0.5 to 1.5 times, further preferably 0.5 to 1.2 times, further preferably 0.7 to 1.4 times, more preferably 0.7 to 1.3 times, more preferably 0.8 to 1.4 times, more preferably 0.8 to 1.3 times, more preferably 0.7 to 1.2 times, more preferably 0.8 to 1.2 times, further preferably 0.7 to 1.1 times, further preferably 0.8 to 1.1 times, further preferably 0.9 to 1.1 times, further preferably 0.95 to 1.1 times, further preferably 0.95 times to 1.05 times the diameter of the swing body and also preferably equal to the diameter of the swing body, so that the rotatable play body does not have to be held exclusively in the centre of the rotatable play body, but can also be held at the outer edge (R1 or R2) of the side caps (K1 and K2) without hindering the rotation of the rotating body, i.e. without fixing the rotatable swing body in its position. Thus, it is preferred, that the acting compressive for holding or applied compressive force while holding at the outermost edge (R1 or R2) of the disc-shaped side caps (K1 or K2) does not cause a deflection f of the disc-shaped side caps, preferably corresponding at most to the distance $B_4$ between the swing body (S) and the inner face of the first disc-shaped side cap (K1) and/or the distance $B_5$ between the swing body (S) and the inner face of the second disc-shaped side cap (K2), in particular if the diameter of the disc-shaped side caps is smaller than or equal to the diameter of the swing body (S), and does not cause the disc-shaped side caps to contact the rotatable swing ring and to prevent the free rotation of the swing body and to fix the freely rotatable swing body in its position. Therefore it is preferred if the acting compressive force or the applied compressive force required for bending of the disc-shaped side caps by a deflection f, wherein the deflection f preferably corresponding at most to the distance $B_4$ between the swing body (S) and the inner face of the first disc-shaped side cap (K1) and/or the distance $B_5$ between the swing body (S) and the inner face of the second disc-shaped side cap (K2), in particular if the diameter of the disc-shaped side caps is smaller than or equal to the diameter of the swing body (S), is not smaller than 15 N, preferably is not smaller than 14 N, more preferably is not smaller than 13 N, more preferably is not smaller than 12 N, more preferably is not smaller than 11 N and especially preferably is not smaller than 10 N and especially preferably is not smaller than 5 N.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps are not plastically deformed or break by an acting compressive force acting at the outer edge (R1) and (R2) perpendicular to the disc-shaped side caps (K1) and (K2) of up to 40N, preferably up to 50N, preferably up to 60N, preferably up to 70N, preferably up to 80N, preferably up to 90N, preferably up to 100N, and wherein the disc-shaped side caps are not bend or are not movable against the freely rotatable swing body (S) in order to fix the freely rotatable swing body (S) in its position by an acting compressive force acting at the outer edge (R1) and (R2) perpendicular to the disc-shaped side caps (K1) and (K2) of below 5N, preferably below 10N, preferably below 15N.

The present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps (K1) and (K2) preferably have a diameter in the range of 0.5 times to 1.5 times, further preferably 0.5 times to 1.2 times, further preferably 0.7 times to 1.4 times, further preferably 0.7 times to 1.3 times, further preferably 0.8 times to 1.4 times, further preferably 0.8 times to 1.3 times, further preferably 0.7 times to 1.2 times, more preferably 0.8 times to 1.2 times, more preferably 0.7 times to 1.1 times, more preferably 0.8 times to 1.1 times, more preferably 0.9 times to 1.1 times, more preferably 0.95 times to 1.1 times, more preferably 0.95 times to 1.05 times the outer diameter of the swing body (S), the distance ($B_0$) between the inner faces (I1, I2) of the opposite disc-shaped side caps (K1) and (K2) is greater than the width ($B_3$) of the swing body (S), wherein the disc-shaped side caps are not plastically deformed or break by an acting compressive force acting at the outer edge (R1) and (R2) perpendicular to the disc-shaped side caps (K1) and (K2) of up to 40N, preferably up to 50N, preferably up to 60N, preferably up to 70N, preferably up to 80N, preferably up to 90N, preferably up to 100N, and wherein the disc-shaped side caps are not bend or are not movable against the freely rotatable swing body (S) in order to fix the freely rotatable swing body (S) in its position by an acting compressive force acting at the outer edge (R1) and (R2) perpendicular to the disc-shaped side caps (K1) and (K2) of below 5N, preferably below 10N, preferably below 15N.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps (K1) and (K2) at the outer edge (R1) and (R2) are reversibly movable against the freely rotatable swing body (S) by an acting compressive force acting parallel to the axis of rotation in the range from 5N to 100N, preferably 8N to 90N, preferably 10N to 80N, preferably 12N to 70N, preferably 14N to 60N, preferably 16N to 50N, preferably 18N to 40N, preferably 20N to 35N in order to fix the freely rotatable swing body (S) in its position.

The play ring according to the invention is part of a children's game and for this purpose it must have a plane and visible printable surface of the outer shell (M) of the swing body (S) along the axis of rotation and the possibility of selecting one of the printed motifs by stopping the rotating swing body (S), wherein the stopping and fixing being effected by pressing the side caps (K1) and (K2) against the swing body (S). The pressure should be in a range that is comfortable for children, from about 14N to 60N, preferably 16N to 50N, preferably 18N to 40N, preferably 20N to 35N. If the pressure is reduced again, the fixation of the swing body (S) is reversed, the side caps (K1) and (K2) reversibly return to their starting position and the swing body (S) can be rotated once again and then be stopped. Several million of these rotating and stopping cycles can be performed with the play ring.

A further advantage of the rotatable play body of the present invention compared to the finger gyroscopes of the prior art is that the disc-shaped side caps of the rotatable play body according to the invention provide a larger surface area for printing. State of the art finger gyroscopes according to DE 20 2017 103 662 U1, CN 107 754 323 A, CN 107 395 815 A or U.S. Pat. No. 9,914,063 $B_1$ are equipped with cover caps, which are almost completely covered by the fingers when holding. If the disc-shaped side caps have a diameter larger than the diameter of the centred ball bearing, preferably in the range of 0.5 times to 1.5 times, more preferably from 0.5 to 1.2 times, more preferably from 0.7 times to 1.4 times, more preferably from 0.7 times to 1.3 times, more preferably from 0.8 times to 1.4 times, more preferably from 0.8 times to 1.3 times, more preferably from 0.7 times to 1.2 times, more preferably from 0.8 times to 1.2 times, more preferably from 0.7 times to 1.1 times, 0.8 times to 1.1 times, further preferably 0.9 times to 1.1 times, further preferably 0.95 times to 1.1 times, further preferably 0.95 times to 1.05 times the diameter of the swing ring, the outer faces of the disc-shaped side caps are preferably printable, so that the printed figures, motifs, shapes and text are not completely covered by the fingers. The advantage of printing on the disc-shaped side caps compared to printing on the lateral outer faces of a swing body is that the disc-shaped side caps do not rotate, i.e. are not freely rotatable, so that the figures, motifs, pictures and text are clearly visible even when the swing body is rotating. Thus, the finger gyroscopes of the state of the art do not offer comparable surfaces that can be printed, where during the use of these finger gyroscopes, i.e. while playing, the figures, motifs, pictures and text are clearly visible while the rotating body is rotating. Even for the finger gyroscope from the state of the art according to CN 107 320 973 A, the covers are rotating and are rotatably connected to the rotating body and therefore rotate with the rotating body. The representation of figures, motifs, shapes and text on non-spinning or non-rotating disc-shaped side caps increases the pleasure and enjoyment of printed surfaces during the use of the rotating play body of the present invention, i.e. during playing, i.e. during the rotation of the freely rotatable swing body according to the present invention.

In preferred embodiments, the disc-shaped side caps of the rotatable play body according to the present invention can be exchanged. Since the non-rotating cover caps of state-of-the-art finger gyroscopes are largely covered by the fingers while holding, and since figures, motifs, pictures and text on the outer lateral surface of the rotating body are not clearly and distinctly visible during rotation due to the rotational movement, replacing the cover caps of state-of-the-art finger gyroscopes will not increase the fun of playing. In the rotatable play body of the present invention, the figures, motifs, pictures and text are preferably not completely covered when held, so that a user can exchange the disc-shaped side caps according to own preferences and can use different disc-shaped side caps printed with figures, motifs, pictures and text. Thus, the rotatable play body according to the present invention can advantageously provide a rotatable play body having individually printed outer faces of the disc-shaped side caps which do not rotate during the use of the rotatable play body and thus also provide pleasure during the rotation of the rotatable play body, which many users, especially children, enjoy.

A further advantage of the rotatable play body according to the present invention is that the disc-shaped side caps may be printed with figures, motifs, pictures, shapes and text in the form of one or more markings which, after stopping and terminating the rotation of the freely rotatable swing body, may point or point to a printed field on the outer edge of the rotatable play body, in the case of a cylindrical outer shell on the cylinder surface or shell surface. With the finger gyroscopes of the state of the art, such a marking is inevitably covered when holding with the fingers, or the user must laboriously lift the finger to see which field could be selected. Since the state of the art rotating bodies of finger gyroscopes are freely rotating bodies, it is likely that the rotating body will continue to rotate or move unintentionally, especially if the hand or fingers of the user holding such finger gyroscopes are moved. Therefore, with the rotatable play body according to the present invention having opposite disc-shaped side caps preferably having a diameter in the range of 0.5 times to 1.5 times, more preferably 0.5 times to 1.2 times, more preferably 0.7 times to 1.4 times, further preferably from 0.7 times to 1.3 times, further preferably from 0.8 times to 1.4 times, further preferably from 0.8 times to 1.3 times, further preferably from 0.7 times to 1.2 times, further preferably from 0.8 times to 1.2 times, further preferably from 0, 7 times to 1.1 times, more preferably 0.8 times to 1.1 times, more preferably 0.9 times to 1.1 times, more preferably 0.95 times to 1.1 times, more preferably 0.95 times to 1.05 times the diameter of the rotatable swing body, a rotatable play body can be provided with which additional fun-enhancing functions can be easily and conveniently integrated into a game by providing disc-shaped side caps with larger outer faces by area which are preferably printable. The rotatable play body also has the advantage that the disc-shaped side caps at the outer edge are preferably movable against the freely rotatable swing body in order to fix the freely rotatable swing body in its position, so that, in contrast to state-of-the-art finger gyroscopes, unintentional rotation or movement of the freely rotatable swing body can be prevented, since the fixed freely rotatable swing body cannot rotate freely.

One of the disadvantages of state-of-the-art finger gyroscopes is that they are designed exclusively to provide fun and enjoyment from the rotation of the rotating body. For this reason, the main focus in providing state-of-the-art finger gyroscopes is to provide rotating bodies that show additional effects during rotation, e.g. light effects by built-in LEDs. In its simplest form, the visual effect achieved with the state-of-the-art finger gyroscopes is that the finger gyroscopes have two or three or more "gyro arms", whereas during rotation the two or three or more "gyro arms" are no longer clearly and distinctly visible and distinguishable, so that to the eye of the user the rotating body with the two or three or more "gyro arms" appears circular and round.

The rotatable play body according to the present invention exhibits advantageous properties, since the disc-shaped side caps can be printed on the outer faces and the diameter of the disc-shaped side caps is preferably so large that figures, motifs, pictures and text are not completely covered, but also that the outer shell of the swing body has one or more printable surfaces, as preferably on the outer frame of the outer shell, i.e. the circumferential shell surface or the cylindrical surface in the case of a cylindrical outer shell, so that the visual effects of the finger gyroscopes from the state of the art can be integrated into the rotatable play body according to the present invention. Thus, with the rotatable play body according to the present invention preferably the representation of figures, pictures, motifs and text during rotation, as well as visual effects by the rotation of the rotatable swing body can be provided simultaneously with a rotatable play body according to the invention. Surprisingly, it was found that such a combination of printable non-rotating surfaces and printable rotating surfaces provides an enhanced and positive effect on the fun and enjoyment of playing with the rotatable play body according to the present invention.

With the provision of a freely rotatable swing body between two non-rotating mutually opposite side caps with a diameter in the range of 0.5 to 1.5 times, further preferably 0.5 to 1.2 times, further preferably 0.7 to 1.4 times, further preferably 0, 7 to 1.3 times, further preferably from 0.8 to 1.4 times, further preferably from 0.8 to 1.3 times, further preferably from 0.7 to 1.2 times, further preferably from 0.8 to 1.2 times, further preferably from 0.7 to 1.1 times, further preferably from 0.8 to 1.1 times, more preferably from 0.9 to 1.1 times, more preferably from 0.95 to 1.1 times, more preferably from 0.95 to 1.05 times the diameter of the rotatable swing body, a rotatable play body is provided according to the invention, which on the one hand is easy to handle and on the other hand, by combining the pleasure of a freely rotatable swing body with the pleasure of printable non-rotating outer faces, which provide additional possibilities for increasing the fun of playing, an increase in the fun of playing with the rotatable play body of the present invention is achieved. With these advantageous properties, the present invention therefore provides a rotatable play body with which, in particular, playing fun is maintained over a long period of time and the motivation and interest in playing with the rotatable play body is maintained or even increased over a long period of time. Furthermore, due to the advantageous technical characteristics of the rotatable play body according to the invention, pedagogically valuable functions can also be integrated into the play process with the rotatable play body, which produce a beneficial and positive learning effect in addition to the joy of playing, especially for children.

In some embodiments, the material from which the disc-shaped side caps are made can be a metal or metal alloy, e.g. steel, stainless steel, which has a high modulus of elasticity E. The force required to bend a material with a given geometric shape depends on the material constants of the material used, as well as the geometric shape and the stress on the material. The force required to bend a disc-shaped side cap depends on the location at which the force is applied. When the force acts perpendicular to the disc-shaped side caps, the acting compressive force required to bend the disc-shaped side caps by the maximum deflection is the lowest when the compressive force acts at the maximum distance from the centre of the side cap, i.e. preferably at the outer edge (R1 or R2) of the disc-shaped side caps (K1 or K2). The maximum distance to the centre is therefore at the outer edge of a disc-shaped side cap. Therefore, the minimum amount of acting compressive force to move the disc side caps against the free rotating swing body in order to fix the freely rotatable swing body in its position depends on the diameter of the disc-shaped side cap, the diameter of the centred extension on the inner face of a disc-shaped side cap, the shape of the centred extension on the inner face of a disc-shaped side cap, the thickness or width or height of the disc-shaped side cap, and the material constants of the material from which the disc-shaped side cap is made. The compressive force to be applied is the higher, the thicker or wider or higher the side cap, the smaller the radius of the side cap and the stiffer the material, e.g. it has a high modulus of elasticity. If a material is bent, it can behave in an elastic, non-elastic, visco-elastic or inelastic manner. For example, a material can be plastically deformed or even break at a certain deflection, or it can be elastically deformed at a certain deflection so that the material returns elastically to its initial state after omission of the force effect.

If the disc-shaped side caps have a diameter less than or equal to the diameter of the swing body, the disc-shaped side caps can only be moved against the freely rotating swing body, i.e. deflected inwards, by the distance $B_4$ or $B_5$ of the inner faces of the disc-shaped side caps to the swing body. It is therefore preferable that the disc-shaped side caps do not undergo plastic deformation or break when being deflected by the distance between the inner faces of the disc-shaped side caps and the swing body. Therefore the distance between the disc-shaped side caps and the swing body must be observed. The diameter of the disc-shaped side caps is preferably in the range of 0.5 to 1.5 times, more preferably from 0.5 to 1.2 times, more preferably from 0.7 to 1.4 times, more preferably from 0.7 to 1.3 times, more preferably from 0.8 to 1.4 times, more preferably from 0.8 to 1.3 times, more preferably from 0.7 to 1.2 times, more preferably from 0.8 to 1.2 times, more preferably from 0.7 to 1.1 times, more preferably from 0.8 to 1.1 times, more preferably from 0.9 to 1.1 times, more preferably from 0.95 to 1.1 times, more preferably from 0.95 to 1.05 times the diameter of the swing body. For example, if the diameter of the disc-shaped side caps is 1.2 times the diameter of the swing body, the disc-shaped side caps can be deflected at the outer edge of the disc-shaped side caps by a deflection greater than the distances $B_4$ or $B_5$. It is preferred that the disc-shaped side caps are not plastically deformed even by this deflection and also do not break.

In another preferred embodiment, the disc-shaped side caps and the swing body have a suitable distance, so that, for example, an inwardly directed force perpendicular to the disc-shaped side caps can be applied preferably at the outer edge of the disc-shaped side caps, so that the rotation of the swing body is slowed down after the swing body has previously been set in rotation. In an exemplary embodiment of the rotatable play body, the force described above can be applied by pressing the play body together with two fingers at the outer edge of the side caps. In a preferred embodiment, the freely rotatable swing body is slowed down by pressing the disc-shaped side caps together, preferably at the outer edge of the disc-shaped side caps. It is preferable if at least a compressive force of 20 N must be applied at the outer edges of the disc-shaped side caps in order to brake the rotating freely rotatable swing body.

In other words, it is preferred that the disc-shaped side caps and the swing body have a suitable distance, so that the disc-shaped side caps at the outer edge can be moved against the freely rotatable swing body in order to fix the freely rotatable swing body in its position. "Fixing" as used herein means that a swing body which has previously been set in rotation is braked until the freely rotatable swing body comes to a standstill, and that a swing body which is fixed cannot be set in rotation. In other words, if a freely rotatable swing body is fixed, its position is maintained. In an exemplary embodiment of the rotatable play body, an acting force acting perpendicular to the disc-shaped side caps can be applied by pressing the play body together with two fingers at the outer edge of the side caps. In a preferred embodiment, the swing body fixed by compressing the disc-shaped side caps by the applied compression force cannot be set in rotation. Only when the disc-shaped side caps are no longer compressed, i.e. a decay of the applied compressive force, the disc-shaped side caps preferably take back the position they had before the application of the compressive force, i.e. the disc-shaped side caps again take back the distance to the freely rotatable swing body as before the application of the compressive force, so that the freely rotatable swing body is no longer fixed, i.e. is again freely rotatable and can thus be set in rotation again.

To slow down or stop the rotation of the swing body by pressing the side caps together at the outer edge of the side caps, it is preferred that the side caps are made of a material, for which a certain force effect causes the material to bend and thus causes the disc-shaped side caps to bend, i.e. causes a deflection f at the outer edge of the disc-shaped side caps, so that the disc-shaped side caps made of this material are deformed substantially elastically and return to their original state after termination or omission of the force effect. It is particularly preferred that the side caps are not plastically or permanently deformed by compression, i.e. by the acting compressive force. In other words, it is preferred that the material from which the disc-shaped side caps are made is elastically deformed when the side caps are pressed together at the outer edge of the disc-shaped side caps in order to slow down the rotation of the swing body or to fix the swing body, and thus the disc-shaped side caps are elastically deformed.

It is further preferred that when the inner faces of the disc-shaped side caps have a distance $B_4$ or $B_5$ to the swing body, the disc-shaped side caps are bent inwards, i.e. moved by the distance $B_4$ or $B_5$, i.e. are bent in direction of the swing body or towards each other, i.e. are movable against the freely rotatable swing body, by an inwardly directed acting compressive force acting perpendicular to the disc-shaped side caps, preferably at the outer edge of the disc-shaped side caps, so that the disc-shaped side caps and the swing body come into contact, i.e. the disc-shaped side caps are bent in the direction of the swing body to such an extent, that the disc-shaped side caps and the swing body come into contact, so that a braking of the rotation of the swing body is effected by occurring frictional forces after the swing body has been previously set in rotation, and so that the swing body is fixed in its position, wherein after termination or omission of the force effect, thus after decay of the applied compressive force, the disc-shaped side caps, return to the original state, with other words regain the distance $B_4$ or $B_5$ to the swing body after termination or omission of the force effect, i.e. return to the position as before the application of the pressure. In other words, at least one of the disc-shaped side caps is bent by a deflection f preferably by the distance $B_4$ or $B_5$, i.e. the disc-shaped side caps are not plastically deformed or break at a deflection $f=B_4$ or $B_5$, i.e. the material from which the disc-shaped side caps are made is essentially elastically deformed at a deflection $f=B_4$ or $B_5$, when a compressive force acts or is applied at the outer edge of the disc-shaped side caps, wherein the rotation of the freely rotatable swing body is braked or wherein the freely rotatable swing body is fixed in its position.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position.

A force at the outer edge of the disc-shaped side caps means that the force or point force or compressive force acts or is applied to the disc-shaped side caps perpendicular to the disc-shaped side caps at a point corresponding to the maximum distance from the centre of the disc-shaped side caps, i.e. the outer radius of the disc-shaped side cap. If the disc-shaped side caps are cylindrical, the force can act on the outer edge of the disc-shaped side caps, i.e. at the distance of the outer radius of the disc-shaped side caps, at any point of the outer circumference at the outer edge of the disc-shaped side caps. If the disc-shaped side caps have a triangular, rectangular, pentagonal, hexagonal, octagonal or polygonal shape, wherein the triangular, square, pentagonal, hexagonal, octagonal or polygonal shape is preferably a regular polygon, it is preferred that the acting compressive force acts or is applied at the outer edge of the disc-shaped side caps at the maximum distance from the centre. In the case of a regular polygon, as described above, the corners of a polygon all lie on an imaginary circle. Therefore, it is preferable that the acting compressive force acts at the outer edge of the disc-shaped side caps at the corners of the regular polygon, since the corners have the maximum radius to the centre of the disc-shaped side caps. Since the acting compressive force acting on the outer edge of the disc-shaped side caps can act at any point of the outer circumference of the disc-shaped side caps in a cylindrical outer shell of the freely rotatable swing body, preferably in the form of a hollow cylinder with a constant wall thickness (W) and a constant outer radius, a cylindrical outer shell is particularly preferred.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the freely rotatable swing body (S) with the outer shell (M) is cylindrical, and the outer cylindrical surface of the cylindrical swing body (S) is plane and printable, wherein preferably the wall thickness (W) of the cylindrical outer shell (M) of the freely rotatable swing body (S) is constant.

If the first and second disc-shaped side caps have a triangular, rectangular, pentagonal, hexagonal, heptagonal, octagonal or polygonal shape, preferably in the form of a regular polygon, it is then preferred that the corners of the regular polygon of the first and second disc-shaped side caps lie on top of each other, so that the acting compressive force can act on both sides of the rotatable swing body at opposite points. It is therefore particularly preferred that the distance $B_4$ between the inner face of the first disc-shaped side cap and the swing body and the distance $B_5$ between the inner face of the second disc-shaped side cap and the swing body prior to the inwardly directed force effect perpendicular to the disc-shaped side caps, preferably at the outer edge of the disc-shaped side caps, preferably at the maximum distance from the centre of the disc-shaped side caps, i.e. the outer radius of the disc-shaped side caps, and after termination or omission of said force effect remains constant or is the same. That means it is preferred that $B_4$ (before force effect)=$B_4$ (after force effect) and $B_5$ (before force effect)=$B_5$ (after force effect). It is therefore preferred that the disc-shaped side caps at the outer edge are reversibly movable against the swing rotating swing body by an acting compressive force in order to fix the freely rotating swing body in its position.

It is preferred when an acting compressive force of at least 20 N must be applied perpendicular to the disc-shaped side caps, preferably at the outer edge of the disc-shaped side caps, so that the disc-shaped side caps are deflected at least to the extent of the distance between the disc-shaped side caps and the freely rotatable swing body, i.e. by the distance $B_4$ or $B_5$, so that a braking of the rotating swing body is effected or wherein the freely rotatable swing body is fixed in its position. Technically relevant nominal design strength values can be determined by a skilled person in the art using methods known from the state-of-the-art and a stress-strain diagram can be created for a given material. A stress-strain diagram distinguishes between different ranges: the linear-elastic range, in which the strain is proportional to the stress and thus Hooke's law applies, the non-linear-elastic range, in which the deformation is still reversible, i.e. elastic but no longer proportional to the stress, and the elastic-plastic range, in which the deformation is partially plastic, i.e. irreversible. If the elastic limit is exceeded, permanent deformation occurs in a component or a material. It is therefore preferred that the disc-shaped side caps at the outer edge are reversibly movable against the freely rotatable swing body by an acting compressive force in order to fix the freely rotatable swing body in its position, wherein the elastic limit of the material of the disc-shaped side caps is not exceeded at a deflection f of the disc-shaped side caps at the outer edge of the side caps in the direction of the freely rotatable swing body.

The strength of a material describes the ability to withstand mechanical loads before failure occurs and is given as mechanical stress a (force per cross-sectional area ($N/mm^2$)). Failure can be an impermissible deformation, in particular a plastic or a permanent deformation or a fracture. Different strengths can be achieved depending on the type of material, material condition, temperature, load and load speed. The strength of a material therefore depends on the material itself, the time course of the stress and the type of stress.

The stiffness of a material describes the relationship between strain and mechanical stress and thus the resistance of a body to elastic deformation by a force or a moment (bending moment or torsional moment). The stiffness of a component not only depends on the elastic properties of the material (the modulus of elasticity), but also on the geometry of the component. The bending stiffness is the product of the elastic modulus (E) of the material and the area moment of inertia (I) of the cross-section. The curvature of the body is proportional to the applied bending moment and inversely proportional to the bending stiffness. A bending moment is called a moment that loads a slim (e.g. beam) or thin component, e.g. a plate, and consequently bends it. In order to determine the effects of a moment load, the progression of the bending moment, e.g. in case of a beam, is considered over the longitudinal alignment of the beam. In general, the deformation or bending line of the component and the resulting mechanical stresses or bending stresses are determined in order to compare them with the maximum allowable stresses or strengths of the material. For example, a beam clamped on one side can be loaded at the free end at distance L by a force F as point load P. The cross-section and material properties are preferably constant along the beam. The bending moment is zero at the point of introduction of the force and increases linearly up to the clamping point to a maximum value $M=F \cdot L$.

Elasticity is the property of a body or material to change its shape under a force effect and to return to its original form when the force effect is omitted. A distinction is made between the linear-elastic behaviour, which is described by Hooke's law, it generally occurs with small deformations, and the non-linear-elastic behaviour, where the stress depends non-linearly on the deformation. If a deformation remains after removing the deflecting forces, one speaks from elastic hysteresis. For all materials there is a limit in the range of elasticity beyond which a non-elastic behaviour is observed. The modulus of elasticity (E), also known as the e-modulus, is a material parameter from materials engineering that describes the proportional relationship between stress and strain during the deformation of a solid body in the case of linear-elastic behaviour. The modulus of elasticity is the constant of proportionality in Hooke's law. The amount of the modulus of elasticity is the greater the more resistance a material offers to its elastic deformation. A component made of a material with a high modulus of elasticity (e.g. steel) is stiffer than a component of the same construction made of a material with a low modulus of elasticity (e.g. rubber). The modulus of elasticity is defined as the slope of the graph in the stress-strain diagram under uniaxial loading with infinitesimal distortion change under dielectric strength. Most materials have at least a small linear-elastic range, this is also called the Hooke's range. Real materials have an elastic limit within which they deform elastically and beyond which dissipative processes such as fractures occur. Hooke's law describes the elastic deformation of solids if their deformation is proportional to the load applied (linear-elastic behaviour). This method is typical for metals, if the load is not too great, as well as for hard, brittle materials such as glass, ceramics, silicon, often to the point of fracture.

The yield strength is a material parameter and describes the stress up to which a raw material or material shows no permanent plastic deformation under uniaxial and torque-free tensile stress: below the yield strength, the material returns elastically to its original shape after relief of the strain and if the yield strength is exceeded, a change in shape remains, i.e. an elongation in the case of a tensile test, and a permanent curvature in the case of bending. The characteristic values corresponding to the yield strength for other types of material stress are called compressive yield point, bending limit and torsion limit, which are also summarized under the umbrella term yield point and elasticity limit. It is therefore preferred that the yield strength or bending limit of the material of the disc-shaped side caps at a deflection f of the disc-shaped side caps at the outer edge of the side caps in the direction of the freely rotatable swing body is not exceeded.

The elastic limit of a material is the amount of mechanical stress below which the material is elastic, i.e. it returns to its original shape when the stress is removed (reversible deformation). If the elastic limit is exceeded, irreversible elongation or compression or plastic deformation occurs. The elasticity limit values are used in addition to other material parameters for calculating and determining the strength and stability of mechanical constructions.

Surprisingly, it was found that a lower acting compressive force must be applied to the outer edge of a disc-shaped side cap in order to bend or move a disc-shaped side cap at the outer edge by the distance between the swing body and the inner faces of the side caps, or by the distance $B_4$ or $B_5$, in order to to brake the rotating swing body or to fix the freely rotatable swing body in its position, the smaller the width of the disc-shaped side caps, the smaller the distance between the side caps and the freely rotatable swing body and the further the point of application of the acting pressure force is away from the centre of the disc-shaped side caps and the greater the difference between the outer diameter of the disc-shaped side caps and the outer diameter of the centred extensions. The diameter of the centred extensions on the inner face of the disc-shaped side caps therefore also plays an important role. For example, if the diameter of the centred extensions is assumed to be point-like, the distance between this point and the point of application of the acting compressive force, which in this approximation corresponds to the outer radius of the disc-shaped side caps, is included in the calculation of the acting force at the outer edge of a disc-shaped side cap of a given material. This means that for an acting compressive force at the outer edge of the disc-shaped side cap the length is between the centre and the distance at which the force effect as a point force is applied. In such an approximation, assuming that the centred extensions are point-like, the maximum length to the point of application of the acting compressive force is the length of the outer radius, i.e. half the diameter of the disc-shaped side caps. If the diameter of the centred extension is larger and, for example, has an outer diameter, e.g. corresponding to half the diameter of the disc-shaped side caps, i.e. the disc-shaped side caps have a 50% larger diameter, or have a diameter twice that of the centred extensions, then the length to the point of application of the acting compressive force corresponds to half the outer radius of the disc-shaped side caps. The skilled person in the art is aware that a greater force must be applied when bending a beam or a plate clamped on one side, the smaller the length of the beam or plate is. A unilaterally clamped beam or a unilaterally clamped plate can only be loaded with an acting compressive force at the unclamped end or side, so that bending takes place. In the rotatable play body according to the present invention, the disc-shaped side caps each have a centred extension on the inner faces, which are each suitable for engaging in the swing body, preferably for form-fit engaging in the swing body. The disc-shaped side caps are thus clamped centrally over the centred extensions and can be loaded with an acting compressive force at the unclamped outer edges, so that bending occurs. In contrast to tensile and compression tests, the bending stress generates a variable stress and strain in the body cross-section. Thus, a tensile stress occurs at the upper side of the disc-shaped side caps and a compressive stress at the lower side, to which the disc-shaped side cap responds with compression or strain of the outer fibres. The maximum strain is also called outer-fibre strain. Therefore, the outer-fibre strain E at the deflection f of the disc-shaped side caps at the outer edge of the disc-shaped side caps must be calculated. It is preferred that the outer-fibre strain ε is below the maximum permissible strain $\varepsilon_{perm}$.

That is, transferred to the rotatable play body according to the present invention, the larger the outer radius or diameter of the centred extensions, the greater is the acting compressive force that must be applied at the outer edge of the disc-shaped side caps in order to move or bend a disc-shaped side cap at the outer edge by a given deflection f. This means that the smaller the length, the greater the amount of acting compressive force, and the greater the acting compressive force, the more likely plastic deformation or breakage of the material will occur. In order that the disc-shaped side caps at the outer edge can be moved or deformed reversibly or elastically by a deflection f, the diameter of the disc-shaped side caps and the diameter of the centred extensions and thus also the diameter of the second central recess must be observed.

It is therefore preferred that the diameter of the disc-shaped side caps is at least twice the outer diameter of the centred extensions of the disc-shaped side caps. It is also preferred that the diameter of the disc-shaped side caps is at least one third larger than the diameter of the centred extensions of the disc-shaped side caps. It is also preferred that the diameter of the disc-shaped side caps is at least one third larger than the diameter of the second central recess of the swing body. It is therefore preferred that the diameter of the disc-shaped side caps is at least 50%, more preferably at least 40% and most preferably at least 30% larger than the diameter of the centred extensions of the disc-shaped side caps. It is also preferred that the diameter of the disc-shaped side caps is at least 50%, more preferably at least 40% and most preferably at least 30% larger than the diameter of the second central recess of the swing body. It is therefore preferred that the disc-shaped side caps have a diameter at least 1.5 times, more preferably at least 1.4 times and most preferably at least 1.3 times the diameter of the centred extensions of the disc-shaped side caps. It is also preferred that the disc-shaped side caps have a diameter at least 1.5 times, more preferably at least 1.4 times and most preferably at least 1.3 times greater than the diameter of the second central recess of the swing body.

A non-exhaustive overview of the material parameters modulus of elasticity (Young's modulus), yield stress and tensile strength for some materials such as metal alloys and polymers (plastics) is shown in Table 1. The skilled person in the art is aware that these values depend on the exact composition and properties of the respective material.

TABLE 1

Overview of elasticity modulus, yield stress and tensile strength of some materials

| Material | E-modulus [N/mm$^2$] at 20° C. | yield stress [N/mm$^2$] | tensile strength [N/mm$^2$] |
|---|---|---|---|
| Steel | 200000-216000 | 250-1155 | 345-1640 |
| Magnesium alloys | 42000-47000 | 70-400 | 185-475 |
| Aluminium alloys | 68000-82000 | 30-500 | 58-550 |
| Glass | 40000-110000 | | 22-177 |
| Wood (longitudinal) | 6000-20000 | 30-70 | 60-100 |
| Wood (transversal) | 500-3000 | 2-6 | 4-9 |
| Rubber (natural rubber) | 15-25 | 20-30 | 22-32 |
| Polypropylene (PP) | 900-1600 | 21-37 | 28-41 |
| Polymethyl methacrylate (PMMA) | 2200-3800 | 54-62 | 48-72 |
| Polyethylene (PE) | 600-900 | 18-29 | 21-45 |
| Polyethylene terephthalate (PET) | 2800-4100 | 57-62 | 48-72 |
| Polyvinyl chloride (PVC) | 2100-4100 | 35-52 | 41-65 |
| Polycarbonate | 2000-2440 | 59-70 | 60-72 |
| Nylon | 2600-3200 | 50-95 | 90-165 |
| Polyester | 2000-4400 | 33-40 | 41-90 |
| Teflon (PTFE) | 400-550 | 15-25 | 20-30 |
| Polyetheretherketone (PEEK) | 3500-4200 | 65-95 | 70-103 |
| Polystyrene | 2300-3300 | 29-56 | 36-57 |
| Polyoxymethylene (POM) | 2500-5000 | 49-72 | 60-90 |
| Polyurethane Thermoplastics | 1300-2100 | 40-54 | 31-62 |
| Polyurethane Thermosets | 2-3 | 25-51 | 25-51 |
| Cellulose polymers | 1600-2000 | 25-45 | 25-50 |
| acrylonitrile butadiene styrene copolymers (ABS) | 1100-2900 | 18-51 | 28-55 |
| Plastics (general) | approx. 400-7000 | | |

Thermoplastics are divided into amorphous and semi-crystalline polymers based on their structure. Plastics with an amorphous structure are usually transparent and tend to be susceptible to stress cracking. Semi-crystalline plastics are opaque and usually tough. Thermoplastics are further subdivided according to their temperature resistance: High-temperature plastics are suitable for a continuous operating temperature of over 150° C., construction plastics are permanently suitable at temperatures between 100° C. and 150° C. and have good mechanical properties, standard plastics such as polypropylene or polyethylene can be used permanently at temperatures below 100° C. The properties of the plastics can be adapted to the desired area of application by targeted incorporation of fillers, e.g. with reinforcing fibres such as glass fibres, with which mainly an increase in strength values is achieved, such as tensile strength in particular, but also other characteristic values such as compressive strength and heat deflection temperature. Carbon fibres can be used as an alternative to glass fibres to increase strength. By incorporating pigments and dyes it is possible to create individually tailored colour settings for engineering plastics. With the addition of UV or heat stabilizers, effects caused by environmental factors or continuous high heat loads can be reduced, which can lead to discoloration or impairment of the mechanical properties of many plastics.

In general, mechanical characteristic values are determined in the state of the art in a standardised or normed tensile test, which serve to assess the behaviour of plastics under short-term, uniaxial stress. In addition to the behaviour under stress and strain, the temperature and loading time are important for the selection of a plastic. The tensile stress $\sigma$ is the tensile force related to the smallest measured initial cross section of the test specimen at any given time during the test. The tensile strength $\sigma_B$ is the tensile stress at maximum force. The tensile strength $\sigma_R$ is the tensile stress at the moment of tearing. The yield stress $\sigma_S$ is the tensile stress at which the slope of the force-length change curve becomes zero for the first time. The strain $\varepsilon$ is the change in length $\Delta L$ related to the original gauge length $L_0$ of the specimen at any point in time of the test. The strain at maximum force is $\varepsilon_B$, the strain at break is ER and the strain at yield is $\varepsilon_S$. It should be noted that the modulus of elasticity E only has a linear curve in the lowest area of the stress-strain diagram for plastics. In this area, Hooke's law applies, which states that the quotient of stress and strain (modulus of elasticity) ($E=\sigma/\varepsilon$ in MPa or in $N/mm^2$) is constant.

In the following, with some simplifying approximations are shown the effects of the outer radius of the disc-shaped side caps, the outer radius of the centred extensions, the width of the disc-shaped side caps, the distance of the inner faces of the disc-shaped side caps to the freely rotatable swing body and the material from which the disc-shaped side caps are made on the acting compressive force by which the disc-shaped side caps at the outer edge are reversibly moved against the freely rotatable swing body in order to fix the freely rotatable swing body in its position. Although, for the sake of simplification, a unilaterally clamped beam or a plate clamped on one side is assumed in the following, a skilled person in the art knows how the relationships described in the following can be transferred to a disc-shaped side cap of the rotatable play body according to the present invention. Since approximations are made in the following for simplification, the physical formulae shown below and the resulting forces do not correspond to the absolute real forces which must be applied or can occur for a centrally clamped disc-shaped side cap which is moved at the outer edge of the disc-shaped side cap against the freely rotatable swing body in order to fix the freely rotatable swing body.

As an approximation, a beam or a plate clamped at one end is assumed which is deflected by a single load F. For the beam or plate having a constant cross-section the bending theory provides the bending or deflection f $$f=F\cdot L^3/3\cdot E\cdot I \quad \text{(I)}$$

with f=deflection, F=force, L=length of beam/plate, E=modulus of elasticity, I=area moment of inertia. The product of the modulus of elasticity E and the axial area moment of inertia I for the bending axis is bending stiffness E I. The acting compressive force to bend or move the unilaterally clamped beam or plate by a deflection f is therefore obtained by rearranging the above equation (I):

$$F=3f\cdot EI/L^3 \quad \text{(II)}$$

For a rectangular plate clamped on one side, the following equation (III) can be used for the area moment of inertia:

$$I=bh^3/12 \quad \text{(III)}$$

with I=area moment of inertia, b=diameter of the plate clamped on one side, h=width or height of the plate clamped on one side. After inserting equation (III) into equation (II) and assuming that the diameter is b=2r and L=r, where r is half the length of the plate representative of the outer radius of a disc-shaped side cap, and assuming that the centred extension is point-like and the outer radius of the centred extension is therefore negligibly small, equation (IV) is obtained:

$$F=0.5fEh^3/r^2 \quad \text{(IV)}$$

If the centred extension is not point-like and has an outer radius $r_f$, equation (V) results:

$$F=0.5fEh^3/(r-r_f)^3 \quad \text{(V)}$$

As an example, with a deflection f of 1 mm and a width of the plate of 1 mm, which is assumed to be representative of the width of the disc-shaped side cap, and a material with a modulus of elasticity of $E=4000\ N/mm^2$, such as a plastic material, an outer radius of a disc-shaped side cap of, for example, 14.5 mm will result approximately in an acting compressive force of F=9.5 N according to equation (IV). Assuming that the centred extension has an outer radius of 6 mm, equation (V) yields a force of F=47.2 N. If a 20% larger outer radius of a disc-shaped side cap is assumed, the acting compressive force according to equation (V) is approximately F=23.5 N. If the outer radius of a disc-shaped side cap is assumed to be 20% smaller, the acting compressive force is approximately the force F=132.1 N according to equation (V). Therefore, equation (V) is approximated by equation (VI), taking into account the variable x as an increase or decrease factor of the outer radius of the disc-shaped side cap:

$$F=0.5fExrh^3/(xr-r_f)^3 \quad \text{(VI)}$$

The exemplary calculated acting compressive forces shown above, which are necessary to move a disc-shaped side cap at the outer edge against a freely rotating swing body in order to fix the freely rotating swing body in its position, clearly demonstrate how sensitively the acting compressive force depends on the technical proportions of the rotating play body, such as the diameter, width, height and distances, as well as on the material characteristics. These example calculations clearly show how the amount of acting compressive force required to move a disc-shaped side cap at the outer edge against a freely rotating swing body increases when the outer radius of the centred extensions is increased or the outer radius of the disc-shaped side caps is reduced. It is obvious that the magnitude of the acting compressive force increases with a material with a higher modulus of elasticity. The magnitude of the acting compressive force also increases significantly when the distance between the disc-shaped side caps and the swing body increases, i.e. when the deflection f is increased. The permissible deflection f can be calculated as a function of the permissible strain $\varepsilon_{perm}$ of the material used. It is preferred that this permissible deflection f is not exceeded when the disc-shaped side caps are compressed. The permissible strain $\varepsilon_{perm}$ or stress $\sigma_{perm}$ for a single short-term deflection at 23° C. can be estimated using the following rule: almost the yield strain for semi-crystalline thermoplastics, approx. 70% of the yield strain for amorphous thermoplastics and approx. 50% of the strain at break for glass-fibre reinforced thermoplastics. In the case of frequent short-term use, it is recommended to assume approximately 60% of the one-time permissible values. In the case of long-term or continuous loads, there is a risk of stress cracking with amorphous materials. For amorphous materials it is known that at strains below approx. 0.5% the risk of stress cracking is significantly lower. The maximum outer fibre strain $\varepsilon_{perm}$ can also be calculated roughly. For brittle materials the approximate breaking strain $\varepsilon_{break}$=yield strain $\varepsilon_{yield}$ and thus $\varepsilon_{perm}=0.5\ \varepsilon_{break}$. For tough materials, the approximate breaking strain $\varepsilon_{break}$>2 yield strain $\varepsilon_{yield}$ and thus $\varepsilon_{perm}$=0.8 $\varepsilon_{yield}$. For a non-exhaustive and non-restrictive selection of some plastics, the permissible strains for short-term and long-term loads are given as guidelines (in %) in Table 2.

TABLE 2

Permissible elongations (in %) for short-term and long-term loading of some selected materials (plastics)

| Material | Permissible elongation [%] Short-term | Long-term |
|---|---|---|
| Acrylonitrile butadiene styrene copolymers (ABS) | 1.5-2.0 | 0.8 |
| Polycarbonate (PC) | 1.5-2.0 | 0.8 |
| Polymethyl methacrylate (PMMA) | 1.5-2.0 | 0.6 |
| Polystyrene (PS) | 1.0-1.5 | 0.6 |
| Polyvinyl chloride (PVC) | 1.5-2.0 | 0.8 |
| Styrene acrylnitrile copolymers (SAN) | 1.5-2.0 | 0.8 |
| Styrene Butadiene (SB) | 1.5-2.0 | 0.8 |
| Polyamide (PA) | 3.0-4.0 | 2.0 |
| Polybutylene terephthalate (PBT) | 4.0-5.0 | 2.0 |
| Polyethylene (strongly branched) (PE-LD) | 5.0-6.0 | 2.5 |
| Polyethylene (weakly branched) (PE-HD) | 4.0-5.0 | 2.0 |
| Polyoxymethylene (POM) | 4.0-5.0 | 2.0 |
| Polypropylene (PP) | 4.0-5.0 | 2.0 |

The deflection force can be calculated accordingly as a function of the geometric stiffness (cross-sectional design), the permissible strain and the material stiffness (E modulus). If the strains occurring are outside the proportional range of the stress-strain curve, the so-called "secant modulus $E_s$", the strain-dependent modulus of elasticity, should be used instead of the modulus of elasticity to determine the deflection force. The skilled person in the art knows how the strain-dependent modulus of elasticity can be determined from a stress-strain diagram for a given material, especially for a plastic. If a specimen is loaded in a uniaxial tensile test, different stress-strain curves result depending on the type of plastic. While amorphous thermoplastics (polystyrene, PMMA) show a comparatively brittle mechanical material behaviour, semi-crystalline thermoplastics (PE, PP) show a rather ductile, tough behaviour at room temperature. The reason here is that the amorphous thermoplastic is used at temperatures below the glass transition temperature. The material behaves hard-brittle here. The semi-crystalline thermoplastic, on the other hand, is used below the crystal melting temperature of the crystalline structures and above the glass transition temperature of its amorphous areas. While the crystalline regions provide the stiffness, the amorphous regions provide the ductile-tough elastic properties. Although plastics show a pronounced non-linear-viscoelastic behaviour and, when a certain load level is exceeded, also plastic strains, the approach of a linear-elastic material model can still be sufficient under short-term loading.

To determine the outer fibre strain ε the following equation (VII) can be used for a plate or beam clamped at one side and approximately for a disc-shaped side cap:

$$\varepsilon=3fh/2L^2 \quad \text{(VII)}$$

with f=deflection, L=length of the beam/plate, h=width or height of the plate clamped on one side. This results in a permissible deflection f at a permissible strain $\varepsilon_{perm}$ by rearranging equation (VII):

$$f=\varepsilon 2L^2/3h \quad \text{(VIII)}$$

Thus, for linear (visco)-elastic material models, the maximum permissible deflection can be approximately determined with equation (VIII) for a given permissible strain. This offers the possibility of estimating the permissible deflection in case of uncertainty in the knowledge of the correct material model or, as in a linear-elastic case, if the modulus of elasticity is not exactly known or if, for example, no stress-strain curve is available, since the strain is obtained purely geometrically with equation (VII) and is independent of the modulus of elasticity. If, however, a material model with irreversible effects is used (e.g. an elasto-plastic material model), locally irreversible effects occur depending on the stress.

For example, a rotating play ring made of a plastic can be provided, wherein the width or height of the disc-shaped side caps is 1 mm and wherein the difference between the outer radius of the disc-shaped side caps and the outer radius of the centred extensions is 10 mm. If the material from which the disc-shaped side caps are made has a permissible strain for short-term loads of e.g. 4.0%, equation (VIII) gives a permissible deflection of 2.7 mm and for long-term loads a permissible strain of e.g. 2.0%, equation (VIII) gives a permissible deflection of 1.3 mm. Thus for this example it would be particularly preferred that the maximum deflection, i.e. preferably a deflection in the region of the distance $B_4$ or $B_5$ between the inner faces of the disc-shaped side caps and the freely rotatable swing body, is less than or equal to 1.3 mm or is maximum 2.7 mm. With the above shown approximations the skilled person in the art is able to estimate which technical proportions of the diameters, the distances, the width and which material are suitable to provide a rotatable play body of the present invention, so that the disc-shaped side caps (K1) and (K2) at the outer edge (R1) and (R2) are movable against the freely rotatable swing body (S), in order to fix the freely rotatable swing body (S) in its position.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps are made of a plastic, preferably made of a thermoplastic, preferably made of a plastic selected from the group of acrylonitrile butadiene styrene copolymer (ABS), cellulose acetate (CA), ionomers, polyamides (PA), polycarbonates (PC), polyetheretherketone (PEEK), polyethylene (PE), polyethylene terephthalate (PET), polymethyl methacrylate (PMMA), polyoxymethylene (POM), polypropylene (PP), polystyrene (PS), polyurethane thermoplastics, polyvinyl chloride (PVC), Teflon (PTFE) or polybutylene terephthalate (PBT), more preferably made of a plastic with a permissible strain for short-term loads of at least 4.0% or with a permissible strain for long-term loads of at least 2.0% and particularly preferred made of polyoxymethylene.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the disc-shaped side caps (K1) and (K2) having a diameter in the range from 0.5 times to 1.2 times the outer diameter of the swing body (S), the disc-shaped side caps (K1) and (K2) being reversibly movable at the outer edge (R1) and (R2) against the freely rotatable swing body (S) by an acting compressive force, in order to fix the freely rotatable swing body (S) in its position, wherein the freely rotatable swing body (S) with the outer shell (M) is cylindrical and the outer cylindrical surface of the cylindrical swing body (S) is plane and printable, wherein the wall thickness (W) of the cylindrical outer shell (M) of the freely rotatable swing body (S) is constant, wherein the outer radius of the cylindrical outer shell (M) of the freely rotatable swing body (S) is constant, wherein the disc-shaped side caps are made of a plastic, preferably made of a thermoplastic, preferably a plastic selected from the group of acrylonitrile-butadiene-styrene copolymer (ABS), cellulose acetate (CA), ionomers, polyamides (PA), Polycarbonates (PC), polyetheretherketone (PEEK), polyethylene (PE), polyethylene terephthalate (PET), polymethyl methacrylate (PMMA), polyoxymethylene (POM), polypropylene (PP), polystyrene (PS), polyurethane thermoplastics, polyvinyl chloride (PVC), Teflon (PTFE) or polybutylene terephthalate (PBT), preferably made of a plastic with a permissible strain for short-term loads of at least 4.0% or are manufactured with a permissible strain for long-term loads of at least 2.0% and preferably made of polyoxymethylene. It is further preferred that the disc-shaped side caps (K1) and (K2) at the outer edge (R1) and (R2) are reversibly movable against the freely rotatable swing body (S) by an acting compressive force in the range from 5N to 100N in order to fix the freely rotatable swing body (S) in its position. It is further preferred that the distance ($B_0$) between the inner faces (I1, I2) of the opposite disc-shaped side caps (K1) and (K2) is greater than the width ($B_3$) of the swing body (S).

It is also preferred that the width of the centred ball bearing (L) is 0.50 to 0.95 times the width of the swing body (S). It is also preferred that the disc-shaped side caps (K1) and (K2) both have the same width. It is further preferred that the disc-shaped side caps (K1) and (K2) each have a width in the range of 0.1 to 0.2 times the width of the swing body (S). It is also preferred that the swing body (S) or the outer shell (M) of the swing body (S), as well as the opposite disc-shaped side caps (K1 and K2), have one or more printable outer face(s). It is further preferred that the first centred extension is suitable to engage in the second centred recess of the centred ball bearing and the second extension is suitable to engage in the second centred recess of the centred ball bearing and/or the first centred extension of the first disc-shaped side cap.

According to the invention, the disc-shaped side caps each have a centred extension on the respective inner side or inner face. The first disc-shaped side cap has a first centred extension on the inner face and the mutually opposite second disc-shaped side cap has a second centred extension on the inner face. The first centred extension is suitable to engage in the second central recess of the centred ball bearing and the second extension is suitable to engage in the second central recess of the centred ball bearing and/or the first centred extension of the first disc-shaped side cap.

In a preferred embodiment according to the invention the first centred extension of the first disc-shaped side cap can engage by form-fit into the second central recess of the centred ball bearing and the second centred extension of the second disc-shaped side cap can engage by form-fit into the first centred extension of the first disc-shaped side cap located in the second central recess of the centred ball bearing.

In a preferred embodiment according to the invention, the inner faces of the disc-shaped side caps exhibit a distance $B_0$ to each other. In this embodiment, it is preferred that the length $B_1$ of the first centred extension of the first disc-shaped side cap is at most the length $B_0$. In this embodiment, it is also preferred that the length $B_2$ of the second centred extension of the second disc-shaped side cap is at most the length $B_0$ and that the second centred extension of the second disc-shaped side cap can engage by form-fit in the first centred extension of the first disc-shaped side cap located in the second central recess of the centred ball bearing. It is further preferred that the first centred extension of the first disc-shaped side cap in this preferred embodiment has a central recess with a maximum depth $B_0$ and with a certain diameter, so that the second centred extension with an outer diameter corresponding to the diameter of the central recess of the first centred extension and a maximum length $B_0$ can engage by form-fit in the central recess of the first centred extension up to the corresponding depth $B_0$.

In another preferred embodiment, the distance $B_0$ is preferably composed of the width $B_3$ of the swing body or the width $B_3$ of the outer shell of the swing body and the sum of the respective distances $B_4$ and $B_5$ between the swing body and the corresponding inner faces of the corresponding disc-shaped side caps. In this embodiment, it is particularly preferred when the centred ball bearing has a width equal to the width of the outer shell of the swing body. In other words, the total length $B_0$ in this embodiment is preferably composed of the sum of the distance $B_4$ of the swing body to the inner face of the first disc-shaped side cap, the distance $B_5$ of the swing body to the inner face of the second disc-shaped side cap and the width $B_3$ of the swing body, and thus it is preferred that $B_0=B_3+B_4+B_5$. In order that the second centred extension of the second disc-shaped side cap can engage exclusively in the first centred extension of the first disc-shaped side cap located in the second central recess of the centred ball bearing, the first centred extension of the first disc-shaped side cap preferably has a length $B_1$ which is composed at least of the sum of the distance $B_4$ of the inner face of the first disc-shaped side cap to the swing body and the width of the swing body $B_3$. Thus, in an embodiment it is preferred that the length $B_1$ of the first centred extension is between ($B_3+B_4$) and $B_0$. It is particularly preferred when the first centred extension has a length of $B_1=B_3+B_4$ and can thus engage by form-fit in the second central recess of the centred ball bearing up to a depth $T_1$, which corresponds to the width $B_3$ of the swing body. The first centred extension of the first disc-shaped side cap with, for example, the length $B_1=B_3+B_4$ preferably has in the length region $B_3$, i.e. the width of the swing body, an outer diameter which corresponds to the diameter of the second central recess, so that this part of the first centred extension can engage form-closed in the second central recess of the centred ball bearing.

However, in some preferred embodiments, the width of the centred ball bearing may be smaller or larger than the width of the outer shell of the swing body. In some preferred embodiments, it is further preferred if the centred ball bearing is centrally engaged by form-fit in the first central recess of the swing body, i.e. if the centred ball bearing has, for example, a smaller width than the outer shell of the swing body, the difference in width between the outer shell of the swing body and the centred ball bearing is preferably the same on both sides. Preferably, the difference in width U will be the difference between half the width of the swing body and half the width of the centred ball bearing. In these embodiments, it is then preferred that the centred ball bearing has the same difference in width on both sides to the outer shell of the swing body, i.e. the difference in width U1=U2. If the width of the centred ball bearing is $B_6$, it is preferred in these embodiments that $B_3=B_6+U_1+U_2$ and further preferred is $B_3=B_6+2U1$ if $U_1=U_2$.

When, as in some preferred embodiments, the centred ball bearing has a width $B_6$ less than the width $B_3$ of the outer shell of the swing body and the first centred extension of the first disc-shaped side cap is capable of form-fit engaging in the second central recess of the centred ball bearing and the second centred extension of the second disc-shaped side cap is capable of form-fit engaging in the first centred extension of the first disc-shaped side cap located in the second central recess of the centred ball bearing, it is preferred in these embodiments that the length $B_1$ of the first centred extension is preferably between $(B_4+B_6+U_1)$ and $B_0$ and that the first centred extension can preferably engage in the second central recess of the ball bearing at least to a depth $T_1$, which corresponds to the width $B_6$ of the centred ball bearing. However, in some preferred embodiments it may also be preferred that the first centred extension of the first side cap cannot engage in the second central recess of the ball bearing to a depth $T_1$ corresponding to the width $B_6$ of the centred ball bearing, so that in these embodiments it is preferred that, for example, in the case of $B_3=B_6$, the length $B_1$ of the first centred extension of the first disc-shaped side cap is preferably in the range between the distance $B_4$ and the sum of the distance $B_4$ and the width $B_3$ of the swing body and it is preferred that $B_4$ is $<B_1<B_3+B_4$ or that, in the case of $B_3>B_6$, the length $B_1$ of the first centred extension of the first disc-shaped side cap is preferably in the range between the sum of the distance $B_4$ and the difference in width $U_1$ and the sum of the distance $B_4$, the difference in width $U_1$ and the width $B_6$ of the centred ball bearing and is preferred that $B_4+U_1$ is $<B_1<B_6+B_4+U_1$, or that, in the case of $B_3<B_6$, the length $B_1$ of the first centred extension of the first disc-shaped side cap is preferably less than the sum of the distance $B_4$ and the width $B_6$ of the centred ball bearing, and it is preferred that $B_1$ is $<B_6+B_4$. In another embodiment, for example, the width $B_6$ of the centred ball bearing can correspond to the distance $B_0$ of the opposite disc-shaped side caps, so that $B_1$ is preferably $<B_6+B_4$. In another preferred embodiment, the width $B_6$ of the centred ball bearing can preferably be in the range between the distance $B_0$ and the width $B_3$ of the outer shell of the swing body. In these embodiments, the length $B_1$ of the first centred extension is at least as long as the distance $B_4$ between the inner face of the first disc-shaped side cap and the centred ball bearing. In some other embodiments, the same applies to the second centred extension of the second disc-shaped side cap as described for the first centred extension. In some preferred embodiments, the centred ball bearing may also preferably have a width greater than the width of the outer shell of the swing body. Preferably, the difference in width U between the width of the centred ball bearing and the width of the swing body on each side is the difference between half the width of the swing body and half the width of the centred ball bearing. In these embodiments it is then preferred that the centred ball bearing on both sides has the same difference in width to the outer shell of the swing body, i.e. the difference in width $U_1=U_2$. If the width of the centred ball bearing is $B_6$, it is preferred in these embodiments that $B_6=B_3+U_1+U_2$ and further preferred is $B_6=B_3+2U_1$ if $U_1=U_2$.

When, as in some preferred embodiments, the centred ball bearing has a width $B_6$ greater than the width $B_3$ of the outer shell of the swing body and the first centred extension of the first disc-shaped side cap is capable of form-fit engaging in the second central recess of the centred ball bearing and the second centred extension of the second disc-shaped side cap is capable of form-fit engaging in the first centred extension of the first disc-shaped side cap located in the second central recess of the centred ball bearing, it is preferred in these embodiments that the first centred extension can preferably engage in the second centred recess of the ball bearing up to a depth $T_1$, which results from the width $B_6$ of the centred ball bearing and is therefore preferably $T_1=B_6$. In the preferred embodiments described above, the first centred extension of the first disc-shaped side cap preferably has a central recess in which the second centred extension of the second disc-shaped side cap can be engaged by form-fit. The central recess of the first centred extension has a depth $T_2$ in which the second centred extension can engage up to a maximum depth $T_2$. For the embodiments described above, it is preferred that the central recess of the first centred extension has a maximum depth $T_2$ that corresponds to the length $B_1$ of the first centred extension of the first disc-shaped side cap.

So that the second centred extension can engage by form-fit in the first centred extension, the first centred extension is, for example, in the form of a hollow cylinder which has a circular central recess of the first centred extension with a certain diameter. The second centred extension has accordingly preferably an outer diameter which corresponds to the diameter of the central recess of the first centred extension, so that it can engage by form-fit in the first centred extension. The central recess of the first extension of the first disc-shaped side cap may have different depths and the second centred extension of the second disc-shaped side cap may have different lengths. In some embodiments, it is preferred that the depth $T_2$ of the central recess of the first centred extension of the first disc-shaped side cap preferably corresponds to the width $B_3$ of the swing body, when as in some embodiments, as preferred, the width $B_6$ of the centred ball bearing corresponds to the width $B_3$ of the outer shell of the swing body and the length $B_1$ of the first centred extension is preferably $B_1=B_3+B_4$, so that accordingly the second centred extension of the second disc-shaped side cap can engage, to a depth $T_3$ corresponding to the width $B_3$ of the swing body, the first centred extension of the first disc-shaped side cap located in the second central recess of the centred ball bearing. It is particularly preferred when the central recess of the first centred extension of the first disc-shaped side cap has a defined depth $T_2$ and the second centred extension of the second disc-shaped side cap has a defined length $B_2$, such that when the first centred extension of the first disc-shaped side cap is engaged by form-fit in the second central recess of the ball bearing and the second centred extension of the second disc-shaped side cap is engaged by form-fit in the first centred extension of the first disc-shaped side cap located in the second central recess of the centred ball bearing, in that the distance of the inner faces of the opposite side caps is $B_0$ wherein $B_0=B_3+B_4+B_5$. In a preferred embodiment, a swing body of width $B_3$ is provided, the swing body having the distance $B_4$ to the inner face of the first disc-shaped side cap and the swing body having the distance $B_5$ to the inner face of the second disc-shaped side cap. Preferably the first centred extension in this exemplary embodiment has the length $B_1=B_3+B_4$, which is composed of the width $B_3$ of the swing body and the distance $B_4$ of the swing body to the inner face of the first disc-shaped side cap. Preferably, the first centred extension in this exemplary embodiment can preferably engage in the second central recess of the centred ball bearing up to a depth $T_1$, which corresponds to the width $B_3$ of the swing body. In this example, the first centred extension also has a central recess with a depth $T_2$, in which the second centred extension can engage by form-fit. In this example, the depth $T_2$ of the central recess of the first centred extension is preferably equal to the depth $T_3$ up to which the second centred extension can engage in the central recess of the first centred extension, which also preferably corresponds to the width $B_3$ of the swing body. In this preferred exemplary embodiment, the second centred extension has at least a length $B_2$ corresponding to the width $B_3$ of the swing body, so that the second centred extension can preferably engage by form-fit in the first centred extension of the first disc-shaped side cap located in the second central recess of the centred ball bearing to a depth $T_3$ corresponding to the width $B_3$ of the swing body. The swing body in this exemplary embodiment also has a distance $B_5$ to the inner face of the second disc-shaped side cap. Thus, in this exemplary embodiment, the length $B_2$ of the second centred extension is preferably the sum of the depth $T_3$, which in this example corresponds to the width $B_3$ of the swing body, and the distance $B_5$ and is therefore $B_2=B_3+B_5$. It is also preferred that after the second centred extension of the second disc-shaped side cap has engaged to a depth $T_3$ in the first centred extension of the first disc-shaped side cap located in the second central recess of the centred ball bearing, the distance between the inner faces of the two opposite disc-shaped side caps is $B_0$ and preferably $B_0=B_3+B_4+B_5$. This preferably means that the sum of the length $B_1$ of the first centred extension of the first disc-shaped side cap and the difference of the length $B_2$ of the second centred extension of the second disc-shaped side cap and the depth $T_3$ with which the second centred extension engages in the central recess of the first centred extension preferably corresponds to $B_0$ and preferably is further $B_0=B_3+B_4+B_5=B_1+(B_2-T_3)=B_1+B_5$.

The embodiment described above only represents an exemplary embodiment. For example, the first centred extension of the first disc-shaped side cap can also have a length $B_1$, which is longer than the previously described length of $B_1=B_3+B_4$. The central recess of the first centred extension of the first disc-shaped side cap can also have different depths than that of the depth $T_1$, which corresponds to the width $B_3$ of the swing body. In a preferred embodiment, the first centred extension may have a central recess with, for example, a depth $T_2$ corresponding to the length $B_1$ of the first centred extension. In this preferred embodiment, the second centred extension has a length $B_2$ of at least the depth $T_3$, which corresponds to the length $B_1$ of the first centred extension, so that the second centred extension of the second disc-shaped side cap can be engaged by form-fit in the first centred extension of the first disc-shaped side cap located in the second central recess of the centred ball bearing up to a depth $T_3=B_1$. The length of the second centred extension which can be engaged in the central recess of the first centred extension is preferably composed of the length $B_5$ which corresponds to the distance $B_5$ of the swing body to the inner face of the second disc-shaped side cap and the part of the second centred extension which can be engaged by form-fit in the central recess of the first centred extension of the first disc-shaped side cap up to a depth $T_3$. In a preferred embodiment, the depth $T_2$ of the central recess of the first centred extension of the first disc-shaped side cap can also be deeper than the length $T_3$ of the part of the second centred extension which can be engaged by form-fit in the central recess of the first centred extension of the first disc-shaped side cap up to a depth $T_3$. The depth $T_2$ of the central recess of the first centred extension has particularly preferably at least the length $T_3$ of the part of the second centred extension, which can be form-fitted into the central recess of the first centred extension up to a depth $T_3$. In other words, it is particularly preferred that the part of the second centred extension which can engage in the central recess of the first centred extension is fully engaged in the length $T_3$ of this part of the second centred extension, so that $B_0=B_3+B_4+B_5$ is preferred for the distance of the opposite disc-shaped side caps.

In some embodiments, the width of the centred ball bearing as described above can preferably be equal to, smaller or larger than the width of the outer shell of the swing body. In some other embodiments, it is still preferred that the length $B_1$ of the first centred extension is preferably $B_4<B_1<B_3+B_4$ in the case of $B_3=B_6$, is still preferred $B_4<B_1<B_6+B_4+U_1$ in the case of $B_3>B_6$ and is still preferred $B_4<B_1<B_6+B_4$ in the case of $B_3<B_6$. In these embodiments, it is further preferred that the first centred extension of the first disc-shaped side cap has a central recess with a depth $T_2$, wherein preferably the depth $T_2$ corresponds at most to the length $B_1$ of the first centred extension. The second centred extension of the second disc-shaped side cap in these embodiments preferably has a maximum length $B_2$, which is composed of the depth $T_3=T_2$ and the difference $B_7$ of the distance $B_0$ and the length $B_1$ of the first extension, and thus the length $B_2$ of the second centred extension is preferably maximum $B_2=T_2+B_7$. In these embodiments, it is further preferred that the second centred extension in length $T_3$ has an outer diameter which corresponds to the diameter of the central recess of the first centred extension, so that this part of the second centred extension can engage by form-fit in the central recess of the first centred extension. The part of the second centred extension of length $B_7$ may have the same outer diameter as the part of length $T_3$ in some preferred embodiments the part of the second centred extension of length $B_7$ may also have different outer diameters. In these embodiments, it is particularly preferred that the part of the second centred extension of length $B_7$ is located at the inner face of the second centred extension. However, since in the preferred embodiments described above it is preferred that the second centred extension of the second disc-shaped side cap engages by form-fit in the first centred extension of the first disc-shaped side cap located in the second central recess of the centred ball bearing and preferably does not engage by form-fit in the second central recess of the centred ball bearing, it is particularly preferred that the outer diameter of the part of the second centred extension with the length $B_7$ is smaller than the diameter of the second central recess of the centred ball bearing.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first centred extension of the first disc-shaped side cap engages by form-fit in the second central recess of the centred ball bearing and the second centred extension of the second disc-shaped side cap engages by form-fit in the first centred extension of the first disc-shaped side cap located in the second central recess of the centred ball bearing.

Thus, the present invention also relates a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the first centred extension of the first disc-shaped side cap engages by form-fit in the second central recess of the centred ball bearing and the second centred extension of the second disc-shaped side cap engages by form-fit in the first centred extension of the first disc-shaped side cap located in the second central recess of the centred ball bearing.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first centred extension of the first disc-shaped side cap engages by form-fit into the second central recess of the ball bearing to a depth ($T_1$) corresponding to the width of the swing body, and the second centred extension of the second disc-shaped side cap engages by form-fit into the first centred extension of the first side cap located in the second central recess of the ball bearing to a depth ($T_3$) corresponding to the width of the swing body.

The centred extensions of the two opposite side caps described above in the exemplary embodiments can also have different external shapes. In this way, the first centred extension of the first disc-shaped side cap or the second centred extension of the second disc-shaped side cap may be cylindrical or have a triangular, rectangular, pentagonal, hexagonal, heptagonal, octagonal or polygonal shape, wherein the triangular, rectangular, pentagonal, hexagonal, heptagonal, octagonal or polygonal shape has preferably the shape of a regular polygon with 5 to 10 corners, more preferably with 6 to 8 corners. Furthermore, the central recess of the first centred extension of the first disc-shaped side cap can preferably have different shapes. In a preferred embodiment, the central recess of the first centred extension of the first disc-shaped side cap may be cylindrical or have a triangular, rectangular, pentagonal, hexagonal, heptagonal, octagonal or polygonal shape, the triangular, rectangular, pentagonal, hexagonal, heptagonal, octagonal or polygonal shape preferably having the shape of a regular polygon with 5 to 10 corners, more preferably with 6 to 8 corners. It is preferred when the outer shape of the first centred extension of the first disc-shaped side cap corresponds to the shape of the second central recess of the ball bearing. In an exemplary embodiment, the second central recess of the ball bearing can be cylindrical, for example. In this exemplary embodiment, it is therefore preferred that the outer shape of the first centred extension of the first disc-shaped side cap is also cylindrical. The exemplary cylindrical first centred extension of the first disc-shaped side cap preferably has also an outer diameter which corresponds to the diameter of the cylindrical second central recess of the centred ball bearing, so that the cylindrical first centred extension can be engaged by form-fit in the cylindrical second central recess of the centred ball bearing. In a further preferred embodiment, the first centred extension has, for example, a cylindrical central recess with a depth $T_2$, in which case it is preferred that the second centred extension of the second disc-shaped side cap is also cylindrical, so that it can be form-fitted into the central recess of the first centred extension to a depth $T_3$, and in which case it preferably has an external diameter which corresponds to the diameter of the central recess of the first centred extension. In other embodiments, the first centred extension of the first disc-shaped side cap, the second centred extension of the second disc-shaped side cap, as well as the central recess of the first centred extension can have different shapes. In a preferred embodiment, the second central recess of the ball bearing may be cylindrical, for example, the first centred extension of the first disc-shaped side caps may preferably have the shape of a regular hexagon, preferably the outer diameter of the first centred extension, i.e. twice the radius of the circle passing through the corners of the regular hexagon preferably corresponds to the diameter of the second central recess of the centred ball bearing, so that engagement by form-fit of the first centred extension of the first disc-shaped side cap in the second central recess of the centred ball bearing is possible. Any conceivable combination of the different outer shapes of the first centred extension of the first disc-shaped side cap, the second centred extension of the second disc-shaped side cap, as well as the central recess of the first centred side cap can be considered according to the invention, wherein preferably the outer diameter of the first centred extension of the first disc-shaped side cap corresponds to the diameter of the second central recess of the centred ball bearing, so that engagement by form-fit of the first centred extension in the second central recess of the centred ball bearing is possible and wherein preferably the outer diameter of the second centred extension of the second disc-shaped side cap corresponds to the diameter of the central recess of the first centred extension, so that engaging by form-fit of the second centred extension of the second disc-shaped side cap in the first centred extension of the first disc-shaped side cap located in the second central recess of the centred ball bearing is possible.

In a preferred embodiment, the first centred extension of the first disc-shaped side cap can engage by form-fit in the second central recess of the centred ball bearing and the second centred extension of the second disc-shaped side cap can engage by form-fit in the second central recess of the centred ball bearing as well as the first centred extension of the first disc-shaped side cap located in the second central recess of the centred ball bearing.

In some preferred embodiments, the inner faces of the disc-shaped side caps have a distance $B_0$ to each other and preferably an outer shell with a width $B_3$ and a centred ball bearing with a width $B_6$. In a preferred embodiment, the width $B_3$ of the outer shell of the swing body corresponds to the width $B_6$ of the centred ball bearing and it is further preferred that the length $B_1$ of the first centred extension of the first disc-shaped side cap is smaller than the sum of the length of the distance $B_4$ of the swing body to the inner face of the first disc-shaped side cap and the width $B_3$ of the swing body and thus preferably $B_1<B_3+B_4$. It is also preferred that the length $B_1$ of the first centred extension of the first disc-shaped side cap is greater than the distance $B_4$ of the swing body to the inner face of the first disc-shaped side cap and therefore preferably $B_1>B_4$. It is also preferred that $B_4<B_1<B_3+B_4$ applies. It is also preferred that the first centred extension of the first disc-shaped side cap does not engage in the second centred recess of the centred ball bearing in the total length $B_1$. It is preferred that the first centred extension can be engaged by form-fit in the second central recess of the ball bearing to a depth $T_1$, which is composed of the difference $D_1$ which is subtracted from the width $B_3$ of the swing body, the difference $D_1$ is composed of the length $B_1$ of the first centred extension and the sum of the width $B_3$ of the swing body and the distance $B_4$ of the swing body from the inner face of the first disc-shaped side cap and is therefore preferably the difference $D_1=(B_3+B_4)-B_1$. Thus it follows that the depth $T_1$ is preferably $T_1=B_3-D_1$ and thus the first centred extension of the first disc-shaped side cap preferably engages in the second central recess of the centred ball bearing up to a depth $T_1=B_3-D_1$. The first centred extension preferably still has a central recess with a depth $T_2$. In a preferred embodiment, the depth $T_2$ corresponds at most to the length $B_1$ of the first centred extension. However, the depth $T_2$ can also be smaller than the length $B_1$ of the first centred extension and the length of the depth $T_2$ is preferably greater than zero and is between zero and the length $B_1$ of the first centred extension. In a preferred embodiment, the depth $T_2$ of the central recess of the first centred extension corresponds to half the width $B_3$ of the swing body and therefore in this embodiment it is preferred that $T_2=\frac{1}{2}B_3$.

In a preferred embodiment, the length $B_2$ of the second side cap is composed of a part which can be engaged by form-fit in the central recess of the first centred extension of the first disc-shaped side cap to a depth $T_3$ and of a part of length $B_7$ which can be engaged by form-fit in the second central recess of the centred ball bearing to a depth $T_4$. The part with the length $B_7$ of the second centred extension is preferably composed of the distance $B_5$ of the swing ring to the inner face of the second disc-shaped side cap and the depth $T_4$, so that preferably $B_7=T_4+B_5$. This is especially preferred in embodiments, wherein the width $B_3$ of the outer shell of the swing body corresponds to the width $B_6$ of the centred ball bearing. In these embodiments, it is preferred that the length $B_7$ of the second centred extension of the second disc-shaped side cap is smaller than the sum of the length of the distance $B_5$ of the swing body to the inner face of the second disc-shaped side cap and the width $B_3$ of the swing body and is therefore preferably $B_7<B_3+B_5$. It is also preferred that the part with the length $B_7$ of the first centred extension of the first disc-shaped side cap is larger than the distance $B_5$ of the swing body to the inner face of the second disc-shaped side cap and thus preferably $B_7>B_5$. It is also preferred that $B_5<B_7<B_3+B_5$ applies. It is also preferred that the second centred extension of the second disc-shaped side cap does not engage in the second central recess of the centred ball bearing in the total length $B_7$. It is preferred that the second centred extension can be engaged by form-fit up to a depth $T_4$ in the second central recess of the ball bearing, which is composed of the difference $D_2$ which is subtracted from the width $B_3$ of the swing body, difference $D_2$ is composed of the length $B_7$ of the second centred extension and the sum of the width $B_3$ of the swing body and the distance $B_5$ of the swing body to the inner face of the second disc-shaped side cap and is therefore preferably the difference $D_2=(B_3+B_5)-B_7$. Thus it follows that the depth $T_4$ is preferably $T_4=B_3-D_2$ and thus the second centred extension of the second disc-shaped side cap preferably engages in the second central recess of the centred ball bearing up to a depth $T_4=B_3-D_2$. In a preferred embodiment, the sum of the differences $D_1$ and $D_2$ is preferably $B_3$, so that $B_3=D_1+D_2$ or $B_3=T_1+T_4$. In another preferred embodiment, $D_1=D_2$ and thus $D_1=D_2=\frac{1}{2}B_3$. Thus, it is preferred that the second centred extension of the second disc-shaped side cap can engage by form-fit in the second central recess of the centred ball bearing up to a depth $T_4$, which corresponds to half the width of the swing body. In another preferred embodiment, the sum of the length $B_1$ of the first centred extension and the length $B_7$ of the second centred extension is preferred $B_0$ and thus it is preferred that $B_0=B_3+B_4+B_5=B_1+(B_2-T_4)=B_1+B_7$. In another preferred embodiment, the sum of the differences $D_1$ and $D_2$ is preferably $B_3$, so that $B_3=D_1+D_2$ or $B_3=T_1+T_4$, wherein, for example, $D_1$ is not equal to $D_2$ or $T_1$ is not equal to $T_4$. In an exemplary embodiment, the first centred extension of the first disc-shaped side cap can, for example, be engaged by form-fit into the second central recess of the centred ball bearing up to a depth $T_1$, which is greater than half the width of the swing body. In this exemplary embodiment, the second centred extension of the second disc-shaped side cap can preferably engage in the second central recess of the centred ball bearing up to a depth $T_4$, wherein the depth $T_4$ is preferably composed of the difference of the width $B_3$ of the swing body and the depth $T_1$, with which the first centred extension engages in the second central recess of the centred ball bearing, so that $T_4=B_3-T_1=D_1$. In another preferred embodiment, depth $T_1$ and depth $T_4$ can also be smaller in sum and the corresponding sum of the differences $D_1=D_2$ can also be greater than $B_3$, so that $T_1+T_4<B_3<D_1+D_2$ is preferred. In a preferred exemplary embodiment, the first centred extension of the first disc-shaped side cap engages the second central recess of the centred ball bearing, for example to a depth $T_1$ which is less than half the width of the swing body, and the second centred extension of the second disc-shaped side cap engages the second central recess of the centred ball bearing, for example to a depth $T_4$ which is also less than half the width of the swing body. In this exemplary embodiment, the two centred extension of the disc-shaped side caps, each set into the second central recess of the centred ball bearing on one side of the swing body, have a gap or distance with a difference $D_3$ to each other. The difference $D_3$ is preferably composed of the difference of the width $B_3$ of the swing body and the sum of the depth $T_1$ and the depth $T_4$, so that preferably $D_3=B_3-(T_1+T_4)$ and further preferably $B_3=D_3+T_1+T_4$. In another preferred embodiment, the first centred extension of the first disc-shaped side cap engages in the second central recess of the centred ball bearing, for example, up to a depth $T_1$, which is greater than half the width of the swing body, wherein, as described above, it is preferred, that when the second centred extension of the second disc-shaped side cap can engage in the second centred recess of the centred ball bearing at most up to a depth $T_4$, that the depth $T_4$ can have at most the length of the difference $D_1$, since preferably $T_1=B_3-D_1$ and therefore $B_3=T_1+D_1$ is valid, and furthermore preferably $B_3=T_1+T_4$. In a preferred embodiment, the second centred extension can also, for example, engage in the second central recess of the centred ball bearing up to a depth $T_4$, which is smaller than the difference $D_1$, wherein it is preferred that $B_3=T_1+T_4+D_3$. Any combination of different lengths $B_1$ of the first centred extension and different lengths $B_7$ of the second centred extension can be selected in accordance with the invention, it is preferred that the sum of the length $B_1$ of the first centred extension and the part of the length $B_7$ of the second centred extension is at most $B_0=B_3+B_4+B_5=B_1+(B_2-T_4)=B_1+B_7$ and preferably $B_4<B_1<B_3+B_4$ and $B_5<B_7<B_3+B_5$.

In some embodiments it may also be preferred if the width $B_6$ of the centred ball bearing is smaller or larger than the width $B_3$ of the swing body or the outer shell of the swing body. In some preferred embodiments, the width $B_6$ of the centred ball bearing is smaller than the width $B_3$ of the swing body or the outer shell of the swing body. In these preferred embodiments, wherein the centred ball bearing has a smaller width $B_6$ than the width $B_3$ of the outer shell of the swing body and the first centred extension of the first disc-shaped side cap can engage by form-fit in the second central recess of the centred ball bearing and the second centred extension of the second disc-shaped side cap can engage by form-fit in the second central recess of the centred ball bearing as well as in the first centred extension of the first disc-shaped side cap, it is preferred, that the length $B_1$ of the first centred extension is preferably between the distance $B_4+U_1$ and the sum of $B_4+B_6+U_1$, wherein $U_1$ is the first difference in width between the width of the outer shell of the swing body and the width of the centred ball bearing, and wherein the first centred extension can preferably engage at least up to a depth $T_1$ in the second central recess of the ball bearing, which is smaller than the width $B_6$ of the centred ball bearing, so that in these embodiments it is preferred that $B_4+U_1$ is $<B_1<B_6+B_4+U_1$ and $T_1<B_6$. Furthermore, in these embodiments it is preferred if the length $B_7$ of the part of the second extension which can engage by form-fit in the second central recess to a depth $T_4$ and which is preferably smaller than the width $B_6$ of the centred ball bearing is preferably between the distance $B_5+U_2$ and the sum of $B_5+B_6+U_2$, where $U_2$ is the second difference in width of the width $B_3$ of the outer shell of the swing body and the width $B_6$ of the centred ball bearing.

In some preferred embodiments the width $B_6$ of the centred ball bearing is larger than the width $B_3$ of the outer shell of the swing body. In these preferred embodiments, the centred ball bearing having a width $B_6$ greater than the width $B_3$ of the outer shell of the swing body, the first centred extension of the first disc-shaped side cap can engage by form-fit in the second central recess of the centred ball bearing and the second centred extension of the second disc-shaped side cap can engage by form-fit in the second central recess of the centred ball bearing as well as in the first centred extension of the first disc-shaped side cap, it is preferred that the length $B_1$ of the first centred extension or the length $B_7$ of the part of the second centred extension adjacent to the inner face is preferably smaller than the distance $B_0$ between the opposite side caps and preferably $B_1+B_7=B_0$. In these embodiments, it is also preferred that the first centred extension can be engaged by form-fit in the second central recess of the centred ball bearing with a depth $T_1$, which corresponds maximum to the length $B_1$, and the second centred extension can be engaged by form-fit in the second central recess of the centred ball bearing to a depth $T_4$, which corresponds maximum to the length $B_2$. In those embodiments where $T_1=B_1$ and $T_4=B_2$ is preferred, it is preferred that the width $B_6$ of the centred ball bearing corresponds to the distance $B_0$ of the opposite disc-shaped side caps. In these embodiments it is particularly preferred that, for example, only the inner ring of the centred ball bearing has the width $B_0$, whereas the outer ring of the centred ball bearing preferably has a smaller width than $B_0$, so that the free rotation of the swing body cannot be restricted or prevented.

In another preferred embodiment, the length $B_2$ of the second centred extension of the second disc-shaped side cap is further composed of a part with the length $T_3$, which can be engaged by form-fit in the central recess of the first centred extension of the first disc-shaped side cap to a depth $T_3$, and of a part with the length $B_7$, which can engaged by form-fit in the second central recess of the centred ball bearing to a depth $T_4$ and is therefore $B_2=T_3+B_7$. The part with the length $T_3$, which can be engaged by form-fit in the central recess of the first centred extension of the first disc-shaped side cap up to a depth $T_3$, preferably has an outer diameter which corresponds to the diameter of the central recess of the first centred extension, so that this part with the length $T_3$ of the second centred extension can be engaged by form-fit in the central recess of the first centred extension.

In a preferred embodiment, the first centred extension of the first disc-shaped side cap, for example, has a length $B_1$, so that it can be engaged by form-fit in the second central recess of the centred ball bearing up to a depth $T_1$, which corresponds to half the width of the swing body, furthermore, the second centred extension of the second disc-shaped side cap has, for example, a part with the length $B_7$ as described above, which can be engaged by form-fit in the second central recess of the centred ball bearing on the opposite side of the swing body up to a depth $T_4$, which corresponds to half the width of the swing body. Thus both the first centred extension as well as the second centred extension engages in the second central recess of the centred ball bearing up to a depth T, which corresponds to half the width of the swing body. As already described above, in a preferred embodiment, the first centred extension of the first disc-shaped side cap may have a central recess with a depth $T_2$ which corresponds at most to the length $B_1$ of the first centred extension. In a preferred embodiment, the second centred extension of the second disc-shaped side cap has a part of length $T_3$ which can be engaged by form-fit in the central recess of the first centred extension, the maximum length $T_3$ of this part of the second centred extension preferably corresponding at most to the depth $T_2$ of the central recess of the first centred extension. The length $T_3$ of this part of the second centred extension may also be smaller than the length of the depth $T_2$ of the central recess of the first centred extension. As already described above, in some preferred embodiments, the first centred extension of the first disc-shaped side cap can, for example, engage in the second central recess of the centred ball bearing up to a depth $T_1$, which is less than half the width of the swing body, and the second centred extension of the second disc-shaped side cap can, for example, engage in the second central recess of the centred ball bearing up to a depth $T_4$, which is also less than half the width of the swing body. In these preferred embodiments, the centred extensions form-fitted into the second central recess of the centred ball bearing have a difference $D_3$ to each other. In this embodiment, the first centred extension of the first disc-shaped side cap has a central recess with a depth $T_2$ which corresponds at most to the length $B_1$ of the first centred extension. The second centred extension has a part with the length $T_3$, which can be form-fitted into the central recess of the first centred extension of the first disc-shaped side cap up to a depth $T_3$. So that in this exemplary embodiment, the part with the length $T_3$ can be engaged in the central recess of the first centred extension to a depth $T_3$, the length $B_2$ of the second centred extension is composed of a part with the length $T_3$, the difference $D_3$ and a part with the length $B_7$, so that the length $B_2$ of the second centred extension has a length which is preferably $B_2=T_3+D_3+B_7$. Any combination of different lengths of the respective extensions as described above for other preferred embodiments can be selected according to the invention, wherein the depth $T_2$ of the central recess of the first centred extension and the part of the second centred extension with the length $T_3$ can also be selected variably. It is preferred that $B_0=B_3+B_4+B_5=B_1+(B_2-T_4)=B_1+B_7$ and wherein $B_4<B_1<B_3+B_4$ and $B_5<B_7<B_3+B_5$ and $B_3=B_6$.

In a particularly preferred embodiment, the first centred extension of the first disc-shaped side cap engages preferably by form-fit in the second central recess of the centred ball bearing up to a depth $T_1$, which corresponds to half the width of the swing body, and the second centred extension of the second disc-shaped side cap engages preferably by form-fit into the second central recess of the centred ball bearing, as well as into the first central extension of the first disc-shaped side cap located in the second central recess of the centred ball bearing up to a depth $T_4$, which corresponds to half the width of the swing body. In some of the preferred embodiments described above, the first centred extension of the first disc-shaped side cap, the second centred extension of the second disc-shaped side cap, as well as the central recess of the first centred extension of the first disc-shaped side cap may preferably have different shapes, which may be as described above for the centred extensions and the central recess of the first centred extension.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first centred extension of the first disc-shaped side cap engages by form-fit in the second central recess of the centred ball bearing and the second centred extension of the second disc-shaped side cap engages by form-fit in the second central recess of the centred ball bearing as well as in the first centred extension of the first disc-shaped side cap located in the second central recess of the centred ball bearing.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the first centred extension of the first disc-shaped side cap engages by form-fit in the second central recess of the centred ball bearing and the second centred extension of the second disc-shaped side cap engages by form-fit in the second central recess of the centred ball bearing as well as in the first centred extension of the first disc-shaped side cap located in the second central recess of the centred ball bearing.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first centred extension of the first disc-shaped side cap engages by form-fit in the second central recess of the centred ball bearing to a depth T corresponding to half the width of the swing body, and the second centred extension of the second disc-shaped side cap engages by form-fit to a depth T, which corresponds to half the width of the swing body, in the second central recess of the centred ball bearing as well as in the first central extension of the first disc-shaped side cap located in the second central recess of the centred ball bearing.

In another preferred embodiment, the first centred extension is suitable to engage in the second central recess of the centred ball bearing and the second centred extension is suitable to engage in the second central recess of the centred ball bearing. In a particularly preferred embodiment, the centred extensions do not engage into each other. It is preferable when the first centred extension engages in the second central recess on the first side of the centred ball bearing and the second centred extension engages in the second central recess on the second side of the centred ball bearing.

In a preferred embodiment, the first and/or second centred extension has a defined length B corresponding to half the distance or half the distance between the first and second disc-shaped side caps. If the distance between the inner faces of the first and second disc-shaped side caps is $B_0$, the centred extensions are therefore preferably of the length ½ $B_0$=B. Half the distance B for the first centred extension of the first disc-shaped side cap is the length $B_1$ and half the distance B for the second centred extension of the second disc-shaped side cap is the length $B_2$. In a preferred embodiment, the length $B_1$ of the first extension of the first disc-shaped side cap corresponds to the length $B_2$ of the second extension of the second disc-shaped side cap, and thus $B_1=B_2$ and $B_1+B_2=B_0$ is preferred. It is particularly preferred when the first centred extension of the first disc-shaped side cap and the second centred extension of the second disc-shaped side cap have an overall length $B_0$ which is composed of the width of the outer shell of the swing body $B_3$ and the sum of the respective distances between the swing body and the corresponding inner face of the disc-shaped side cap $B_4$ and $B_5$. In other words, the total length $B_0$, i.e. the sum of the length $B_1$ of the first centred extension and the length $B_2$ of the second centred extension, is preferably composed of the sum of the distance $B_4$ of the swing body to the inner face of the first disc-shaped side cap, the distance $B_5$ of the swing body to the inner face of the second disc-shaped side cap and the width $B_3$ of the swing body, and thus it is preferred that $B_0=B_1+B_2=B_3+B_4+B_5$. It is preferred if the length $B_1$ of the first centred extension and the length $B_2$ of the second centred extension are equal and it is preferred if the distance $B_4$ of the swing body and the first disc-shaped side cap and the distance $B_5$ of the swing body and the second disc-shaped side cap are equal and thus $B_0=2B_1=B_3+2B_4$ if $B_1=B_2$ and $B_4=B_5$. In a preferred embodiment, the lengths $B_1$ and $B_2$ of the centred extensions of the opposite side caps can preferably be of different lengths. Preferably the first centred extension of the first disc side cap has at least the length of the distance $B_4$ of the swing body to the inner face of the first disc side cap and preferably the second centred extension of the second disc side cap has at least the length of the distance $B_5$ of the swing body to the inner face of the second disc side cap, so that preferably $B_4<B_1$ and $B_5<B_2$. It is also preferred that the length $B_1$ of the first centred extension is less than the sum of the length of the distance $B_4$ and the width $B_3$ of the swing body and that the length $B_2$ of the second centred extension is less than the sum of the length of the distance $B_5$ and the width $B_3$ of the swing body, so that $B_1<B_4+B_3$ and $B_2<B_5+B_3$ are preferred. It is therefore particularly preferred that $B_4<B_1<B_4+B_3$ and $B_5<B_2<B_5+B_3$ apply.

In some preferred embodiments, for example, the first centred extension of the first disc-shaped side cap can engage in the second central recess of the centred ball bearing to a depth $T_1$, which is less than half the width of the swing body, and the second centred extension of the second disc-shaped side cap can engage in the second central recess of the centred ball bearing to a depth $T_4$, which is also less than half the width of the swing body. In these preferred embodiments, the centred extensions form-fitted in the second central recess of the centred ball bearing have a difference $D_3$ to each other, wherein it is preferred that $B_3=T_1+T_4+D_3$ and wherein it is also preferred that $B_0=B_1+B_2=B_3+B_4+B_5=T_1+T_4+D_3+B_4+B_5$.

In a particularly preferred embodiment, the first centred extension of the first disc-shaped side cap engages in the second central recess of the centred ball bearing preferably by form-fit up to a depth $T_1$, which corresponds to half the width of the swing body, and the second centred extension engages in the second central recess of the centred ball bearing preferably up to a depth $T_4$, which corresponds to half the width of the swing body, without that the centred extensions are interlocking.

In some embodiments, it may also be preferred that the width $B_6$ of the centred ball bearing is smaller or larger than the width $B_3$ of the swing body or the outer shell of the swing body. In some preferred embodiments, the width $B_6$ of the centred ball bearing is smaller than the width $B_3$ of the swing body or the outer shell of the swing body. In these preferred embodiments, the centred ball bearing having a width $B_6$ less than the width $B_3$ of the outer shell of the swing body, the first centred extension of the first disc-shaped side cap can engage by form-fit in the second central recess of the centred ball bearing and the second centred extension of the second disc-shaped side cap can engage by form-fit in the second central recess of the centred ball bearing, without that the centred extensions are interlocking, it is preferred that the length $B_1$ of the first centred extension is at least equal to the sum of the distance $B_4$ and the difference in width $U_1$ and at most to the above-mentioned sum and additionally to the width $B_6$ of the centred ball bearing and therefore it is preferred that $B_4+U_1$ is $<B_1<B_6+B_4+U_1$. Furthermore, it is preferred in these embodiments, if the length $B_2$ of the second centred extension is at least equal to the sum of the distance $B_5$ and the difference in width $U_2$ and at most to the above-mentioned sum and additionally to the width $B_6$ of the centred ball bearing and therefore it is preferred that $B_5+U_2$ is $<B_2<B_6+B_5+U_2$. In these embodiments, it is still particularly preferred if $B_0=B_1+B_2=B_3+B_4+B_5=U_1+U_2+B_6+B_4+B_5$.

In some preferred embodiments the width $B_6$ of the centred ball bearing is larger than the width $B_3$ of the outer shell of the swing body. In these preferred embodiments, the centred ball bearing having a width $B_6$ greater than the width $B_3$ of the outer shell of the swing body, the first centred extension of the first disc-shaped side cap can engage by form-fit in the second central recess of the centred ball bearing and the second centred extension of the second disc-shaped side cap can engage by form-fit in the second central recess of the centred ball bearing, without that the centred extensions are interlocking, it is preferably the case that the length $B_1$ of the first centred extension and the length $B_2$ of the second centred extension are preferably at least as large as the difference between half the distance $B_0$ between the two opposite disc caps and half the width of the centred ball bearing, particularly preferably if the centred ball bearing has the same distance to each of the two disc-shaped side caps. In these embodiments, it is particularly preferred that, for example, only the inner ring of the centred ball bearing has the width $B_0$, whereas the outer ring of the centred ball bearing preferably has a smaller width than $B_0$, so that the free rotation of the swing body cannot be restricted or prevented.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second centred recess of the centred ball bearing and the second centred extension is suitable to engage in the second centred recess of the centred ball bearing and/or in the first centred extension of the first disc-shaped side cap, wherein the first centred extension of the first disc-shaped side cap engages by form-fit in the second central recess of the centred ball bearing and the second centred extension also engages in the second central recess of the centred ball bearing without that the centred extensions are interlocking.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the first centred extension of the first disc-shaped side cap engages by form-fit in the second central recess of the centred ball bearing and the second centred extension also engages in the second central recess of the centred ball bearing without that the centred extensions are interlocking.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second central extension is suitable to engage in the second centred recess of the centred ball bearing and/or in the first centred extension of the first disc-shaped side cap, wherein the first centred extension of the first disc-shaped side cap engages by form-fit in the second central recess of the centred ball bearing to a depth T corresponding to half the width of the swing body and the second centred extension engages in the second central recess of the centred ball bearing to a depth T corresponding to half the width of the swing body, without that the centred extensions are interlocking.

In a preferred embodiment, the first and second disc-shaped side caps have a defined distance $B_4$ and $B_5$ to the swing body respectively, so that the swing body can rotate freely and is not slowed down by the side caps during rotation. In a preferred embodiment, the swing body has a defined distance $B_4$ to the inner face of the first disc-shaped side cap, for example in that the first centred extension has two regions of different diameter in the form of a two-stage extension and the part of the first centred extension which is adjacent to the inner face, i.e. the first stage of the two-stage extension, has a diameter which is larger than the diameter of the second central recess of the centred ball bearing and smaller than the diameter of the first central recess of the swing body and has a width, which corresponds to at least half the width of the swing body minus half the width of the centred ball bearing, or more preferably corresponds to at least $B_4$, and the second region of the first centred extension which is adjacent to the first region of the first centred extension, i.e. the second stage of the two-stage extension, has a diameter which corresponds to the diameter of the second central recess of the centred ball bearing.

In a preferred embodiment, the swing body has a defined distance $B_5$ to the inner face of the second disc-shaped side cap, for example in that the second centred extension has two regions of different diameter in the form of a two-stage extension and the part of the second centred extension which is adjacent to the inner face, i.e. the first stage of the two-stage extension, has a diameter which is larger than the diameter of the second central recess of the centred ball bearing and smaller than the diameter of the first central recess of the swing body and has a width, which corresponds to at least half the width of the swing body minus half the width of the centred ball bearing and further preferably corresponds to at least $B_5$, and the second region of the second centred extension which is adjacent to the first region of the second centred extension, i.e. the second stage of the two-stage extension, has a diameter which corresponds to the diameter of the second central recess of the centred ball bearing.

In other words, each centred extension on the inner face of one of the disc-shaped side caps preferably has an outer diameter which is larger than the diameter of the second central recess of the centred ball bearing and which is smaller than the diameter of the first central recess of the swing body, in the length of the distance between the inner face of the disc-shaped side cap and the swing body ($B_4$ and $B_5$ respectively). Furthermore, each centred extension on the inner face of one of the disc-shaped side caps, preferably has an outer diameter between the diameter of the second central recess of the centred ball bearing and the diameter of the first central recess of the swing body ($B_4$ or $B_5$) in the length of the distance between the inner face of the disc-shaped side cap and the swing body ($B_4$ or $B_5$). The centred extension on the inner face of one of the disk-shaped side caps each preferably has an outer diameter which is smaller than the diameter of the first central recess in the length of the distance between the inner face of the disk-shaped side cap and the swing body ($B_4$ or $B_5$), so that the outer shell cannot be braked during rotation or while it rotates freely by the part of the centred extensions adjacent to the inner face, i.e. the respective parts adjacent to the inner face, i.e. the first stage of the two-stage extension.

In some preferred embodiments, however, the swing body can also have a centred ball bearing, which has a smaller width $B_6$ than the width $B_3$ of the outer shell of the swing body. In these embodiments, the centred extensions of the disc-shaped side caps show in the length of the distance between the inner faces of the disc-shaped side caps and the swing body ($B_4$ or $B_5$) and additionally in the length of the distance, resulting from the difference in width between the centred ball bearing and the swing body ($U_1$ or $U_2$) or from half the width of the swing body minus half the width of the centred ball bearing, respectively, in total an outer diameter which is preferably larger than the diameter of the second central recess of the centred ball bearing and preferably smaller than the diameter of the first central recess of the swing body, and further preferably an outer diameter in the range between the diameter of the second central recess of the centred ball bearing and the diameter of the first central recess of the swing body.

If the centred ball bearing has a smaller width $B_6$ than the width of the outer shell of the swing body $B_3$, it is preferred that the centred ball bearing is fitted in the first central recess in such a way that the same difference in width to the outer shell of the swing body results on both sides and thus preferably $U_1=U_2$ and thus preferably $B_3=B_6+U_2+U_2$ or particularly preferably $B_3=B_6+2U_1$ if $U_1=U_2$. Thus, the first and second centred extensions are preferably composed in such a way that, starting from the inner surface or inner face of the disc-shaped side caps up to the distance length between the centred ball bearing and the disc-shaped side caps ($B_4+U_1$ and $B_5+U_2$), have an outer diameter which is preferably larger than the outer diameter of the second central recess and preferably smaller than the diameter of the first central recess and further preferably lies in the range between the diameter of the second central recess of the centred ball bearing and the diameter of the first central recess of the swing body.

It is preferred that the centred extensions from the distance length between the inner faces of the respective disc-shaped side cap up to the centred ball bearing preferably up to corresponding to half the width of the centred ball bearing ($B_1-(B_4+U_1)=½ B_6$ and $B_2-(B_5+U_2)=½ B_8$) have an outer diameter which corresponds to the outer diameter of the second central recess, so that form-fit engaging in the second central recess is possible.

If the centred ball bearing has a greater width $B_6$ than the width of the outer shell of the swing body $B_3$, it is preferred that the centred ball bearing is fitted in the first central recess in such a way that the same difference in width to the outer shell of the swing body results on both sides and thus preferably $U_1=U_2$ and thus preferably $B_6=B_3+U_2+U_2$ or particularly preferably $B_6=B_3+2U_1$ if $U_1=U_2$. Thus, the first and second centred extensions are preferably composed in such a way that, starting from the inner surface or inner face of the disc-shaped side caps up to the distance between the centred ball bearing and the disc-shaped side caps, they have an outer diameter which is preferably larger than the outer diameter of the second central recess and preferably smaller than the diameter of the first central recess and further preferably in the range between the diameter of the second central recess of the centred ball bearing and the diameter of the first central recess of the swing body.

It is preferred that the centred extensions from the distance length between the inner faces of the respective disc-shaped side cap up to the centred ball bearing preferably up to corresponding to half the width of the centred ball bearing ($B_1-(B_4+U_1)=½ B_6$ and $B_2-(B_5+U_2)=½B_6$) have an outer diameter which corresponds to the outer diameter of the second central recess, so that form-fit engaging in the second central recess is possible.

In a preferred embodiment, the first and second centred extensions can engage in the second central recess only in the length of half the width of the centred ball bearing, since due to the larger outer diameter of the centred extensions in the distance between the inner face of the respective disc-shaped side cap and the centred ball bearing ($B_4+U_1$ and $B_5+U_2$) form-fit engaging of the extensions in the second central recess within this distance length is prevented, since the second central recess has a smaller diameter.

As already described above, the swing body has a distance $B_4$ or $B_5$ to the inner faces of the disc-shaped side caps, which are preferably in the range between 0.1-3.0 mm, 0.3 mm-2.0 mm, further preferably 0.5 mm-1.5 mm and most preferably 0.8 mm-1.2 mm. Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second centred recess of the centred ball bearing and the second centred extension is suitable to engage in the second central recess of the centred ball bearing and/or in the first centred extension of the first disc-shaped side cap, wherein the first centred extension has two regions of different diameters and the part of the first centred extension adjacent to the inner face has a diameter which is smaller than the diameter of the first central recess of the swing body and h is larger than the diameter of the second central recess of the centred ball bearing and has a width, which corresponds to half the width of the swing body minus half the width of the centred ball bearing plus 0.1 mm to 3.0 mm, and the second region of the first centred extension which is adjacent to the first region of the first centred extension has a diameter which corresponds to the diameter of the second centred recess of the centred ball bearing.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the first centred extension has two regions of different diameters and the part of the first centred extension adjacent to the inner face has a diameter which is smaller than the diameter of the first central recess of the swing body and which is larger than the diameter of the second central recess of the centred ball bearing and has a width, which corresponds to half the width of the swing body minus half the width of the centred ball bearing plus a distance $B_4$ between the swing body and the inner face of the first disc-shaped side cap, and the second region of the first centred extension which is adjacent to the first region of the first centred extension has a diameter which corresponds to the diameter of the second centred recess of the centred ball bearing.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the second centred extension has two regions of different diameters and the part of the second centred extension which is adjacent to the inner face has a diameter which is smaller than the diameter of the first central recess of the swing body and which is larger than the diameter of the second central recess of the centred ball bearing and has a width, which corresponds to half the width of the swing body minus half the width of the centred ball bearing plus 0.1 mm to 3.0 mm, and the second region of the second centred extension which is adjacent to the first region of the second centred extension has a diameter which corresponds to the diameter of the second central recess of the centred ball bearing.

Accordingly, the present invention also relates to a rotatable play body suitable for a children's game consisting of a freely rotatable swing body arranged between two mutually opposite disc-shaped side caps, wherein the swing body exhibits an outer shell with a first central recess and a centred ball bearing with a second central recess, and the centred ball bearing is inserted in the first central recess of the outer shell, the first disc-shaped side cap has an outer face and, on the inner face, a first centred extension, the opposite second disc-shaped side cap exhibits an outer face and, on the inner face, a second centred extension, the first centred extension is suitable to engage in the second central recess of the centred ball bearing and the second centred extension is suitable to engage in the second central recess of the centred ball bearing and/or in the first centred extension of the first disc-shaped side cap, wherein the second centred extension has two regions of different diameters and the part of the second centred extension which is adjacent to the inner face has a diameter which is smaller than the diameter of the first central recess of the swing body and which is larger than the diameter of the second central recess of the centred ball bearing and has a width, which corresponds to half the width of the swing body minus half the width of the centred ball bearing plus a distance $B_5$ between the swing body and the inner face of the second disc-shaped side cap, and the second region of the second centred extension which is adjacent to the first region of the second centred extension has a diameter which corresponds to the diameter of the second centred recess of the centred ball bearing.

Thus, the present invention also relates to a rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on the inner face (I1), a first centred extension (P1), the opposite second disc-shaped side cap (K2) exhibits an outer edge (R2), an outer face (F2) and, on the inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position, wherein the first centred extension has two regions of different diameters and the part of the first centred extension adjacent to the inner face has a diameter which is smaller than the diameter of the first central recess of the swing body and which is larger than the diameter of the second central recess of the centred ball bearing and has a width, which corresponds to half the width of the swing body minus half the width of the centred ball bearing plus a distance $B_4$ between the swing body and the inner face of the first disc-shaped side cap, and the second region of the first centred extension which is adjacent to the first region of the first centred extension has a diameter, which corresponds to the diameter of the second central recess of the centred ball bearing and/or wherein the second centred extension has two regions of different diameters and the part of the second centred extension which is adjacent to the inner face has a diameter which is smaller than the diameter of the first central recess of the swing body and which is larger than the diameter of the second central recess of the centred ball bearing and has a width, which corresponds to half the width of the swing body minus half the width of the centred ball bearing plus a distance $B_5$ between the swing body and the inner face of the second disc-shaped side cap, and the second region of the second centred extension which is adjacent to the first region of the second centred extension has a diameter which corresponds to the diameter of the second centred recess of the centred ball bearing.

In another preferred embodiment, the first and/or second extension can also have a total length that is shorter than half the distance or half the distance between the side caps. In another embodiment, the first and second extensions can have different overall lengths. It is preferred that the part of the first extension of the first side cap which has an outer diameter corresponding to the outer diameter of the second central recess of the ball bearing, so that this part of the first extension can be engaged by form-fit in the second central recess of the centred ball bearing, together with the part of the second extension of the second side cap, which has an outer diameter which corresponds to the outer diameter of the second central recess of the ball bearing, so that this part of the second extension can be engaged by form-fit into the second central recess of the centred ball bearing, in total at most the width of the swing body or at most the width of the outer shell of the swing body or maximum the width of the centred ball bearing. It is preferable if the length of the parts of the first as well as of the second extension, which have an outer diameter corresponding to the outer diameter of the second central recess of the centred ball bearing and which can be form-fitted into the second central recess of the centred ball bearing, have a length so that after form-fit engaging into the second central recess of the centred ball bearing, the side caps do not disengage from the second central recess of the centred ball bearing again without the application of force e.g. not solely by gravity.

The first and second extensions on the inner faces of the disc-shaped side caps, as shown in the embodiments described above, may preferably also have different shapes. For example, a centred extension on the inner face of a disc-shaped side cap can be cylindrical or be also in the shape of a triangle, square, pentagon or regular polygon. The part of the centred extension on the inner face of a disc-shaped side cap at the distance of the inner face of the disc-shaped side cap and the swing body, for example the first stage of a two-stage extension, may have a different outer shape than the part of the extension which has an outer diameter corresponding to the outer diameter of the second central recess of the centred ball bearing, for example the second stage of a two-stage extension, so that this part of the centred extension can engage by form-fit in the second central recess of the centred ball bearing. If the form-fit engaging part of a centred extension of a disc-shaped side cap is cylindrical, it is preferred that this part has an outer diameter which corresponds to the outer diameter of the second central recess. It is particularly preferred if the second central recess is also cylindrical. For example, if the form-fit engaging part of a centred extension of a disc-shaped side cap has the shape of a regular hexagon, it is preferred that the double distance between a corner of the regular hexagon and the centre of the regular hexagon, i.e. twice the radius or diameter of the circle passing through the corners of the regular hexagon, is equal to the outer diameter of the second central recess of the centred ball bearing, so that the part of the extension of a side cap which is in the shape of a regular hexagon can be engaged by form-fit into the second central recess of the centred ball bearing.

The preferred embodiments described above, wherein the centred extensions have two stages as two-stage extensions, are only one possibility to realize a defined distance between the swing body and the inner faces of the side caps. In some other preferred embodiments, spacers can also be provided in a defined diameter on the inner face of the disc-shaped side caps. These spacers preferably have a length which corresponds to the lengths of the first stages of the two-stage extensions as described above. In an exemplary embodiment, for example, the first centred extension on the inner face has spacers on the inner face, which lie in a range of the diameter of the disc-shaped side cap, which corresponds to the diameter of the inner ring of the centred ball bearing, for example. The previously described embodiments, wherein the centred extensions with two stages are available as two-stage extensions or the disc-shaped side caps have spacers can be such as for all the above described embodiments of centred extensions, such as that the first centred extension engages in the second central recess of the ball bearing and the second centred extension engages in the first extension located in the second central recess of the centred ball bearing, in that the first centred extension engages in the second central recess of the centred ball bearing and the second centred extension engages in the second central recess of the centred ball bearing as well as in the first centred extension located in the second central recess of the centred ball bearing and in that the first and second centred extensions each engage in the second central recess of the centred ball bearing without that they are interlocking.

So that after joining the first centred extension of the first disc-shaped side cap into the second central recess of the centred ball bearing or the second centred extension of the second disc-shaped side cap into the first centred extension of the first disc-shaped side cap, a locking mechanism is provided in some preferred embodiments within the first centred extension of the first disc-shaped side cap in the form of a plug connection with resistance which requires a certain pressure force to press the second centred extension into the first centred extension and a certain tensile force to disengage from this plug connector. Such a plug connection can be easily achieved by thickening and thinning the material. For example, a material thickening or point-like or circular elevations can be provided centrally on the outer face of the second centred extension, which engages in a matched manner into a corresponding recess on the inner surface of the first centred extension. In order to release this connection, i.e. to insert the second centred extension tightly into the first centred extension, a minimum pressure force of 20 N is required. A tensile force of at least 20 N is also required to disengage this connection.

The plug connection described above is only one way of implementing a locking mechanism. Other methods known from the state of the art can also be used so that the swing body, the first disc-shaped side cap as well as the second disc-shaped side cap do disengage after they have been assembled to form the rotatable play body according to the invention. It may also be preferable for this connection to be achieved by force-fit, for example if the central recess of the first centred extension has a thread into which the second centred extension can be screwed like a screw. In some embodiments, it may be preferred that the assembled parts of the rotating play body cannot be detached from each other. For example, one of the two disc-shaped side caps may be assembled with the swing body in such a way, for example glued with a suitable adhesive, that these two parts of the rotatable play body can no longer be detached from each other in particular cannot disengage by a tensile force of 20 N. In these embodiments, it may be preferred, for example, that only one of the disc-shaped side caps can be disengaged by a tensile force of 20 N and can be replaced. In a preferred embodiment, the first centred extension can engage in the second central recess of the centred ball bearing, wherein the first centred extension of the first disc-shaped side cap has a central recess in which the second centred extension of the second disc-shaped side cap can engage by form-fit, and wherein the first disc-shaped side cap and the centred ball bearing can no longer be detached from one another, and wherein the second extension can engage by form-fit in the central recess of the first extension. However, it is particularly preferred that the assembled disc-shaped side caps can be released again from each other and also from the swing body under force effect. This is particularly preferred when, for example, the swing body or one or both of the disc-shaped side caps of the rotatable toy body shall be replaced. In an exemplary embodiment, different swing bodies and different disc-shaped side caps are provided, which can be assembled by a user in any combination.

It is thus preferred that the second centred extension (P2) of the second disc-shaped side cap (K2) engages in such a way in the first centred extension (P1) of the first disc-shaped side cap (K1) or the second centred extension (P2) of the second disc-shaped side cap (K2) can be connected in such a way with the first centred extension (P1) of the first disc-shaped side cap (K1), that a compressive force of at least 20 N is required to make the connection possible and a tensile force of at least 20 N is required to break the connection. In order to allow the side caps to be replaced independently of each other, it is preferable that the first centred extension is suitable to engage in the second central recess of the centred ball bearing and the second centred extension is suitable to engage in the second central recess of the centred ball bearing, wherein the centred extensions do not engage in each other. It is preferable when the first centred extension engages in the second central recess on the first side of the centred ball bearing and the second centred extension engages the second central recess on the second side of the centred ball bearing.

In a preferred embodiment of the rotatable play body according to the invention, the swing body or the outer shell of the swing body as well as the opposite side caps have one or more printable outer face(s). In an exemplary embodiment of a printed rotatable play body, the outer shell of the swing body has the shape of a regular hexagon, for example. On the faces of the hexagon, the six outer fields are printed, for example, with different game figures or the numbers 1 to 6. Accordingly, this exemplary embodiment of a rotatable play body, if it is printed with the numbers from 1 to 6, can be used like a dice. The swing body is set in rotation by a user and stopped e.g. with a finger. The field on which the user's finger brakes the swing body represents the number that a user has "thrown". If, on the other hand, the outer face of the outer frame of the outer shell is printed with game figures or actions, the user can select a game figure or an action by stopping the rotatable swing body.

In some preferred embodiments of the rotatable play body according to the invention, further components which, for example, generate acoustic and/or visual signals can be integrated into the swing body or into the two disc-shaped side caps. Suitable components which are suitable for visual signal generation are, for example, light-emitting diodes (LEDs) which can be integrated into one or more recesses in the outer shell of the swing body, the swing body or the disc-shaped side caps. In a preferred embodiment, for example, several LEDs with different light colours can be integrated into the outer shell of the swing body. Suitable components which are suitable for acoustic signal generation can, as in the case of the LEDs, be components which have acoustic signals instead of the visually perceptible light or, for example, be integrated in such a way that an air stream flows through the component when it is rotated, thereby generating an acoustic signal. Such components, which generate acoustic or visual signals, especially preferably they generate them only during the rotation of the swing body, are known from the state of the art and the skilled person in the art is able to select a suitable component for the generation of acoustic and/or visual signals on the basis of the present disclosure in order to integrate it into the rotatable play body.

DESCRIPTION OF THE FIGURES

FIG. 2.

FIG. 8.

FIG. 10.

FIG. 12.

FIG. 14: FIG. 14A shows the assembly of the second centred two-stage extension (P2) with a length $B_2$ of the second disc-shaped side cap (K2) with the first centred two-stage extension (P1) with a length $B_1$ of the first disc-shaped side cap (K1) without a swing body (S) interposed there between.

FIG. 15.

EXAMPLES

Example 1

Figure 1:
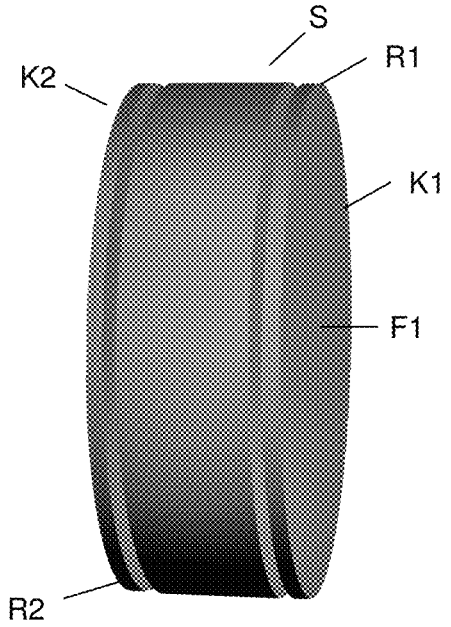
FIG. 1: shows a preferred embodiment of the rotatable play body according to the invention. The swing body (S), which is cylindrical and has a printable surface, is arranged centrally between the two disc-shaped side caps (K1) and (K2). On the right, the first disc-shaped side cap (K1) can be seen as a round cylindrical disc with the plane printable circular outer face (F1). The second disc-shaped side cap (K2) is indicated on the left only by its outer edge. The diameter of the first disc-shaped side cap (K1) corresponds to the diameter of the second disc-shaped side cap (K2) which corresponds to the diameter of the swing body (S). The width of the swing body (S) corresponds to 10 times to 12 times the width of a disc-shaped side cap, the width of the first disc-shaped side cap (K1) corresponding to the width of the second disc-shaped side cap (K2).
Figure 2A:
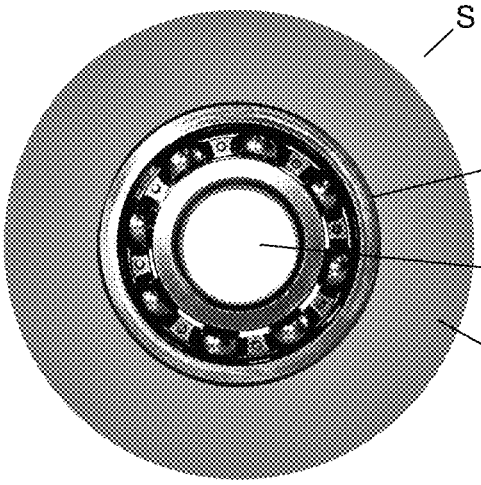
FIG. 2A shows a picture of the swing body (S) consisting of the outer shell (M) and the form-fitted and centrally inserted centred ball bearing (L). The centred ball bearing (L) has the second central recess (A2).
Figure 2B:
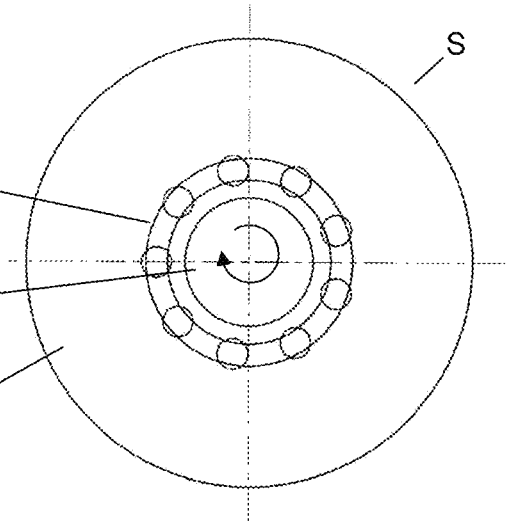
FIG. 2B shows the centred arrangement of the outer shell (M) and inner centred ball bearing (L). The cylindrical centred ball bearing (L) with the second central recess (A2) is concentrically surrounded by the cylindrical outer shell (M). The axis of rotation runs vertically through the centre of the swing body (S), around which the swing body (S) is freely rotatable.
Figure 3:
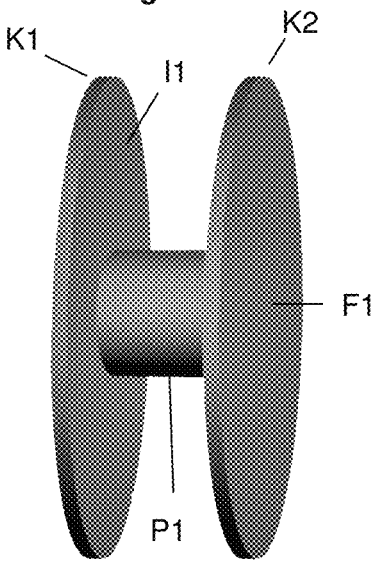
FIG. 3: shows the disc-shaped side caps (K1) and (K2) fitted together without a swing body (S) in between, both of which have the same width and diameter. The cylinder located centrally between the disc-shaped side caps (K1) and (K2) around the axis of rotation is the first centred extension (P1) located centrally on the inner face (I1) of the first disc-shaped side cap (K1), which is engaged by the second centred extension (P2) located centrally on the inner face (I2) of the side cap (K2) which is not shown in FIG. 3.
Figure 4:
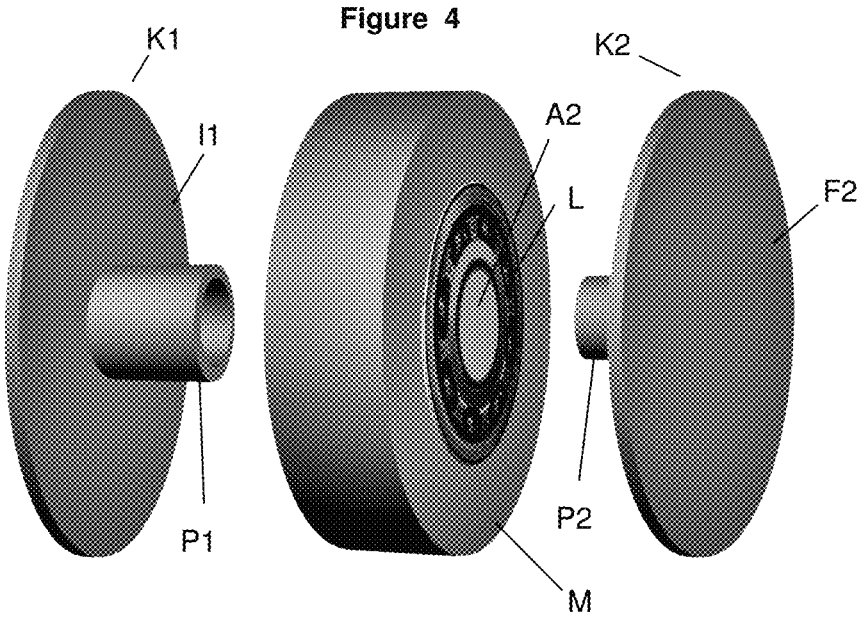
FIG. 4: shows the play body with swing body (S) with cylindrical outer shell (M), cylindrical centred ball bearing (L) and the cylindrical central recess of the centered ball bearing (L). To the right of the swing body (S) is the cylindrical second disc-shaped side cap (K2) with the outer face (F2) and the centred cylindrical second centred extension (P2). On the left is shown the cylindrical first disc-shaped side cap (K1) with the inner face (I1) and the centrally located cylindrical first centred extension (P1) thereon.
Figure 5:
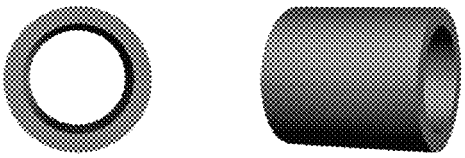
FIG. 5: shows an exemplary cylindrical second centred extension (P2) in the form of a hollow cylinder or cylinder shell from above (left) and from the side (right) suitable to engage in the first centred extension (P1).
Figure 6:
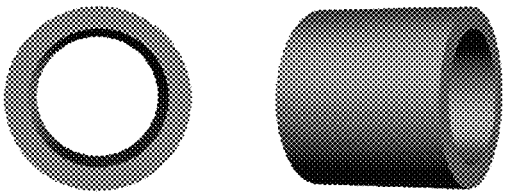
FIG. 6: shows an exemplary cylindrical first centred extension (P1) in the form of a hollow cylinder or cylinder shell from above (left) and from the side (right).
Figure 7:
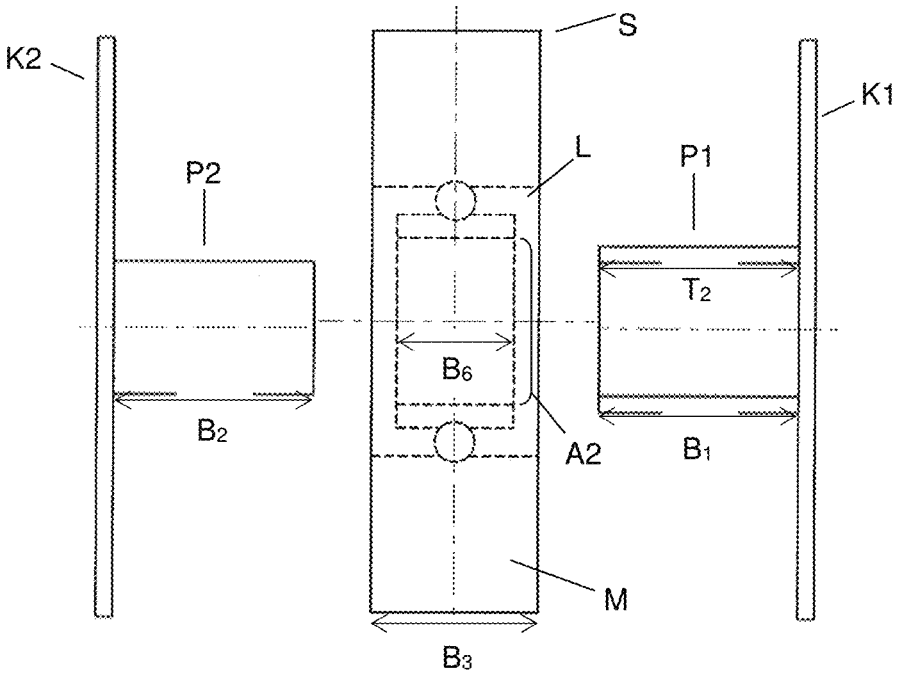
FIG. 7: shows a preferred embodiment of a rotatable play body according to the invention with a swing body (S) with the outer shell (M) having a width $B_3$, with the centred ball bearing (L) having a width $B_6$ and the second central recess (A2) of the centred ball bearing (L). To the right of the swing body (S) is the first disc-shaped side cap (K1) with the centred first centred extension (P1) with a length $B_1$. The first centred extension (P1) has a central recess with a depth $T_2$. On the left is the second disc-shaped side cap (K2) with the second centred extension (P2) of length $B_2$.
Figure 8A:
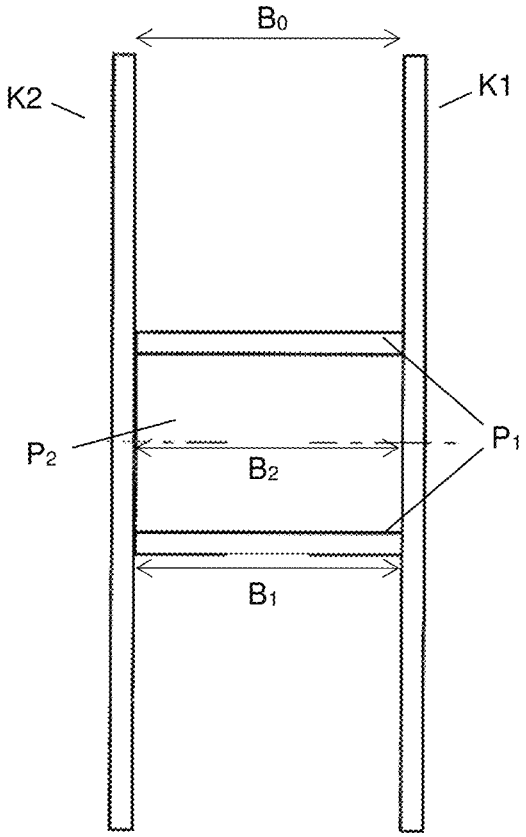
FIG. 8A shows the engagement of the second centred extension (P2) having a length $B_2$ of the second disc-shaped side cap (K2) with the first centred extension (P1) having a length $B_1$ of the first disc-shaped side cap (K1) without a swing body (S) interposed there between. The length of both extensions is the same, i.e. $B_1=B_2$, so that complete interlocking is possible. The disc-shaped side caps (K1) and (K2) have a distance $B_0$ between them.
Figure 8B:
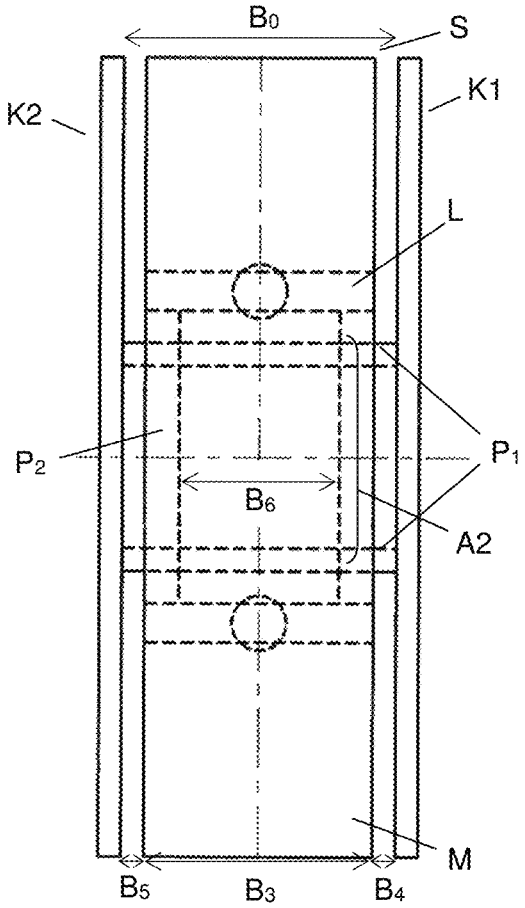
FIG. 8B shows the engagement of the second centred extension (P2) of the second disc-shaped side cap (K2) with a length $B_2$ into the first centred extension (P1) of the first disc-shaped side cap (K1) with a length $B_1$ with a swing body (S) arranged in between. The length of both extensions is the same, i.e. $B_1=B_2$, so that complete interlocking is possible. The disc-shaped side caps (K1) and (K2) have a distance $B_0$ between them. The outer shell (M) has a width $B_3$ and the centred ball bearing (L) has a width $B_6$ and a second central recess (A2) of the ball bearing (L). The distance between the swing body (S) and the first disc-shaped side cap (K1) is equal to the length $B_4$ and the distance between the swing body (S) and the second disc-shaped side cap (K2) is equal to the length $B_5$. In this exemplary embodiment, the first centred extension (P1) of the first disc-shaped side cap (K1) engages by form-fit into the second central recess (A2) of the ball bearing (L) and the second centred extension (P2) of the second disc-shaped side cap (K2) engages by form-fit into the first centred extension (P1) of the first disc-shaped side cap (K1) located in the second central recess (A2) of the centred ball bearing (L).
Figure 9:
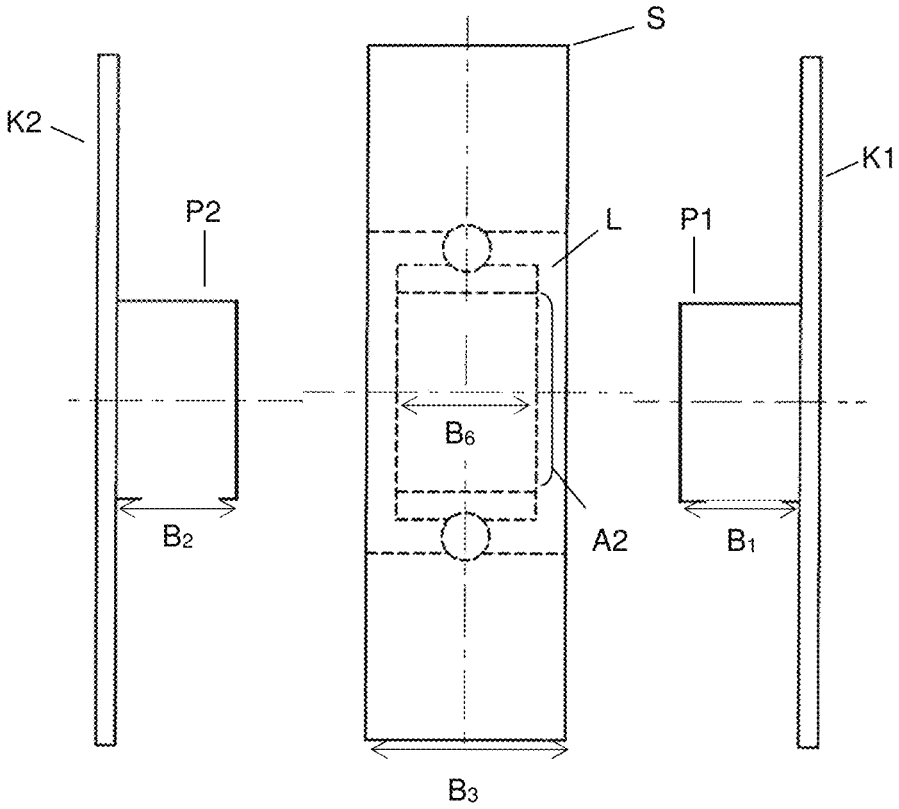
FIG. 9: shows a preferred embodiment of a rotatable play body according to the invention with a swing body (S) with the outer shell (M) having a width $B_3$, with a centred ball bearing (L) having a width $B_6$ and the second central recess (A2) of the centred ball bearing (L). To the right of the swing body (S) is the first disc-shaped side cap (K1) with the centred first centred extension (P1) with a length $B_1$. To the left is the second disc-shaped side cap (K2) with the second centred extension (P2) with a length $B_2$.
Figure 10A:
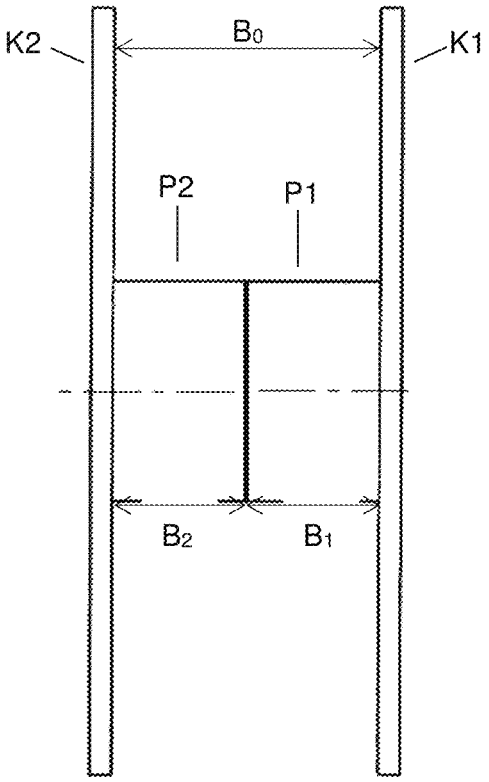
FIG. 10A shows the assembly of the second centred extension (P2) having a length $B_2$ of the second disc-shaped side cap (K2) with the first centred extension (P1) having a length $B_1$ of the first disc-shaped side cap (K1) without a swing body (S) interposed there between. The length of both extensions is the same, i.e. $B_1=B_2$, so that complete interlocking is possible. The disc-shaped side caps (K1) and (K2) have a distance $B_0$ between them.
Figure 10B:
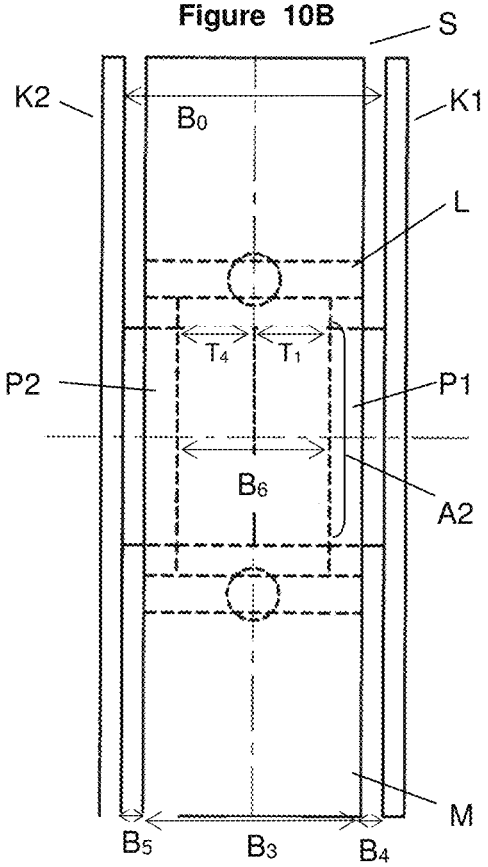
FIG. 10B shows the engagement of the second centred extension (P2) of the second disc-shaped side cap (K2) with a length $B_2$ into the second central recess (A2) of the centred ball bearing (L) and of the first centred extension (P1) of the first disc-shaped side cap (K1) with a length $B_1$ into the second central recess (A2) of the centred ball bearing (L) with a swing body (S) arranged there between. The length of both extensions is the same, i.e. $B_1=B_2$. The disc-shaped side caps (K1) and (K2) have a distance $B_0$ to each other, so that $B_1+B_2=B_0$. The outer shell (M) has a width $B_3$ and the centred ball bearing (L) has a width $B_6$ and a second central recess (A2) of the ball bearing (L). The distance between the swing body (S) and the first disc-shaped side cap (K1) is equal to length $B_4$ and the distance between the swing body (S) and the second disc-shaped side cap (K2) is equal to length $B_5$. In this preferred embodiment, the first centred extension (P1) of the first disc-shaped side cap (K1) engages by form-fit into the second central recess (A2) of the ball bearing (L) up to a depth $T_1$ and the second centred extension (P2) of the second disc-shaped side cap (K2) engages by form-fit into the second central recess (A2) of the centred ball bearing (L) up to a depth $T_4$, without that the centred extensions (P1) and (P2) are interlocking.
Figure 11:
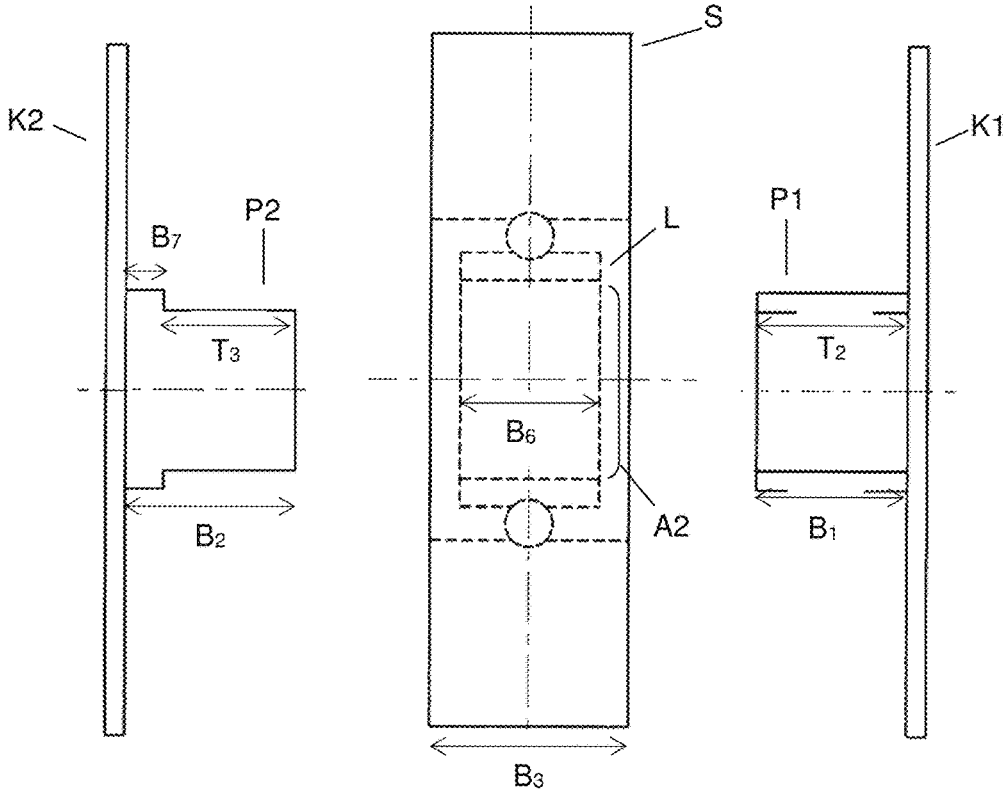
FIG. 11: shows a preferred embodiment of the rotatable play body according to the invention with a swing body (S) with the outer shell (M) having a width $B_3$, with a centred ball bearing (L) having a width $B_6$ and the second central recess (A2) of the centred ball bearing (L). To the right of the swing body (S) is the first disc-shaped side cap (K1) with the centred first centred extension (P1) with a length $B_1$. The first centred extension (P1) has a central recess with a depth $T_2$. On the left is the second disc-shaped side cap (K2) with the second centred extension (P2) of length $B_2$. The second centred extension has a part of length $B_7$ which is adjacent to the inner face (I2) and has a diameter corresponding to the diameter of the second central recess (A2) of the ball bearing (L) and a part of length $T_3$ which can engage to a depth $T_3$ in the central recess of the first centred extension (P1) of the first disc-shaped side cap (K1).
Figure 12A:
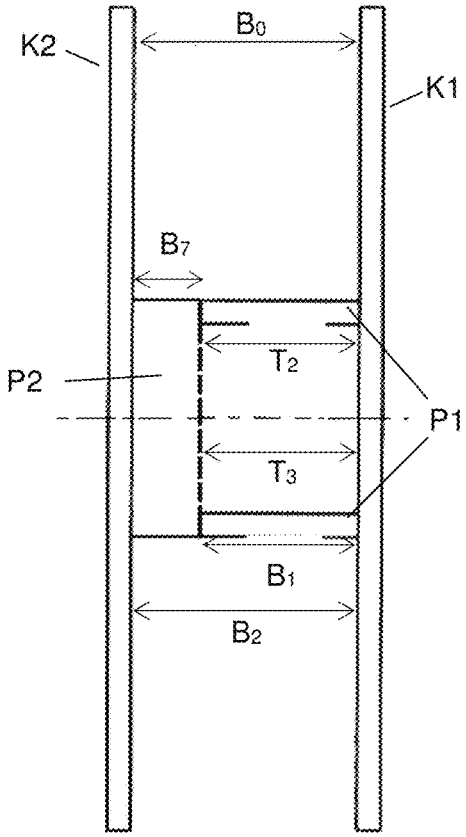
FIG. 12A shows the engagement of the second centred extension (P2) having a length $B_2$ of the second disc-shaped side cap (K2) with the first centred extension (P1) having a length $B_1$ of the first disc-shaped side cap (K1) without a swing body (S) interposed there between. The part of the second centred extension (P2) of length $T_3$ engages the central recess of the first centred extension (P1) to a depth $T_3$. The part of the second centred extension (P2) of length $T_3$ corresponds in this version to the depth $T_2$ of the central recess of the first centred extension. Lengths $T_2$ and $T_3$ are the same so they are fully interlocked. The disc-shaped side caps (K1) and (K2) have a distance $B_0$ between them. The part of the second centred extension (P2) of length $B_7$ that is adjacent to the inner face (I2) does not engage in the central recess of the first centred extension (P1).
Figure 12B:
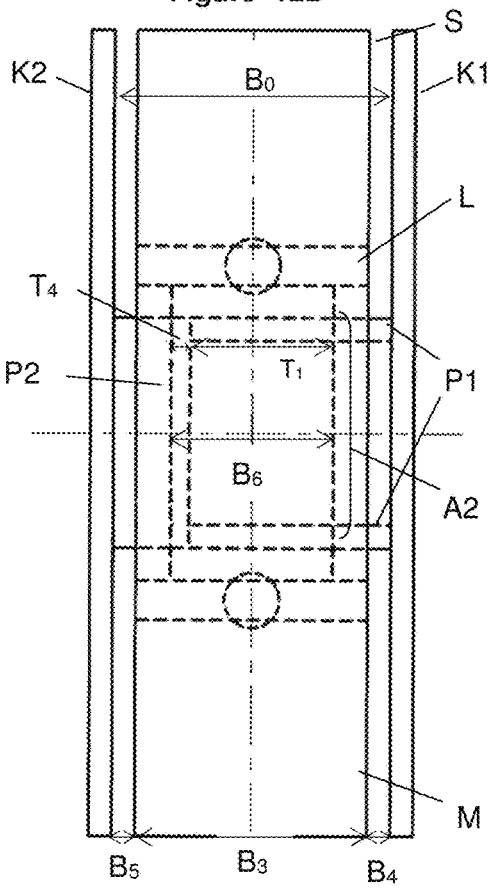
FIG. 12B shows the engagement of the second centred extension (P2) of the second disc-shaped side cap (K2) with a length $B_2$ in the second central recess (A2) of the centred ball bearing (L) and in the central recess of the first centred extension (P1) and the first centred extension (P1) of the first disc-shaped side cap (K1) with a length $B_1$ in the second central recess (A2) of the centred ball bearing (L) with the swing body (S) arranged there between. The disc-shaped side caps (K1) and (K2) have a distance $B_0$ between them. The outer shell (M) has a width $B_3$ and the centred ball bearing (L) has a width $B_6$ and a second central recess (A2) of the ball bearing (L). The distance between the swing body (S) and the first disc-shaped side cap (K1) is equal to the length $B_4$ and the distance between the swing body (S) and the second disc-shaped side cap (K2) is equal to the length $B_5$. In this preferred embodiment, the first centred extension (P1) of the first disc-shaped side cap (K1) engages by form-fit in the second central recess (A2) of the ball bearing (L) to a depth $T_1$ and the second centred extension (P2) of the second disc-shaped side cap (K2) engages by form-fit in the second central recess (A2) of the ball bearing (L) to a depth $T_4$ as well as in the first centred extension (P1) of the first disc-shaped side cap (K1) located in the second central recess (A2) of the centred ball bearing (L).
Figure 13:
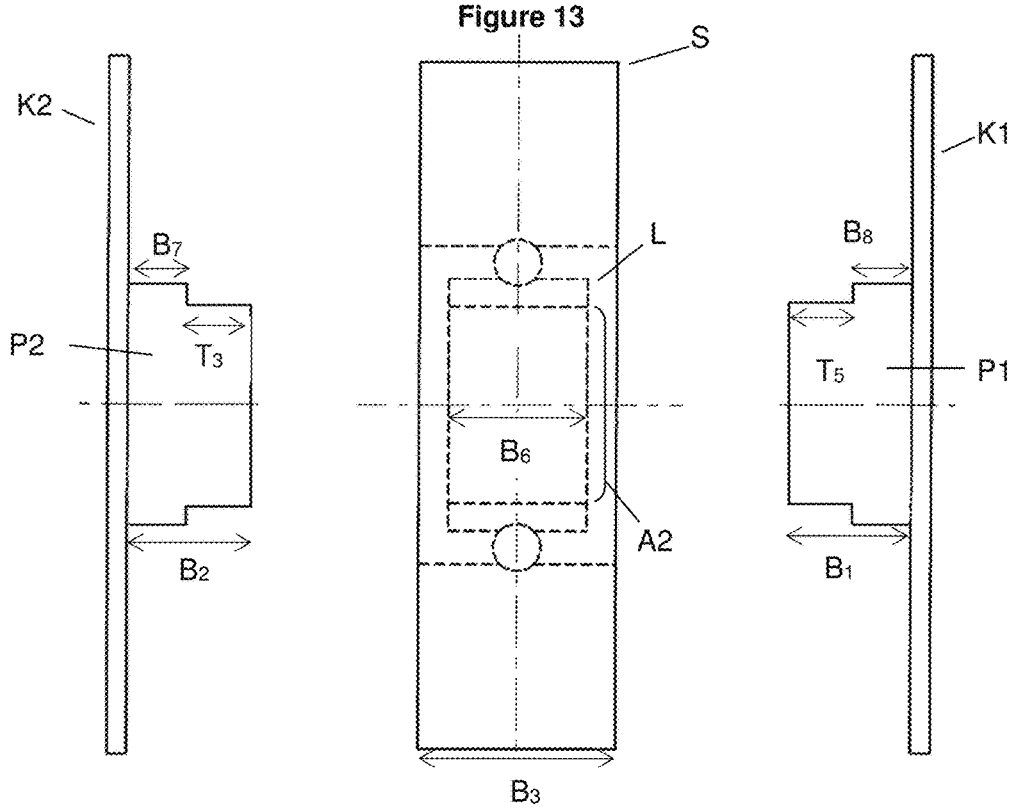
FIG. 13: shows a preferred embodiment of the rotatable play body according to the invention with a swing body (S) with the outer shell (M) having a width $B_3$, with a centred ball bearing (L) having a width $B_6$ and the second central recess (A2) of the centred ball bearing (L). To the right of the swing body (S) is the first disc-shaped side cap (K1) with the centred first centred two-stage extension (P1) with a length $B_1$. On the left is the second disc-shaped side cap (K2) with the centred second centred two-stage extension (P2) with a length $B_2$. The second centred extension has a part of length $B_7$ abutting the inner face (I2) and the first centred extension has a part of length $B_8$ abutting the inner face (I1), the parts of length $B_7$ and $B_8$ having a diameter smaller than the diameter of the first central recess (A1) of the outer shell (M) and larger than the diameter of the second central recess (A2) of the centred ball bearing (L). The first centred extension (P1) has a part of length $T_5$ which can engage to a depth $T_5$ in the second central recess (A2) of the centred ball bearing (L) and that of the second centred extension (P2) has a portion of length $T_3$ which can engage to a depth $T_3$ in the second central recess (A2) of the ball bearing (L) without that the centred extensions (P1) and (P2) are interlocking.
Figure 14A:
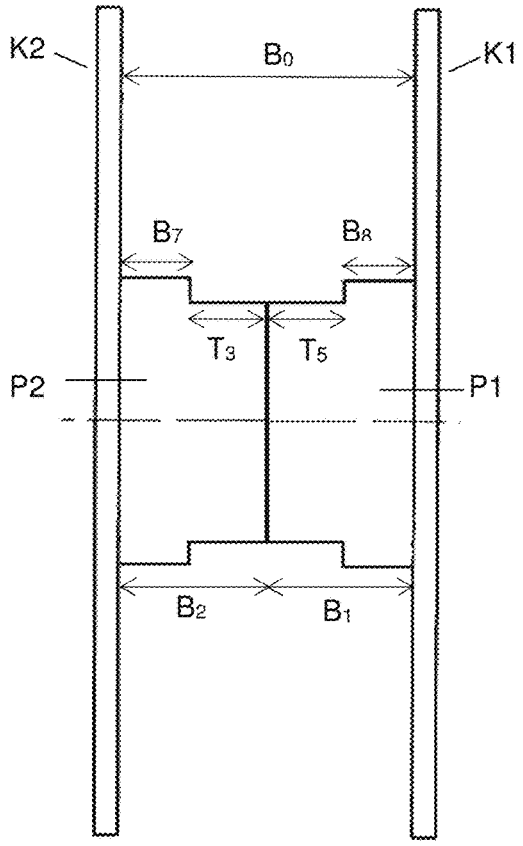
Figure 14B:
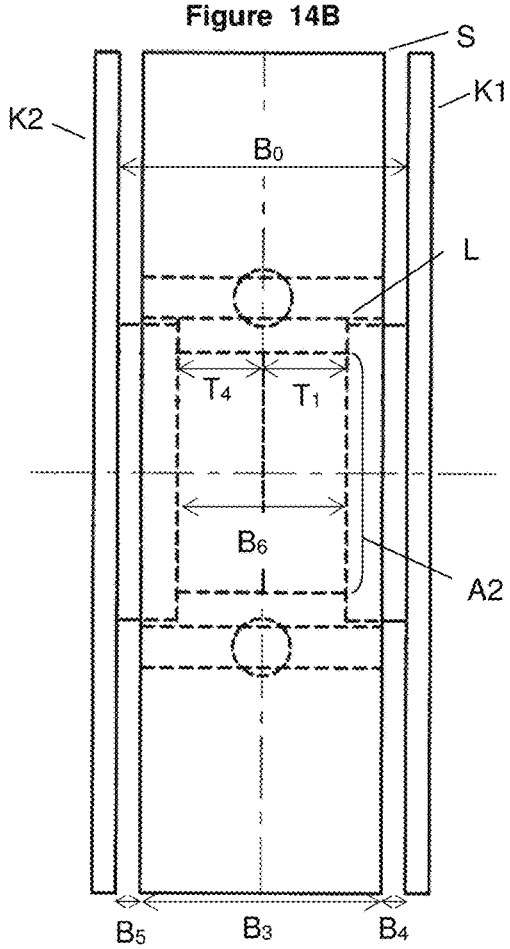
FIG. 14B shows the engagement of the second centred extension (P2) of the second disc-shaped side cap (K2) having a length $B_2$ into the second central recess (A2) of the centred ball bearing (L) and of the first centred extension (P1) of the first disc-shaped side cap (K1) having a length $B_1$ into the second central recess (A2) of the centred ball bearing (L) with a swing body (S) arranged there between. The disc-shaped side caps (K1) and (K2) have a distance $B_0$ between them. The outer shell (M) has a width $B_3$ and the centred ball bearing (L) has a width $B_6$ and a second central recess (A2) of the ball bearing (L). The distance between the swing body (S) and the first disc-shaped side cap (K1) is equal to the length $B_4$ and the distance between the swing body (S) and the second disc-shaped side cap (K2) is equal to the length $B_5$. In this preferred embodiment, the first centred extension (P1) of the first disc-shaped side cap (K1) engages by form-fit in the second central recess (A2) of the ball bearing (L) to a depth $T_1$, which corresponds to the length $T_3$, and the second centred extension (P2) of the second disc-shaped side cap (K2) engages by form-fit in the second central recess (A2) of the centred ball bearing (L) to a depth $T_4$, which corresponds to the length $T_5$.
Figure 15A:
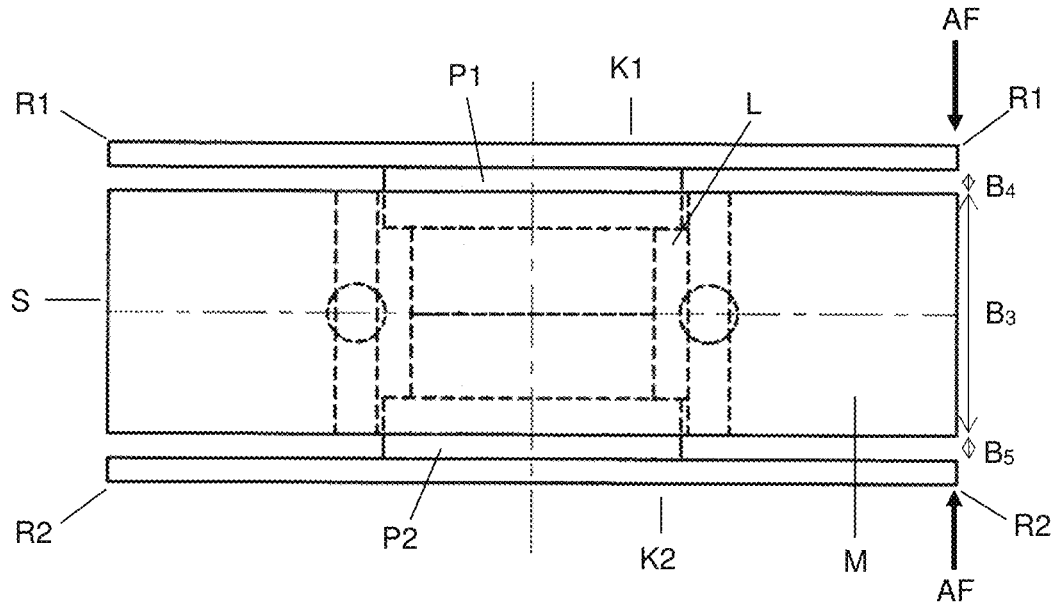
FIG. 15A shows the rotatable swing body shown in FIG. 14B rotated by 90° with a swing body (S) with the outer shell (M) with a width $B_3$, with a centred ball bearing (L) and the second central recess (A2) of the centred ball bearing (L). At the top of the swing body (S) is the first disc-shaped side cap (K1) with an exemplary first centred two-stage extension (P1). Below is the second disc-shaped side cap (K2) with an exemplary centred second centred two-stage extension (P2). The first disc-shaped side cap has an outer edge (R1) and the second disc-shaped side cap has an outer edge (R2). The disc-shaped side caps (K1) and (K2) are movable at the outer edge (R1) and (R2) against the freely rotatable swing body (S) in order to fix the freely rotatable swing body (S) in its position. Shown is the point of application of the acting compressive force (AF) at the outer edge (R1) and (R2) of the mutually opposite disc-shaped side caps in order to move the disc-shaped side caps (K1) and (K2) against the swing body in order to fix the freely rotatable swing body (S) in its position.
Figure 15B:
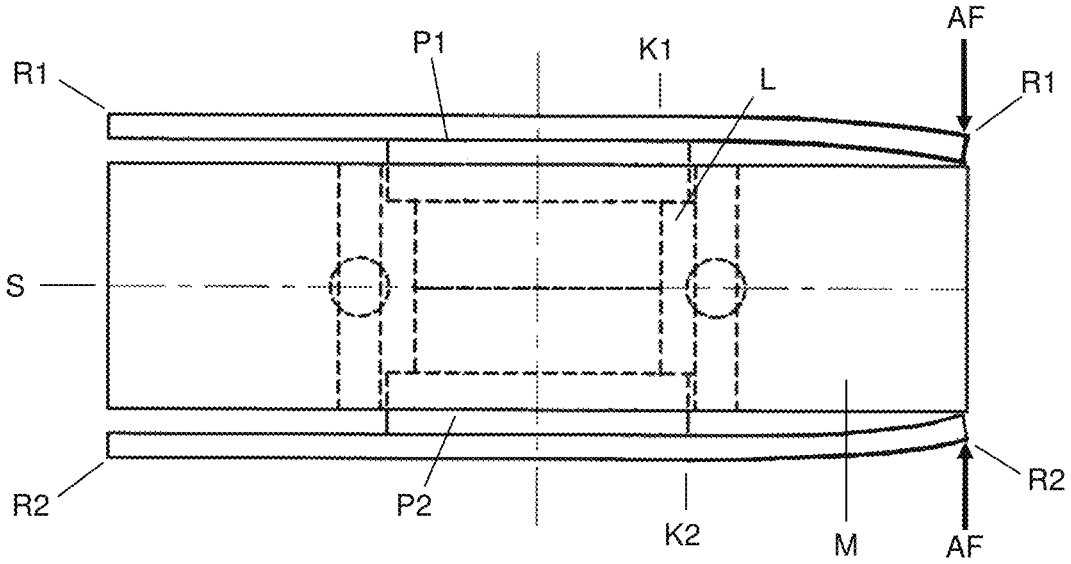
FIG. 15B shows the rotatable swing body of FIG. 15A, wherein the disc-shaped side caps (K1, K2) at the outer edge (R1, R2) are moved against the freely rotatable swing body (S) by the inwardly directed acting compressive force (AF) so that the freely rotatable swing body (S) is fixed in its position. The shown disc-shaped side caps (K1) and (K2) and the swing body (S) have a suitable spacing so that the inwardly directed force (AF) perpendicular to the disc-shaped side caps can be applied preferably at the outer edge (R1, R2) of the disc-shaped side caps, so that a braking of the rotation of the swing body is effected after the swing body has previously been set in rotation.

In FIG. 1 an example of an assembled rotating play body according to the invention is shown. This consists of a cylindrical swing body (S) and cylindrical disc-shaped side caps (K1) with an outer edge (R1) and (K2) with an outer edge (R2). The cylindrical swing body(S) is made of polyoxymethylene (POM). The swing ring (S) or the outer shell (M) of the swing ring (S) has an outer diameter of 3.5 cm and width of 1.0 cm. The outer shell (M) is printed with 10 motifs in two dimensions. Into the cylindrical outer shell (M) of the swing body (S) a centred ball bearing (L) is inserted, which is made of polyoxymethylene (POM) and the balls of the ball bearing (L) are made of stainless steel. The first central recess (A1) has a diameter of 1.6 cm. The cylindrical centred ball bearing (L) has an outer diameter of 1.6 cm, a width of 0.8 cm and a cylindrical second central recess (A2) with a diameter of 1.0 cm. The assembled rotatable play body has on the one hand the disc-shaped side cap (K1) as a round disc with a plane printable circular outer face (F1) and on the other hand the plane printable circular disc-shaped side cap (K2). The cylindrical disc-shaped side caps are also made of polyoxymethylene (POM) and each have an outer diameter of 3.5 cm and a width of 1 mm. The assembled disc-shaped side caps (K1) and (K2) are arranged parallel to each other with a distance of 1.2 cm between the two inner faces (I1) and (I2). The disc-shaped side caps (K1) and (K2) each have a two-stage extension (P1) and (P2), each with a length of 0.5 cm, centrally arranged on the inner faces (I1) and (I2) of the disc-shaped side caps (K1) and (K2). The first stage of the two-stage extensions (P1) and (P2) has a length of 2.0 mm and a diameter of 1.2 cm. The second stage of the two-stage extensions (P1) and (P2) is 3.0 mm long and 1.0 cm in diameter. Thus, the first centred extension (P1) engages in the second central recess (A2) of the centred ball bearing (L) to a depth of 3.0 mm and the second centred extension (P2) engages the second central recess (A2) of the centred ball bearing to a depth of 3.0 mm without the centred extensions (P1) and (P2) interlocking.

The assembly of the rotatable play body is carried out in such a way that at first the first disc-shaped side cap (K1) is assembled with the swing body (S) by engaging in the first centred extension (P1) of the disc-shaped side cap (K1) in the second central recess (A2) of the centred ball bearing (L). The second disc-shaped side cap (K2) is then assembled with the previously assembled swing body (S) and the first disc-shaped side cap (K1) by form-fit engaging of the second centred extension (P2) in the second central recess (A2) of the centred ball bearing (L) on the opposite side. This provides a rotatable play body according to the invention, in which the distance of the swing body (S) to the inner faces (I1) and (I2) of the disc-shaped side caps (K1) and (K2) is 0.1 mm respectively, so that the swing body (S) between the two disc-shaped side caps (K1) and (K2) is freely rotatable, so that it can be taken in the left hand and with the right hand the swing body (S) is rotated, which after 10 seconds still rotates freely at a speed of 2 rotations per second.

By pressing with a pressure of approx. 22N at the outer edge (R1) of the side cap (K1) and at opposite position on the outer edge (R2) of the side cap (K2), the side caps (K1) and (K2) can be pressed against the swing body (S) in such a way that the swing body (S) can no longer rotate and its position and thus that of the motifs on the outer shell (M) is fixed.

What is claimed is:

1. Rotatable play body suitable for a children's game consisting of a freely rotatable swing body (S) arranged between two mutually opposite disc-shaped side caps (K1) and (K2), wherein the swing body (S) exhibits an outer shell (M) and a centred ball bearing (L), the first disc-shaped side cap (K1) exhibits an outer edge (R1), an outer face (F1) and, on an inner face (I1), a first centred extension (P1), the opposite second disc-shaped side cap (K2) exhibits an outer edge (R2), an outer face (F2) and, on an inner face (I2), a second centred extension (P2), and the extensions (P1) and (P2) are suitable for engaging in the swing body (S), wherein the disc-shaped side caps (K1) and (K2) are movable at the outer edge (R1) and (R2) towards the freely rotatable swing body (S) in order to fix the freely rotatable swing body (S) in its position.

2. The rotatable play body according to claim 1, wherein the disc-shaped side caps (K1) and (K2) exhibit a diameter in the range of 0.5 times to 1.2 times of the outer diameter of the swing body (S).

3. The rotatable play body according to claim 1, wherein the disc-shaped side caps (K1) and (K2) at the outer edge (R1) and (R2) are reversibly movable against the freely rotatable play body (S) by an acting compressive force (AF) in order to fix the freely rotatable swing body (S) in its position.

4. The rotatable play body according to claim 1, wherein the outer shell (M) is cylindrical or exhibits a triangular, rectangular, pentagonal, hexagonal, heptagonal, octagonal or polygonal shape.

5. The rotatable play body according to claim 4, wherein the triangular, rectangular, pentagonal, hexagonal, heptagonal, octagonal or polygonal shape is a regular polygon.

6. The rotatable play body according to claim 1, wherein the first disc-shaped side cap (K1) and/or the second disc-shaped side cap (K2) is/are cylindrical or exhibits/exhibit a triangular, rectangular, pentagonal, hexagonal, heptagonal, octagonal or polygonal shape.

7. The rotatable play body according claim 1, wherein the freely rotatable swing body (S) with the outer shell (M) is cylindrical, and the outer cylindrical surface of the cylindrical swing body (S) is plane and printable.

8. The rotatable play body according to claim 7, wherein the wall thickness (W) of the cylindrical outer shell (M) of the freely rotatable swing body (S) is constant.

9. The rotatable play body according to claim 7, wherein the outer radius of the cylindrical outer shell (M) of the freely rotatable swing body (S) is constant.

10. The rotatable play body according to claim 1, wherein the disc-shaped side caps (K1) and (K2) at outer edge (R1) and (R2) are reversibly movable against the freely rotatable swing body (S) by an acting compressive force in the range of 5 N to 100 N in order to fix the freely rotatable swing body (S) in its position.

11. The rotatable play body according to claim 1, wherein the distance ($B_0$) of the inner faces (I1, I2) of the mutually opposite side caps (K1) and (K2) is greater than the width ($B_3$) of the swing body (S).

12. The rotatable play body according to claim 1, wherein the disc-shaped side caps (K1) and (K2) exhibit a diameter in the range of 0.8 times to 1.1 times of the outer diameter of the swing body (S).

13. The rotatable play body according to claim 1, wherein the disc-shaped side-caps (K1) and (K2) both have the same diameter which corresponds to the outer diameter of the swing body (S).

14. The rotatable play body according claim 1, wherein the width of the centred ball bearing (L) is 0.50 times to 0.95 times of the width of the swing body (S).

15. The rotatable play body according to claim 1, wherein the disc-shaped side caps (K1) and (K2) each have a width in the range of 0.05 times to 0.5 times of the width of the swing body (S).

16. The rotatable play body according to claim 1, wherein the disc-shaped side caps (K1) and (K2) each have a width in the range of 0.07 times to 0.3 times of the width of the swing body (S).

17. The rotatable play body according to claim 1, wherein the disc-shaped side caps (K1) and (K2) each have a width in the range of 0.1 times to 0.2 times of the width of the swing body (S).

18. The rotatable play body according to claim 1, wherein the disc-shaped side caps (K1) and (K2) both have the same width.

19. The rotatable play body according to claim 1, wherein the swing body (S) or the outer shell (M) of the swing body (S) as well as the mutually opposite disc-shaped side caps (K1 and K2) exhibit one or more printable outer faces.

20. The rotatable play body according to claim 1, wherein the mass of the swing body (S) is at least 15 times the mass of the two disc-shaped side caps (K1 and K2).

21. The rotatable play body according to claim 1, wherein the first centred extension (P1) of the first disc-shaped side cap (K1) engages form-closed into a second central recess (A2) of the centred ball bearing (L) and the second centred extension (P2) of the second disc-shaped side caps (K2) engages form-closed into the first extension (P1) of the first disc-shaped side cap (K1) located in the second central recess (A2) of the centred ball bearing (L).

22. The rotatable play body according to claim 1, wherein the first centred extension (P1) of the first disc-shaped side cap (K1) engages form-closed into a second central recess (A2) of the centred ball bearing (L) and the second centred extension (P2) of the side cap (2) engages form-closed into the second central recess (A2) of the centred ball bearing (L) and into the first centred extension (P1) of the first disc-shaped side cap (K1) located in the second central recess (A2).

23. The rotatable play body according to claim 1, wherein first centred extension (P1) of the first disc-shaped side cap (K1) engages form-closed into a second central recess (A2) of the centred ball bearing (L) and the second centred extension (P2) engages also into the second central recess (A2) of the centred ball bearing (L) without the centred extensions (P1) and (P2) engage into each other.

24. The rotatable play body according to claim 1, wherein the first centred extension (P1) has two regions of different diameters and the part of the first centred extension (P1) abutting the inner face (I1) has a diameter which is smaller than the diameter of a first central recess (A1) of the swing body (S) and which is larger than the diameter of a second central recess (A2) of the centred ball bearing (L) and has a width, which corresponds to half the width of the swing body (S) minus half the width of the centred ball bearing (L) plus a distance ($B_4$) between the swing body (S) and the inner face (I1) of the second disc-shaped side cap (K1), and the second region of the first centred extension (P1) which abuts the first region of the first centred extension (P1) has a diameter which corresponds to the diameter of the second central recess (A2) of the centred ball bearing (L).

25. The rotatable play body according to claim 1, wherein the second centred extension (P2) has two regions of different diameters and the part of the second centred extension (P2) abutting the inner face (I2) has a diameter which is smaller than the diameter of a first central recess (A1) of the swing body (S) and which is larger than the diameter of a second central recess (A2) of the centred ball bearing (L) and has a width, which corresponds to half the width of the swing body (S) minus half the width of the centred ball bearing (L) plus a distance ($B_5$) between the swing body (S) and the inner face (I2) of the second disc-shaped side cap (K2), and the second region of the second centred extension (P2) which abuts against the first region of the second centred extension (P2) has a diameter corresponding to the diameter of the second central recess (A2) of the centred ball bearing (L).

26. The rotatable play body according to claim 1, wherein the second centred extension (P2) of the second disc-shaped side cap (K2) engages the first centred extension (P1) of the side cap (K1) or the second extension (P2) of the side cap (K2) can be connected to the first extension (P1) of the side cap (K1) during engagement in such a way that a compressive force of at least 20 N is required to establish the connection and a tensile force of at least 20 N is required to disconnect this connection.

27. The rotatable play body according to claim 1, wherein the outer shell (M) exhibits one or more recesses.

28. The rotatable play body according to claim 1, wherein the first disc-shaped side cap (K1) and/or the second disc-shaped side cap (K2) exhibit one or more recesses at the outer edge (R1, R2) of the side cap (K1, K2).

29. The rotatable play body according to claim 1, wherein the first disc-shaped side cap (K1) and/or the second disc-shaped side cap (K2) exhibit one or more recesses which are completely enclosed by the material of the respective side cap (K1, K2).

* * * * *